United States Patent [19]

Saitoh et al.

[11] Patent Number: 4,696,882

[45] Date of Patent: Sep. 29, 1987

[54] MEMBER HAVING LIGHT RECEIVING LAYER WITH SMOOTHLY INTERCONNECTING NONPARALLEL INTERFACES

[75] Inventors: Keishi Saitoh, Ibaraki; Tetsuo Sueda, Chofu; Kyosuke Ogawa, Tokyo; Teruo Misumi, Kawasaki; Yoshio Tsuezuki, Toride; Masahiro Kanai, Tokyo, all of Japan

[73] Assignee: Canon Kabushiki Kaisha, Tokyo, Japan

[21] Appl. No.: 753,011

[22] Filed: Jul. 8, 1985

[30] Foreign Application Priority Data

| | | | |
|---|---|---|---|
| Jul. 12, 1984 | [JP] | Japan | 59-143294 |
| Jul. 13, 1984 | [JP] | Japan | 59-144387 |
| Jul. 16, 1984 | [JP] | Japan | 59-146110 |
| Jul. 17, 1984 | [JP] | Japan | 59-146968 |
| Jul. 18, 1984 | [JP] | Japan | 59-150187 |
| Jul. 19, 1984 | [JP] | Japan | 59-148651 |
| Oct. 22, 1984 | [JP] | Japan | 59-220377 |
| Oct. 23, 1984 | [JP] | Japan | 59-221257 |
| Oct. 24, 1984 | [JP] | Japan | 59-222225 |
| Oct. 25, 1984 | [JP] | Japan | 59-223019 |
| Oct. 26, 1984 | [JP] | Japan | 59-224038 |
| Oct. 27, 1984 | [JP] | Japan | 59-225107 |

[51] Int. Cl.[4] ..... G03G 5/085

[52] U.S. Cl. ..... 430/57; 430/65; 430/128

[58] Field of Search ..... 430/56, 57, 58, 65, 430/69, 84, 127

[56] References Cited

U.S. PATENT DOCUMENTS

| | | | |
|---|---|---|---|
| 4,359,514 | 11/1982 | Shimizu et al. | 430/65 |
| 4,492,745 | 1/1985 | Mimura et al. | 430/67 |
| 4,514,483 | 4/1985 | Matsuura et al. | 430/84 |
| 4,592,981 | 6/1986 | Saitoh et al. | 430/69 |
| 4,592,983 | 6/1986 | Saitoh et al. | 430/69 |
| 4,595,644 | 6/1986 | Saitoh et al. | 430/69 |
| 4,600,671 | 7/1986 | Saitoh et al. | 430/69 |

FOREIGN PATENT DOCUMENTS

| | | | |
|---|---|---|---|
| 2733187 | 1/1978 | Fed. Rep. of Germany | 430/65 |
| 56-150754 | 11/1981 | Japan | 430/65 |
| 60-31144 | 2/1985 | Japan | 430/69 |

*Primary Examiner*—John L. Goodrow

*Attorney, Agent, or Firm*—Fitzpatrick, Cella, Harper & Scinto

[57] ABSTRACT

A light-receiving member comprises a substrate and a light-receiving layer of a multi-layer structure having a first layer comprising an amorphous material containing silicon atoms and germanium atoms and a second layer comprising an amorphous material containing silicon atoms and exhibiting photoconductivity provided successively from the substrate side, said light-receiving layer having at least one pair of non-parallel interfaces within a short range and said non-parallel interfaces being aranged in a large number in at least one direction within the plane perpendicular to the layer thickness direction, said non-parallel interfaces being connected to one another smoothly in the direction in which they are arranged.

56 Claims, 79 Drawing Figures

MEMBER HAVING LIGHT RECEIVING LAYER WITH SMOOTHLY INTERCONNECTING NONPARALLEL INTERFACES

CROSS-REFERENCE TO RELATED APPLICATIONS

This application contains subject matter related to commonly assigned, copending application Ser. Nos. 697,141; 699,868; 705,516; 709,888; 720,011; 740,901; 786,970; 725,751; 726,768, 719,980; 739,867, 740,714,714; 741,300; 753,048; 752,920 and 753,011.

BACKGROUND OF THE INVENTION

1. Field of the invention

This invention relates to a light-receiving member having sensitivity to electromagnetic waves such as light [herein used in a broad sense, including ultraviolet rays, visible light, infrared rays, X-rays and gamma-rays]. More particularly, it pertains to a light-receiving member suitable for using a coherent light such as laser beam.

2. Description of the prior art

As the method for recording a digital image information as an image, there have been well known the methods in which an electrostatic latent image is formed by scanning optically a light-receiving member with a laser beam modulated corresponding to a digital image information, then said latent image is developed, followed by processing such as transfer or fixing, if desired, to record an image. Among them, in the image forming method employing electrophotography, image recording has been generally practiced with the use of a small size and inexpensive He-Ne laser or a semiconductor laser (generally having an emitted wavelength of 650–820 nm).

In particular, as the light-receiving member for electrophotography which is suitable when using a semiconductor laser, an amorphous material containing silicon atoms (hereinafter written briefly as "A-Si") as disclosed in Japanese Laid-open patent application Nos. 86341/1979 and 83746/1981 is attracting attention for its high Vickers hardness and non-polluting properties in social aspect in addition to the advantage of being by far superior in matching in its photosensitive region as compared with other kinds of light-receiving members.

However, when the photosensitive layer is made of a single A-Si layer, for ensuring dark resistance of $10^{12}$ ohm.cm or higher required for electrophotography while maintaining high photosensitivity, it is necessary to incorporate structurally hydrogen atoms or halogen atoms or boron atoms in addition thereto in controlled form within specific ranges of amounts. Accordingly, control of layer formation is required to be performed severely, whereby tolerance in designing of a light-receiving member is considerably limited.

As attempts to enlarge this tolerance in designing, namely to enable effective utilization of its high photosensitivity in spite of somewhat lower dark resistance, there have been proposed a light-receiving layer with a multi-layer structure of two or more laminated layers with different conductivity characteristics with formation of a depletion layer within the light-receiving layer, as disclosed in Japanese Laid-open Patent Application Nos. 121743/1979, 4053/1982 and 4172/1982, or a light-receiving member with a multi-layer structure in which a barrier layer is provided between the substrate and the photosensitive layer and/or on the upper surface of the photosensitive layer, thereby enhancing apparent dark resistance of the light receiving layer as a whole, as disclosed in Japanese Laid-open patent application Nos. 52178/1982, 52179/1982, 52180/1982, 58159/1982, 58160/1982 and 58161/ 1982.

According to such proposals, A-Si type light receiving members have been greatly advanced in tolerance in designing of commercialization thereof or easiness in management of its production and productivity, and the speed of development toward commercialization is now further accelerated.

When carrying out laser recording by use of such a light receiving member having a light receiving layer of a multi-layer structure, due to irregularity in thickness of respective layers, and also because of the laser beam which is an coherent monochromatic light, it is possible that the respective reflected lights reflected from the free surface on the laser irradiation side of the light receiving layer and the layer interface between the respective layers constituting the light receiving layer and between the substrate and the light receiving layer (hereinafter "interface" is used to mean comprehensively both the free surface and the layer interface) may undergo interference.

Such an interference phenomenon results in the so-called interference fringe pattern in the visible image formed and causes a poor iamge. In particular, in the case of forming a medium tone image with high gradation, bad appearance of the image will become marked.

Moreover, as the wavelength region of the semiconductor laser beam is shifted toward longer wavelength, absorption of said laser beam in the photosensitive layer becomes reduced, whereby the above interference phenomenon becomes more marked.

This point is explained by referring to the drawings.

FIG. 1 shows a light $I_0$ entering a certain layer constituting the light receiving layer of a light receiving member, a reflected light $R_1$ from the upper interface 102 and a reflected light $R_2$ reflected from the lower interface 101.

Now, the average layer thickness of the layer is defined as d, its refractive index as n and the wavelength of the light as $\lambda$, and when the layer thickness of a certain layer is ununiform gently with a layer thickness difference of $\lambda/2n$ or more, changes in absorbed light quantity and transmitted light quantity occur depending on to which condition of $2nd=m\lambda$(m is an integer, reflected lights are strengthened with each other) and $2nd=(m+\frac{1}{2})\lambda$(m is an integer, reflected lights are weakened with each other) the reflected lights $R_1$ and $R_2$ conform.

In the light receiving member of a multi-layer structure, the interference effect as shown in FIG. 1 occurs at each layer, and there ensues a synergistic deleterious influence through respective interferences as shown in FIG. 2. For this reason, the interference fringe corresponding to said interference fringe pattern appears on the visible image transferred and fixed on the transfer member to cause bad images.

As the method for cancelling such an inconvenience, it has been proposed to subject the surface of the substrate to diamond cutting to provide unevenness of ±500Å- ±10000Å, thereby forming a light scattering surface (as disclosed in Japanese Laid-open Patent Application No. 162975/1983); to provide a light absorbing layer by subjecting the aluminum substrate surface to black Alumite treatment or dispersing carbon, color pigment or dye in a resin (as disclosed in Japanese Laid-open Patent Application No. 165845/1982); and to provide a light scattering reflection preventive layer on the substrate surface by subjecting the aluminum substrate surface to satin-like Alumite treatment or by providing a sandy fine unevenness by sand blast (as disclosed in Japanese Laid-open Patent Application No. 16554/1982).

However, according to these methods of the prior art, the interference fringe pattern appearing on the image could not completely be cancelled.

For example, because only a large number of unevenness with specific sized are formed on the substrate surface according to the first method, although prevention of appearance of interference fringe through light scattering is indeed effected, regular reflection light component yet exists. Therefore, in addition to remaining of the interference fringe by said regular reflection light, enlargement of irradiated spot occurs due to the light scattering effect on the surface of the substrate to be a cause for substantial lowering of resolution.

As for the second method, such a black Alumite treatment is not sufficinent for complete absorption, but reflected light from the substrate surface remains. Also, there are involved various inconveniences. For example, in providing a resin layer containing a color pigment dispersed therein, a phenomenon of degassing from the resin layer occurs during formation of the A-Si photosensitive layer to markedly lower the layer quality of the photosensitive layer formed, and the resin layer suffers from a damage by the plasma during formation of A-Si photosensitive layer to be deteriorated in its inherent absorbing function. Besides, worsening of the surface state deleteriously affects subsequent formation of the A-Si photosensitive layer.

In the case of the third method of irregularly roughening the substrate surface, as shown in FIG. 3, for example, the incident light $I_0$ is partly reflected from the surface of the light receiving layer 302 to become a reflected light $R_1$, with the remainder progressing internally through the light receiving layer 302 to become a transmitted light $I_1$. The transmitted light $I_1$ is partly scattered on the surface of the substrate 301 to become scattered lights $K_1$, $K_2$, $K_3$. . . $K_n$, with the remainder being regularly reflected to become a reflected light $R_2$, a part of which goes outside as an emitted light $R_3$. Thus, since the reflected light $R_1$ and the emitted light $R_3$ which is an interferable component remain, it is not yet possible to extinguish the interference fringe pattern.

On the other hand, if diffusibility of the surface of the substrate 301 is increased in order to prevent multiple reflections within the light receiving layer 302 through prevention of interference, light will be diffused within the light receiving layer 302 to cause halation, whereby resolution is disadvantageously lowered.

Particularly, in a light receiving member of a multi-layer structure, as shown in FIG. 4, even if the surface of the substrate 401 may be irregularly roughened, the reflected light $R_2$ from the first layer 402, the reflected light $R_1$ from the second layer 403 and the regularly reflected light $R_3$ from the surface of the substrate 401 are interfered with each other to form an interference fringe pattern depending on the respective layer thicknesses of the light receiving member. Accordingly, in a light receiving member of a multi-layer structure, it was impossible to completely prevent appearance of interference fringes by irregularly roughening the surface of the substrate 401.

In the case of irregularly roughening the substrate surface according to the method such as sand blasting, etc., the roughness will vary so much from lot to lot, and there is also nonuniformity in roughness even in the same lot, and therefore production control could be done with inconvenience. In addition, relatively large projections with random distributions are frequently formed, hence causing local breakdown of the light receiving layer during charging treatment.

On the other hand, in the case of simply roughening the surface of the substrate 501 regularly, as shown in FIG. 5, since the light-receiving layer 502 is deposited along the uneven shape of the surface of the substrate 501, the slanted plane of the unevenness of the substrate 501 becomes parallel to the slanted plane of the unevenness of the light receiving layer 502.

Accordingly, for the incident light on that portion, $2nd_1=m\lambda$ or $2nd_1=(m+\frac{1}{2})\lambda$ holds, to make it a light portion or a dark portion. Also, in the light receiving layer as a whole, since there is nonuniformity in which the maximum difference among the layer thicknesses $d_1$, $d_2$, $d_3$ and $d_4$ of the light receiving layer is $\lambda/2n$ or more, there appears a light and dark fringe pattern.

Thus, it is impossible to completely extinguish the interference fringe pattern by only roughening regularly the surface of the substrate 501.

Also, in the case of depositing a light receiving layer of a multi-layer structure on the substrate, the surface of which is regularly roughened, in addition to the interference between the regularly reflected light from the substrate surface and the reflected light from the light receiving layer surface as explained for light receiving member of a single layer structure in FIG. 3, interferences by the reflected lights from the interfaces between the respective layers participate to make the extent of appearance of interferance fringe pattern more complicated than in the case of the light receiving member of a single layer structure.

SUMMARY OF THE INVENTION

An object of the present invention is to provide a novel light-recieving member sensitive to light, which has cancelled the drawbacks as described above.

Another object of the present invention is to provide a light receiving member which is suitable for image formation by use of a coherent monochromatic light and also easy in production management.

Still another object of the present invention is to provide a light- receiving member which can cancel the interference fringe pattern appearing during image formation and appearance of speckless on reversal developing at the same time and completely.

Still another object of the present invention is to provide a light-receiving member which is high in dielectric strength and photosensitivity and excellent in electrophotographic characteristics.

Still another object of the present invention is to provide a light-recieving member, which can provide an image of high quality which is high in density, clear in halftone and high in resolution and is suitable for electrophotography.

According to the present invention, there is provided a light-receiving member comprising a substrate and a light-receiving layer of a multi-layer structure having a first layer comprising an amorphous material containing silicon atoms and germanium atoms and a second layer comprising an amorphous material containing silicon atoms and exhibiting photoconductivity provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

DESCRIPTION OF THE PREFERRED EMBODIMENTS

Referring now to the accompanying drawings, the present invention is to be described in detail.

Figure 1:
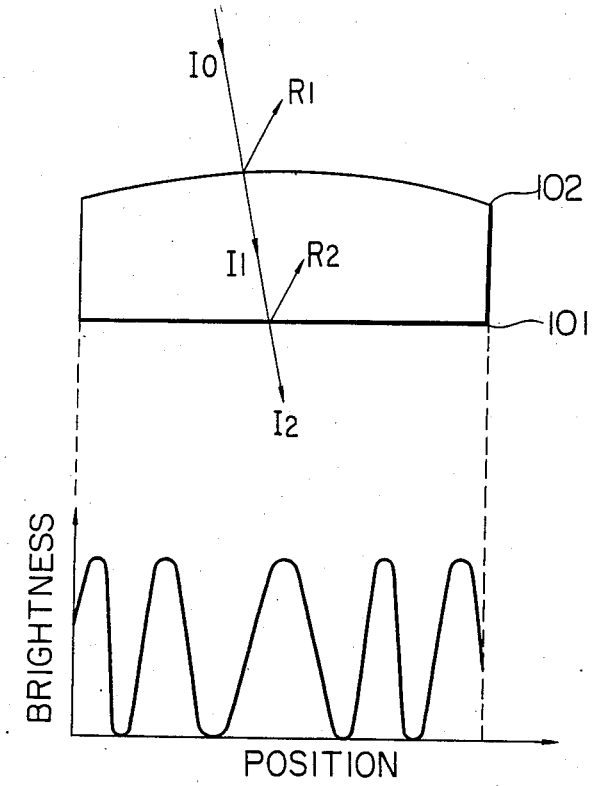
FIG. 1 is a schematic illustration of interference in general.
Figure 2:
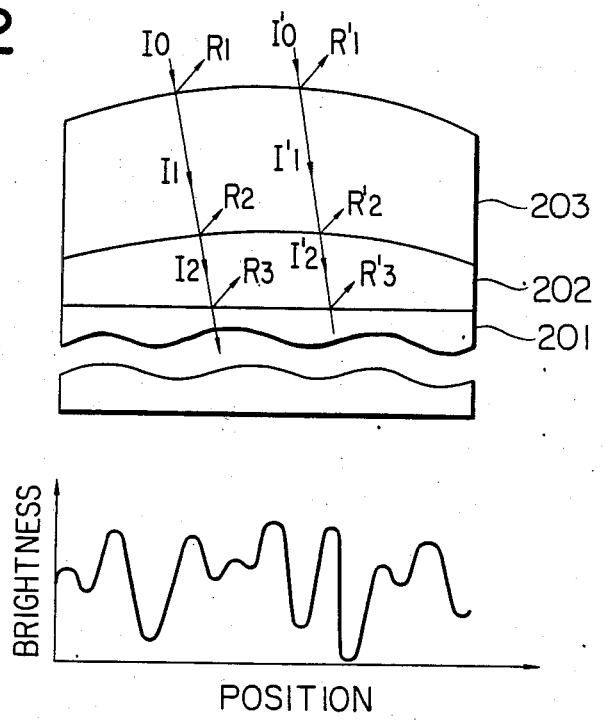
FIG. 2 is a schematic illustration of appearance of interference fringe in the case of a multi-layer light-receiving member.
Figure 3:
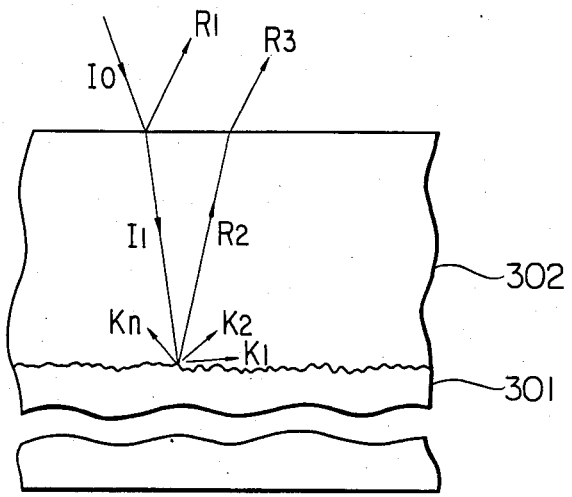
FIG. 3 is a schematic illustration of appearance of interference fringe by scattered light.
Figure 4:
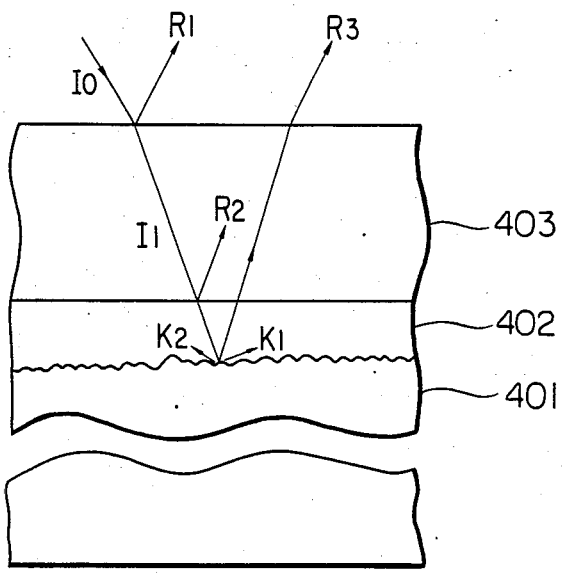
FIG. 4 is a schematic illustration of appearance of interference fringe by scattered light in the case of a multi-layer light-receiving member.
Figure 5:
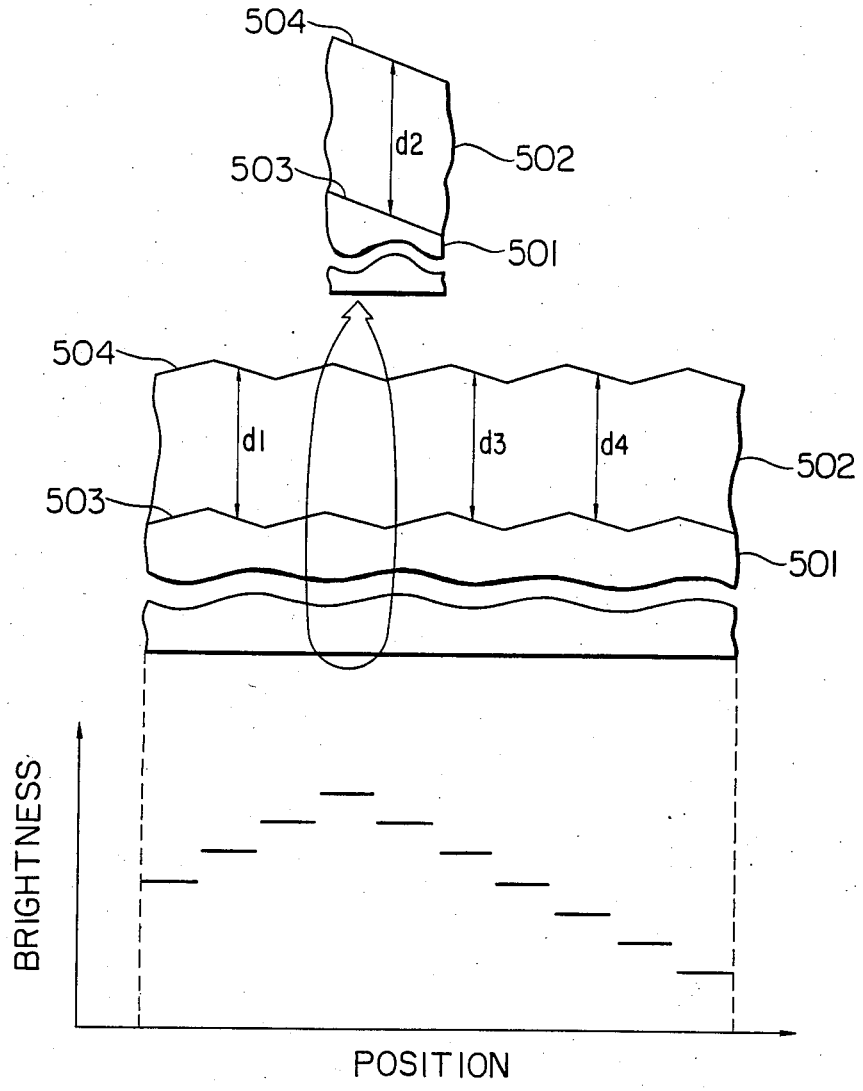
FIG. 5 is a schematic illustration of interference fringe in the case where the interfaces of respective layers of a light-receiving member are parallel to each other.
Figure 6:
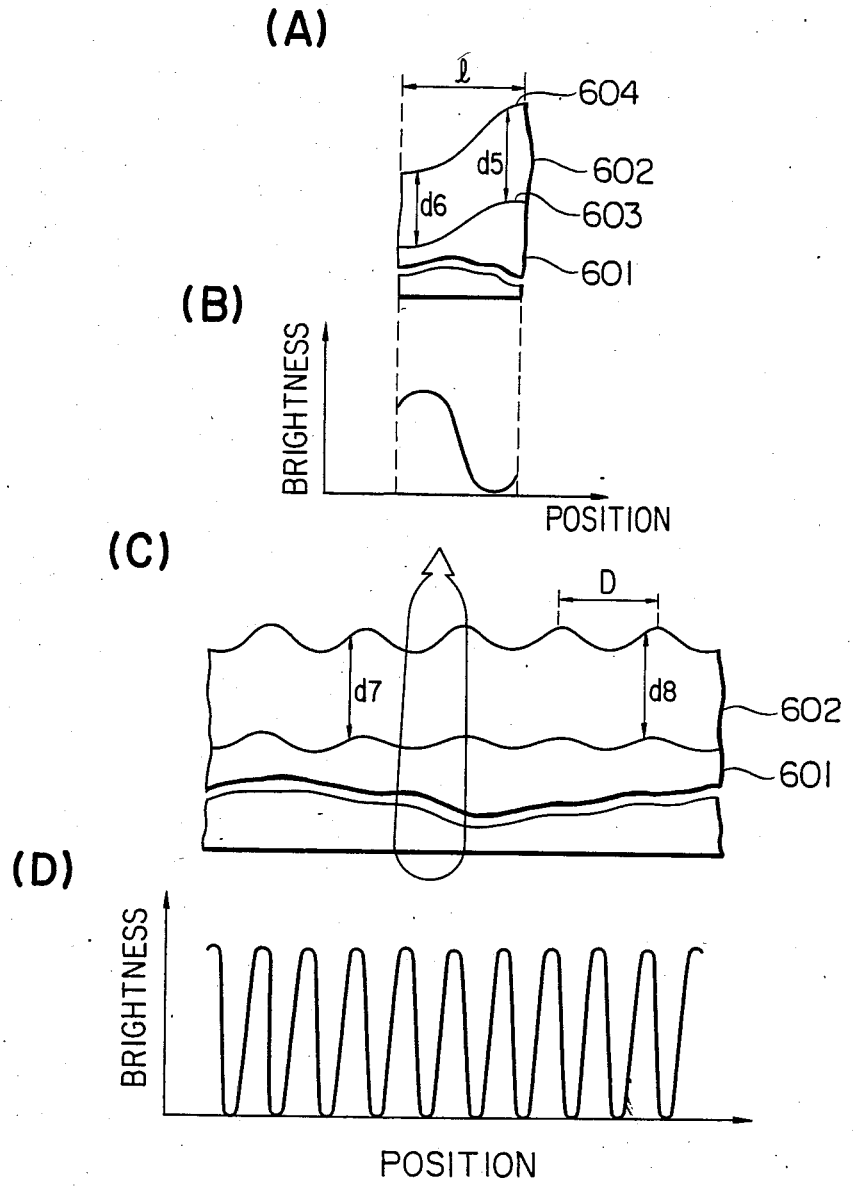
FIG. 6 is a schematic illustration about no appearance of interference fringe in the case of non-parallel interfaces between respective layers of a light-receiving member.

FIG. 6 is a schematic illustration for explanation of the basic principle of the present invention.

In the present invention, on a substrate (not shown) having a fine smooth unevenness smaller than the resolution required for the device, a light-receiving layer of a multi-layer constitution is provided along the uneven slanted plane, with the thichness of the second layer 602 being continuously changed from $d_5$ to $d_6$, as shown enlarged in a part of FIG. 6, and therefore the interface 603 and the interface 604 have respective gradients. Accordingly, the coherent light incident on this minute portion (short range region ) l [indicated schematically in FIG. 6 (C), and its enlarged view shown in FIG. 6 (A)] undergoes interference at said minute portion l to form a minute interference fringe pattern.

Figure 7:
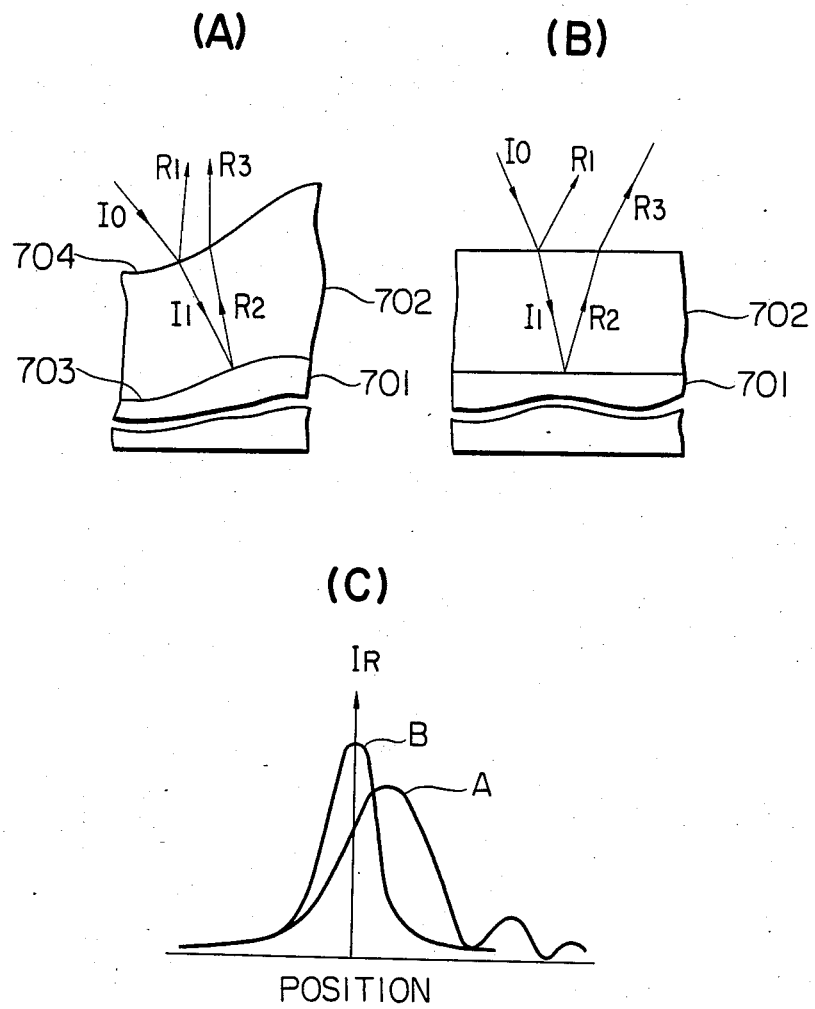
FIG. 7 is a schematic illustration of comparison of the reflected light intensity between the case of parallel interfaces and non-parallel interfaces between the respective layers of a light-receiving member.
Figure 8:
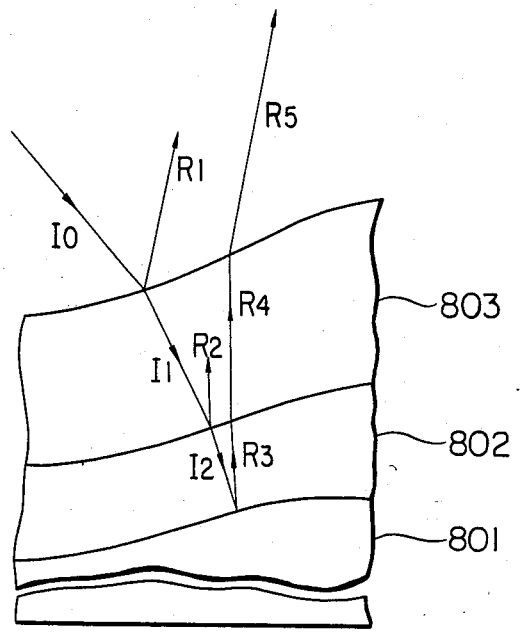
FIG. 8 is a schematic illustration of no appearance of interference fringe in the case of non-parallel interfaces between respective layers as developed.

Also, as shown in FIG. 7, when the interface 703 between the first layer 701 and the second layer 702 and the free surface 704 are non-parallel to each other, the reflected light $R_1$ and the emitted lgiht $R_3$ are different in direction of progress from each other relative to the incident light $I_0$ as shown in FIG. 7 (A), and therefore the degree of interference will be reduced as compared with the case (FIG. 7 (B)) when the interfaces 703 and 704 are parallel to each other.

Accordingly, as shown in FIG. 7 (C), as compared with the case "(B)" where a pair of the interfaces are in parallel relation, the difference in lightness and darkness in the interference fringe pattern becomes negligibly small even if interfered, if any, in the non-parallel case "(A)".

The same is the case, as shown in FIG. 6, even when the layer thickness of the layer 602 may be macroscopically ununiform ($d_7 \div d_8$), and therefore the incident light quantity becomes uniform all over the layer region (see FIG. 6 (D)).

To describe about the effect of the present invention when coherent light is transmitted from the irradiation side to the first layer in the case of a light-receiving layer of a multi-layer structure, reflected lights $R_1$, $R_2$, $R_3$, $R_4$ and $R_5$ exsit in connection with the incident light $I_0$. Accordingly, at the respective layers, the same phenomenon as described with reference to FIG. 7 occurs.

Therefore, when considered for the light-receiving layer as a whole, interference occurs as a synergetic effect of the respective layers and, according to the present invention, appearance of interference can further be prevented as the number of layers constituting the light-receiving layer is increased.

The interference fringe occurring within the minute portion cannot appear on the image, because the size of the minute portion is smaller than the spot size of the irradiated light, namely smaller than the resolution limit. Further, even if appeared on the image, there is no problem at all, since it is less than resolving ability of the eyes.

In the present invention, the slanted plane of unevenness should desirably be mirror finished in order to direct the reflected light assuredly in one direction.

The size l (one cycle of uneven shape) of the minute portion suitable for the present invention is $l \leqq L$, wherein L is the spot size of the irradiation light.

Further, in order to accomplish more effectively the objects of the present invention, the layer thickness difference ($d_5 - d_6$) at the minute portion 1 should desirably be as follows:

$d_5 - d_6 \geqq \lambda/2n$ (where $\lambda$ is the wavelength of the irradiation light and n is the refractive index of the second layer 602).

In the present invention, within the layer thickness of the minute portion l (hereinafter called as "minute column") in the light-receiving layer of a multi-layer structure, the layer thicknesses of the respective layers are controlled so that at least two interfaces between layers may be in non-parallel relationship, and, provided that this condition is satisfied, any other pair of two interfaces between layers may be in parallel relationship within said minute column.

However, it is desirable that the layers forming parallel interfaces should be formed to have uniform layer thicknesses so that the difference in layer thickness at any two positions may be not more than:

$\lambda/2n$ (n: refractive index of the layer).

For formation of the respective layers of the first layer and the second layer constituting the light-receiving layer, in order to accomplish more effectively and easily the objects of the present invention, the plasma chemical vapor deposition method (PCVD method), the optical CVD method and thermal CVD method can be employed, because the layer thickness can accurately be controlled on the optical level thereby.

The smooth unevenness to be provided on the substrate surface can be formed by fixing a bite having a circular cutting blade at a predetermined position on a cutting working machine such as milling machine, lathe, etc., and cut working accurately the substrate surface by, for example, moving regularly in a certain direction while rotating a cylindrical substrate according to a program previously designed as desired, thereby forming to a desired smooth unevenness shape, pitch and depth. The sinusoidal linear projection produced by the unevenness formed by such a cutting working has a spiral structure with the center axis of the cylindrical substrate as its center.

Figure 9:
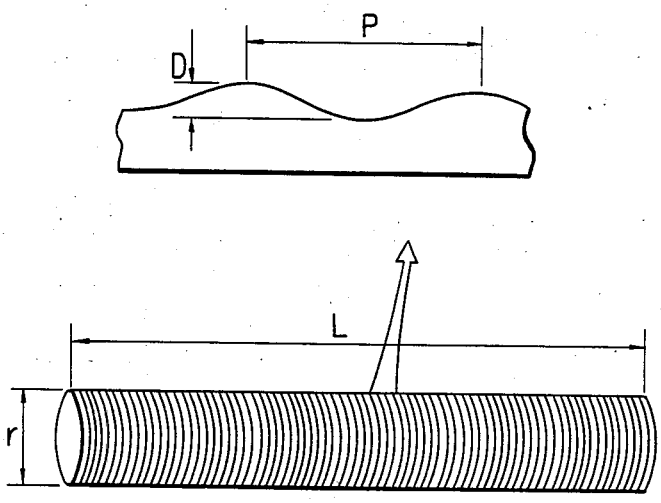
FIG. 9 is a schematic illustration of the surface state of the substrate.

An example of such a structure is shown in FIG. 9. In FIG. 9, L is the length of the substrate, r is the diameter of the substrate, P is the spiral pitch and D is the depth of groove.

The spiral structure of the sinusoidal projection may be made into a multiple spiral structure such as double or triple structure or a crossed spital structure.

Alternatively, a straight line structure along the center axis may also be introduced in addition to the spiral structure.

In the present invention, the respective dimensions of the smooth unevenness provided on the substrate surface under managed condition are set so as to accomplish efficiently the objects of the present invention in view of the following points.

More specifically, in the first place, the A-Si layer constituting the light-receiving layer is sensitive to the structure of the surface on which the layer formation is effected, and the layer quality will be changed greatly depending on the surface condition.

Accordingly, it is necessary to set dimensions of the smooth unevenness to be provided on the substrate surface so that lowering in layer quality of the A-Si layer may not be brought about.

Secondly, when there is an extreme unevenness on the free surface of the light-receiving layer, cleaning cannot completely be performed in cleaning after image formation.

Further, in case of practicing blade cleaning, there is involved the problem that the blade will be damaged more earlily.

As the result of investigations of the problems in layer deposition as described above, problems in process of electrophotography and the conditions for prevention of interference fringe pattern, it has been found that the pitch at the recessed portion on the substrate surface should preferably be 0.3 to 500 μm, more preferably 1 to 200 μm, most preferably 5 to 50μm.

It is also desirable that the maximum depth of the recessed portion should preferably be made 0.1 to 5 μm, more preferably 0.3 to 3 μm, most preferably 0 6 to 2 μm. When the pitch and the maximum depth of the recessed portions on the substrate surface are within the ranges as specified above, the gradient of the slanted plane connecting the minimum value point and the maximum value point, respectively, of the adjacent recessed portion and protruded portion may preferably be 1° to 20°, more preferably 3° to 15°, most preferably 4° to 10°.

On the other hand, the maximum of the difference in the layer thickness based on such an uniformness in layer thichness of the respective layers formed on such a substrate should preferably be made 0.1 μm to 2 μm within the same pitch, more preferably 0.1 μm to 1.5 μm, most preferably 0.2 μm to 1 μm.

Further, the light-receiving layer in the light-receiving member of the present invention has a multi-layer structure comprising a first layer constituted of an amorphous material containing silicon atoms and germanium atoms and a second layer constituted of an amorphous material containing silicon atoms and exhibiting photoconductivity provided on a substrate successively from the substrate side, and therefore can exhibit very excellent electrical, optical and photoconductive characteristics, dielectric strength as well as good use environmental characteristics.

In particular, when it is applied as a light-receiving member for electrophotography, there is no influence of residual potential on image formation at all, with its electrical properties being stable with high sensitivity and high SN ratio, also excellent in light fatigue resistance and repeated use characteristics, whereby it is possible to obtain repeatedly and stably images of high quality with high density, clear halftone and high resolution.

Further, the light-receiving member of the present invention is high in photosensitivity over the all visible light regions, particularly in photosensitivity to the light of longer wavelength region and is therefore excellent in matching to semiconductor laser and also rapid in light response.

Referring now the drawings, the light-receiving member of the present invention is to be described in detail.

Figure 10:
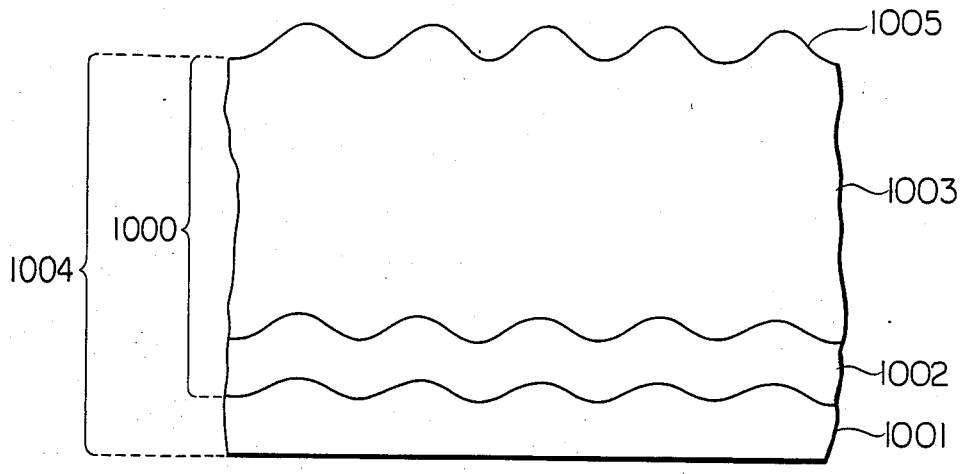
FIG. 10 is a schematic illustration of the layer constitution of the light-receiving member.

FIG. 10 shows a schematic sectional view for illustration of the layer structure of an embodiment of the light-receiving member of the present invention.

The light-receiving member 1004 as shown in FIG. 10 has a light-receiving layer 1000 on a substrate for light-receiving member 1001, said light-receiving layer 1000 having a free surface 1005 on one end surface.

The light-receiving layer 1000 has a layer structure constituted of a first layer (G) 1002 comprising an amorphous material containing silicon atoms and germanium atoms and, if desired, hydrogen atoms (H) and/or halogen atoms (X) (hereinafter abbreviated as "A-SiGe(H,X)") and a second layer (S) 1003 comprising A-Si containing, if desired, hydrogen atoms (H) and/or halogen atoms (X) (hereinafter abbreviated as A-Si(H,X)) and exhibiting photoconductivity laminated successively from the substrate 1001 side.

The germanium atoms contained in the first layer (G) 1002 may be contained so that the distribution state may be uniform within the first layer (G), or they can be contained continuously in the layer thickness direction in said first layer (G) 1002, being more enriched at the substrate 1001 side toward the side opposite to the side where said substrate 1001 is provided (the surface 1005 side of the light-receiving layer 1001).

When the distribution state of the germanium atoms contained in the first layer (G) is ununiform in the layer thickness direction, it is desirable that the distribution state should be made uniform in the interplanar direction in parallel to the surface of the substrate.

In the present invention, in the second layer (S) provided on the first layer (G), no germanium atoms is contained and by forming a light-receiving layer to such a layer structure, the light-receiving member obtained can be excellent in photosensitivity to the light with wavelengths of all the regions from relatively shorter wavelength to relatively longer wavelength, including visible light region.

Also, when the distribution state of germanium atoms in the first layer (G) is ununiform in the layer thickness direction, the germanium atoms are distributed continuously throughout the whole layer region while giving a change in distribution concentration C of the germanium atoms in the layer thickness direction which is decreased from the substrate toward the second layer (S), and therefore affinity between the first layer (G) and the second layer (S) is excellent. Also, as described as hereinafter, by extremely increasing the distribution concentration C of germanium atoms at the end portion on the substrate side extremely great, the light on the longer wavelength side which cannot substantially be absorbed by the second layer (S) can be absorbed in the first layer (G) substantially completely, when employing a semiconductor laser, whereby interference by reflection from the substrate surface can be prevented.

Also, in the light-receiving member of the present invention, the respective amorphous materials constituting the first layer (G) and the second layer (S) have the common constituent of silicon atoms, and therefore chemical stability can sufficiently be ensured at the laminated interface.

FIGS. 11 through 19 show typical examples of distribution in the layer thickness direction of germanium atoms contained in the first layer region (G) of the light-receiving member in the present invention.

In FIGS. 11 through 19, the abscissa indicates the content C of germanium atoms and the ordinate the layer thickness of the first layer (G), $t_B$ showing the position of the end surface of the first layer (G) on the substrate side and $t_T$ the position of the end surface of the first layer (G) on the side opposite to the substrate side. That is, layer formation of the first layer (G) containing germanium atoms proceeds from the $t_B$ side toward the $t_T$ side.

Figure 11:
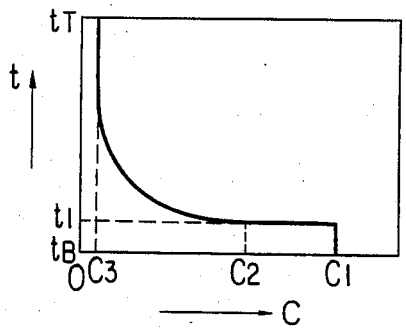
FIGS. 11 through 19 are schematic illustrations of depth profiles of germanium atoms in the first layer.

In FIG. 11, there is shown a first typical embodiment of the depth profile of germanium atoms in the layer thickness direction contained in the first layer (G).

In the embodiment as shown in FIG. 11, from the interface position $t_B$ at which the surface, on which the first layer (G) containing germanium atoms is to be formed, comes into contact with the surface of said first layer (G) to the position $t_1$, germanium atoms are contained in the first layer (G) formed, while the distribution concentration C of germanium atoms taking a constant value of $C_1$, the concentration being gradually decreased from the concentration $C_2$ continuously from the position $t_1$ to the interface position $t_T$. At the interface position $t_T$, the distribution concentration C of germanium atoms is made $C_3$.

Figure 12:
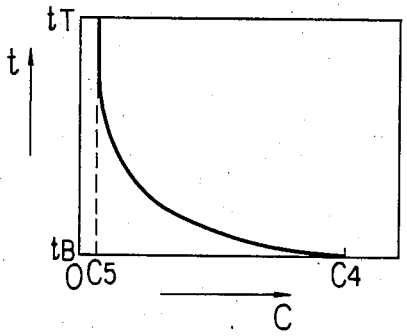

In the embodiment shown in FIG. 12, the distribution concentration C of germanium atoms contained is decreased gradually and continuously from the position $t_B$ to the position $t_T$ from the concentration $C_4$ until it becomes the concentration $C_5$ at the position $t_T$.

Figure 13:
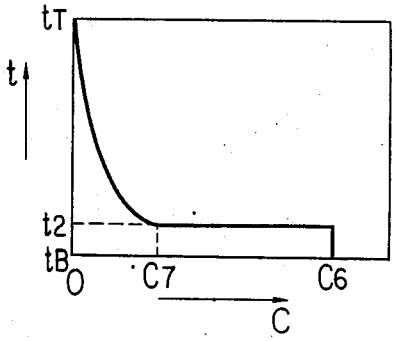

In case of FIG. 13, the distribution concentration C of germanium atoms is made constant as $C_6$ at the position $t_B$, gradually decreased continuously from the position $t_2$ to the position $t_T$, and the concentration C is made substantially zero at the position $t_T$ (substahtially zero herein means the content less than the detectable limit).

Figure 14:
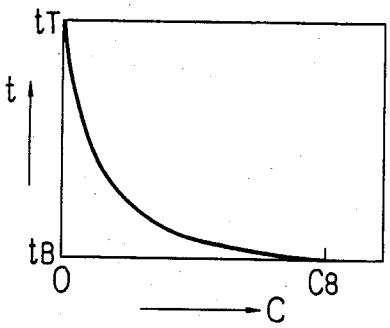

In case of FIG. 14, germanium atoms are decreased gradually and continuously from the position $t_B$ to the position $t_T$ from the concentration $C_8$, until it is made substantially zero at the position $t_T$.

Figure 15:
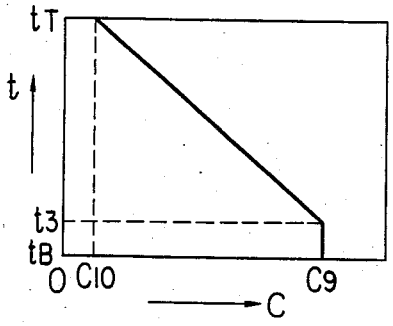

In the embodiment shown in FIG. 15, the distribution concentration C of germanium atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 16:
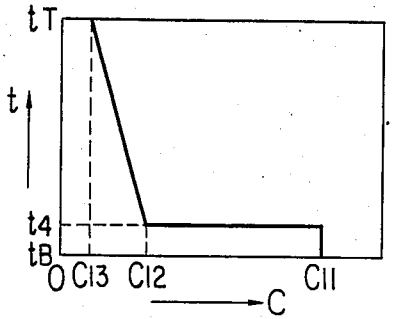

In the embodiment shown in FIG. 16, there is formed a depth profile such that the distribution concentration C takes a constant value of $C_{11}$ from the position tB to the position $t_4$, and is decreased as a first order function from the concentration $C_{12}$ to the concentration $C_{13}$ from the position $t_4$ to the position $t_T$.

Figure 17:
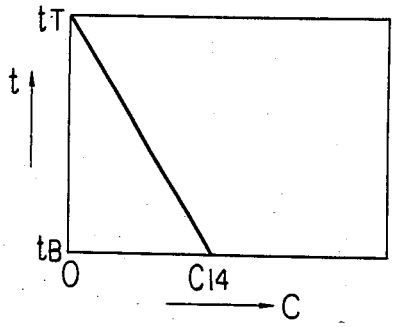

In the embodiment shown in FIG. 17, the distribution concentration C of germanium atoms is decreased as a first order function from the concentration $C_{14}$ to zero from the position $t_B$ to the position $t_T$.

Figure 18:
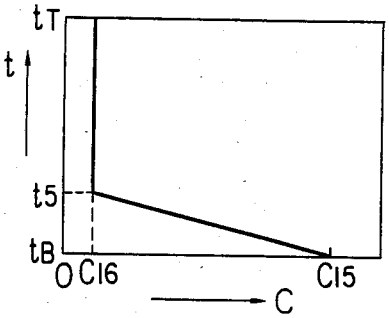

In FIG. 18, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 19:
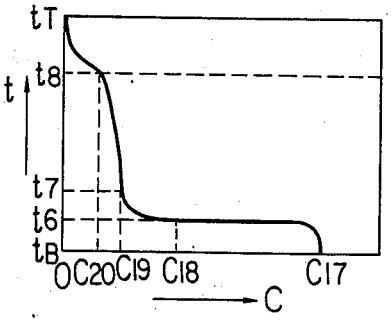

In the embodiment shown in FIG. 19, the distribution concentration C of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$ Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer (G) in the direction of the layer thickness by referring to FIGS. 11 through 19, when the distribution state of germanium atoms is ununiform in the layer thickness direction, the first layer (G) is provided desirably in a depth profile so as to have a portion enriched in distribution concentration C of germanium atoms on the substrate side and a portion depleted in distribution concentration C of germanium atoms considerably lower than that of the substrate side on the interface $t_T$ side The first layer (G) constituting the light-receiving member in the present invention is desired to have a localized region (A) containing germanium atoms at a relatively higher concentration on the substrate side as described above.

In the present invention, the localized region (A), as explained in terms of the symbols shown in FIG. 11 through FIG. 19, may be desirably provided within 5μ from the interface position $t_B$.

In the present invention, the above localized region. (A) may be made to be identical with the whole of the layer region ($L_T$) on the interface position $t_B$ to the thickness of 5μ, or alternatively a part of the layer region ($L_T$).

It may suitably be determined depending on the characteristics required for the light-receiving layer to be formed, whether the localized region (A) is made a part or whole of the layer region ($L_T$).

The localized region (A) may preferably be formed according to such a layer formation that the maximum value Cmax of the concentrations of germanium atoms in a distribution in the layer thickness direction may preferably be 1000 atomic ppm or more, more preferably 5000 atomic ppm or more, most preferably $1\times10^4$ atomic ppm or more based on silicon atoms.

That is, according to the present invention, it is desirable that the layer region (G) containing germanium atoms is formed so that the maximum value Cmax of the distribution concentration C may exist within a layer thickness of 5μ from the substrate side (the layer region within 5μ thickness from $t_B$).

In the present invention, the content of germanium atoms in the first layer (G), which may suitably be determined as desired so as to acheive effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the present invention, the layer thickness of the first layer (G) and the thickness of the second layer (S) are one of the important factors for accomplishing effectively the objects of the present invention, and therefore sufficient care should desirably be paid in designing of the light-receiving member so that desirable characteristics may be imparted to the light-receiving member formed.

In the present invention, the layer thickness $T_B$ of the first layer (G) may preferably be 30 Å to 50μ, more preferably 40 Å to 40 μ, most preferably 50 Å to 30 μ.

On the other hand, the layer thickness T of the second layer (S) may be preferably 0.5 to 90μ, more preferably 1 to 80μ, most preferably 2 to 50μ.

The sum of the above layer thicknesses T and $T_B$, namely ($T+T_B$) may be suitably determined as desired in designing of the layers of the light-receiving member, based on the mutual organic relationship between the characteristics required for both layer regions and the characteristics required for the whole light-receiving layer.

In the light-receiving member of the present invention, the numerical range for the above ($T_B+T$) may generally be from 1 to 100μ, preferably 1 to 80μ, most preferably 2 to 50μ.

In a more preferred embodiment of the present invention, it is preferred to select the numerical values for respective thicknesses $T_B$ and T as mentioned above so that the relation of $T_B/T\leqq1$ may be satisfied.

In selection of the numerical values for the thicknesses $T_B$ and T in the above case, the values of $T_B$ and T should preferably be determined so that the relation $T_B/T\leqq0.9$, most preferably, $T_B/T\leqq0.8$, may be satisfied.

In the present invention, when the content of germanium atoms in the first layer (G) is $1\times10^5$ atomic ppm or more, the layer thickness $T_B$ should desirably be made considerably thinner, preferably 30μ or less, more preferably 25μ or less, most preferably 20μ or less.

In the present invention, illustrative of halogen atoms (X), which may optionally be incorporated in the first layer (G) and the second layer (S) constituting the light-receiving layer, are fluorine, chlorine, bormine and iodine, particularly preferably fluorine and chlorine.

In the present invention, formation of the first layer (G) constituted of A-SiGe(H,X) may be conducted according to the vacuum deposition method utilizing discharging phenomenon, such as glow discharge method, sputtering method or ion-plating method. For example, for formation of the first layer (G) constituted of A-SiGe(H,X) according to the glow discharge method, the basic procedure comprises introducing a starting gas for Si supply capable of supplying silicon atoms (Si), a starting gas for Ge supply capable of supplying germanium atoms (Ge) optionally together with a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting layer formation on the surface of a substrate placed at a predetermined position while controlling the depth profile of germanium atoms according to a desired rate of change curve to form a layer constituent of A-SiGe (H,X). Alternatively, for formation according to the sputtering method, when carrying out sputtering by use of two sheets of targets of a target constituted of Si and a target constituted of Ge, or a target of a mixture of Si and Ge in an atmosphere of an inert gas such as Ar, He, etc. or a gas mixture based on these gases, a gas for introduction of hydrogen atoms (H) and/or a gas for introduction of halogen atoms (X) may be introduced, if desired, into a deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred because of easiness in handling during layer formation and high efficiency for supplying Si.

As the substances which can be used as the starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred because of easiness in handling during layer formation and high efficiency for supplying Ge.

Effective starting gases for introduction of halogen atoms to be used in the present invention may include a large number of halogenic compounds, as exemplified preferably by halogenic gases, halides, interhalogen compounds, or gaseous or gasifiable halogenic compounds such as silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, inter-halogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the light-receiving member of the present invention is formed according to the glow discharge method by employment of such a silicon compound containing halogen atoms, it is possible to form the first layer (G) constituted of A-SiGe containing halogen atoms on a desired substrate without use of a hydrogenated silicon gas as the starting gas capable of supplying Si together with the starting gas for Ge supply.

In the case of forming the first layer (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the first layer (G) and exciting glow discharge to form a plasma atmosphere of these gases, whereby the first layer (G) can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

For formation of the first layer (G) comprising A-SiGe(H,X) according to the reactive sputtering method or the ion plating method, for example, in the case of the sputtering method, two sheets of a target of Si and a target of Ge or a target of Si and Ge is employed and subjected to sputtering in a desired gas plasma atmosphere. In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halo-containing silicon compounds as mentioned above can effectively be used. Otherwise, it is also possible to use effectively as the starting material for formation of the first layer (G) gaseous or gasifiable substances, including halides containing hydrogen atom as one of the constituents, e.g. hydrogen halide such as HF, HCl, HBr, HI, etc.; halo-substituted hydrogenated silicon such as $SiH_2F_2$, $siH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing halogen atoms can preferably be used as the starting material for introduction of halogens, because hydrogen atoms, which are very effective for controlling electrical or photoelectric characteristics, can be introduced into the layer simultaneously with introduction of halogen atoms during formation of the first layer (G).

For introducing hydrogen atoms structurally into the first layer (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer (G) constituting the light-receiving layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer (G), for example, the substrate temperature and/or the amount of the starting materials used for incorporation of hydrogen atoms (H) or halogen atoms (X) to be introduced into the deposition device system, discharging power, etc. may be controlled.

In the present invention, for formation of the second layer (S) constituted of A-Si(H,X), the starting materials (I) for formation of the first layer (G), from which the starting materials for the starting gas for supplying Ge are omitted, are used as the starting materials (II) for formation of the second layer (S), and layer formation can be effected following the same procedure and conditions as in formation of the first layer (G).

More specifically, in the present invention, formation of the second layer region (S) constituted of a-Si(H,X) may be carried out according to the vacuum deposition method utilizing discharging phenomenon such as the glow discharge method, the sputtering method or the ion-plating method. For example, for formation of the second layer (S) constituted of A-Si(H,X) according to the glow discharge method, the basic procedure comprises introducing a starting gas for Si supply capable of supplying silicon atoms (Si) as described above, optionally together with starting gases for introduction of hydrogen atoms (H) and/or halogen atoms (X), into a deposition chamber which can be brought internally to a reduced pressure and exciting glow discharge in said deposition chamber, thereby forming a layer comprising A-Si(H,X) on a desired substrate placed at a predetermined position. Alternatively, for formation according to the sputtering method, gases for introduction of hydrogen atoms (H) and/or halogen atoms (X) may be introduced into a deposition chamber when effecting sputtering of a target constituted of Si in an inert gas such as Ar, He, etc. or a gas mixture based on these gases.

In the present invention, the amount of hydrogen atoms (H) or the amount of halogen atoms (X) or the sum of the amounts of hydrogen atoms and halogen atoms (H+X) to be contained in the second layer (S) constituting the light-receiving layer to be formed should preferably be 1 to 40 atomic %, more preferably 5 to 30 atomic %, most preferably 5 to 25 atomic %.

In the light-receiving member 1004, by incorporating a substance (C) for controlling conductivity in at least the first layer (G) 1002 and/or the second layer (S) 1003, desired conductivity characteristics can be given to the layer containing said substance (C).

In this case, the substance (C) for controlling conductivity may be contained throughout the whole layer region in the layer containing the substance (C) or contained locally in a part of the layer region of the layer containing the substance (C).

Also, in the layer region (PN) containing said substance (C), the distribution state of said substance (C) in the layer thickness direction may be either uniform or nonuniform, but desirably be made uniform within the plane in parallel to the substrate surface. When the distribution state of the substance (C) is nonuniform in the layer thickness direction, and when the substance (C) is to be incorporated in the whole layer region of the first layer (G), said substance (C) is contained in the first layer (G) so that it may be more enriched on the substrate side of the first layer (G).

Thus, in the layer region (PN), when the distribution concentration in the layer thickness direction of the above substance (C) is made non-uniform, optical and electrical junction at the contacted interface with other layers can further be improved.

In the present invention, when the substance (C) for controlling conductivity is incorporated in the first layer (G) so as to be locally present in a part of the layer region, the layer region (PN) in which the substance (C) is to be contained is provided as an end portion layer region of the first layer (G), which is to be determined case by case suitably as desired depending on.

In the present invention, when the above substance (C) is to be incorporated in the second layer (S), it is desirable to incorporate the substance (C) in the layer region including at least the contacted interface with the first layer (G).

When the substance (C) for controlling conductivity is to be incorporated in both the first layer (G) and the second layer (S), it is desirable that the layer region containing the substance (C) in the first layer (G) and the layer region containing the substance (C) in the second layer (S) may contact each other.

Also, the above substance (C) contained in the first layer (G) may be either the same as or different from that contained in the second layer (S), and their contents may be either the same or different.

However, in the present invention, when the above substance (C) is of the same kind in the both layers, it is preferred to make the content in the first layer (G) sufficiently greater, or alternatively to incorporate substances (C) with different electrical characteristics in respective layers desired.

In the present invention, by incorporating a substance (C) for controlling conductivity in at least the first layer (G) and/or the second layer (S) constituting the light-receiving layer, conductivity of the layer region containing the substance (C) [which may be either a part or the whole of the layer region of the first layer (G) and/or the second layer (S)] can be controlled as desired. As a substance (C) for controlling conductivity characteristics, there may be mentioned so called impurities in the field of semiconductors. In the present invention, there may be included p-type impurities giving p-type condutivity characteristics and n-type impurities and/or giving n-type conductivity characteristics to A-Si(H,X) and/or A-SiGe(H,X) constituting the light receiving layer to be formed.

More specifically, there may be mentioned as p-type impurities atoms belonging to the group III of the periodic table (Group III atoms), such as B (boron), Al(aluminum), Ga(gallium), In(indium), Tl(thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the layer region (PN) may be suitably be determined depending on the conductivity required for said layer region (PN), or when said layer region (PN) is provided in direct contact with the substrate, the organic relationships such as relation with the characteristics at the contacted interface with the substrate, etc.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably 1 to $5\times10^3$ atomic ppm.

In the present invention, by making the content of said substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the substrate side into the light-receiving layer can be effectively inhibited when the free surface of the light-receiving layer is subjected to the charging treatment to ⊕ polarity. On the other hand, when the substance to be incorporated is a n-type impurity, migration of positive holes injected from the substrate side into the light-receiving layer may be effectively inhibited when the free surface of the light-receiving layer is subjected to the charging treatment to ⊖ polarity.

In the case as mentioned above, the layer region (Z) at the portion excluding the above layer region (PN) under the basic constitution of the present invention as described above may contain a substance for controlling conductivity of the other polarity, or a substance for controlling conductivity having characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other, thus providing a so called depletion layer at said contact region.

In short, for example, a layer containing the aforesaid p-type impurity and a layer region containing the aforesaid n-type impurity are provided in the light-receiving layer in direct contact with each other to form the so called p-n junction, whereby a depletion layer can be provided.

FIGS. 27 through 35 show typical examples of the depth profiles in the layer thickness direction of the substance (C) contained in the layer region (PN) in the light-receiving layer of the present invention. In each of these Figures, representations of layer thickness and concentration are shown in rather exaggerated forms for illustrative purpose, since the difference between respective Figures will be indistinct if represented by the real values as such, and it should be understood that these Figures are schematic in nature. As practical distribution, the values of ti ($1 \leqq i \leqq 9$) or Ci ($1 \leqq i \leqq 17$) should be chosen so as to obtain desired distribution concentration lines, or values obtained by multiplying the distribution curve as a whole with an appropriate coefficient should be used.

In FIGS. 27 through 35, the abscissa shows the distribution concentration C of the substance (C), and the ordinate the layer thickness of the layer region (PN), $t_B$ indicating the position of the end surface on the substrate side of the layer region (G) and $t_T$ the position of the end surface on the side opposite to the substrate side. Thus, layer formation of the layer region (PN) containing the substance (C) proceeds from the $t_B$ side toward the $t_T$ side.

Figure 27:
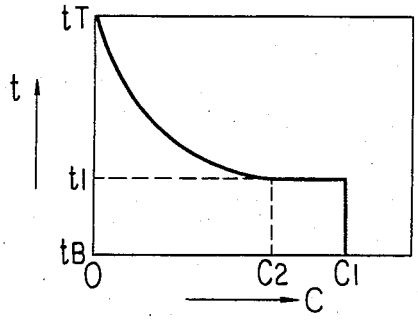
FIGS. 27 through 35 are schematic illustrations of depth profiles of the substance (C) in the layer region (PN)

FIG. 27 shows a first typical example of the depth profile of the substance (C) in the layer thickness direction contained in the layer region (PN).

In the embodiment shown in FIG. 27, from the interface position $t_B$ where the surface at which the layer region (PN) containing the substance (C) contacts the surface of said layer (G) to the position $t_1$, the substance (C) is contained in the layer region (PN) formed while the distribution concentration C of the substance (C) taking a constant value of $C_1$, and the concentration is gradually decreased from the concentration $C_2$ continuously from the position $t_1$ to the interface position $t_T$. At the interface position $t_T$, the distribution concentration C of the substance (C) is made substantially zero (here substantially zero means the case of less than detectable limit).

Figure 28:
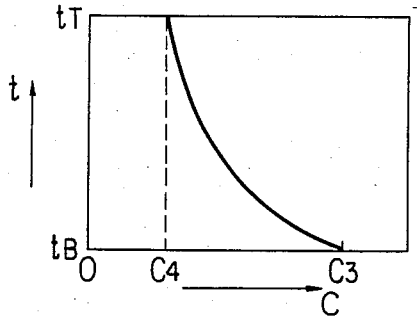

In the embodiment shown in FIG. 28, the distribution concentration C of the substance (C) contained is decreased from the position $t_B$ to the position $t_T$ gradually and continuously from the concentration $C_3$ to the concentration $C_4$ at $t_T$.

Figure 29:
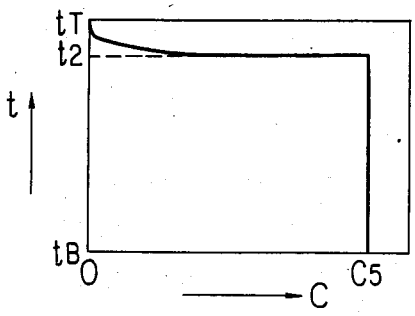
Figure 32:
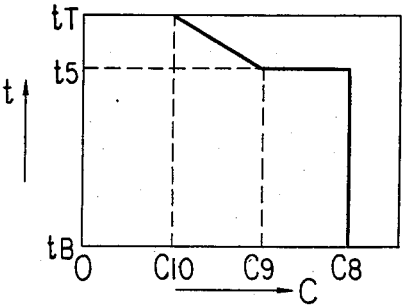

In the case of FIG. 29, from the position $t_B$ to the position $t_2$, the distribution concentration C of the substance (C) is made constantly at $C_5$, while between the position $t_2$ and the position $t_T$, it is gradually and continuously decreased, until the distribution concentration is made substantially zero at the position $t_T$.

Figure 30:
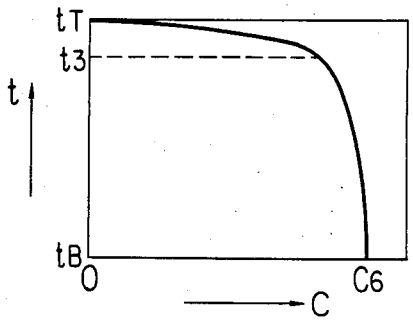

In the case of FIG. 30, the distribution concentration C of the substance (C) is first decreased continuously and gradually from the concentration $C_6$ from the position $t_B$ to the position $t_3$, from where it is abruptly decreased to substantially zero at the position $t_T$.

Figure 31:
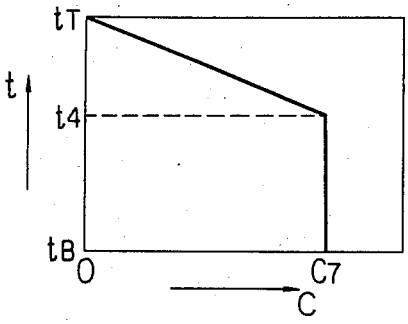

In the embodiment shown in FIG. 31, the distribution concentration of the substance (C) is constantly $C_7$ between the position $t_B$ and the position $t_T$, and the distribution concentration is made zero at the position $t_T$. Between the $t_4$ and the position $t_T$, the distribution concentration C is decreased as a first order function from the position $t_4$ to the position $t_T$. In the embodiment shown in FIG. 32, the distribution concentration C takes a constant value of $C_8$ from the position $t_B$ to the position $t_5$, while it was decreased as a first order function from the concentration $C_9$ to the concentration $C_{10}$ from the position $t_5$ to the position $t_T$.

Figure 33:
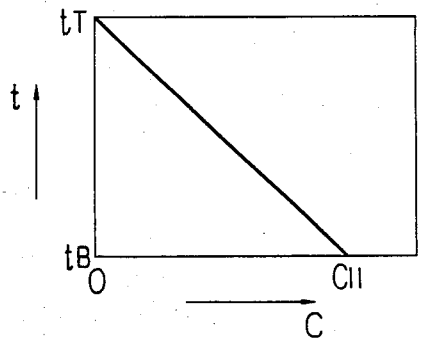

In the embodiment shown in FIG. 33, from the position $t_B$ to the position $t_T$, the distribution concentration C of the substance (C) is decreased continuously as a first order function from the concentration $C_{11}$ to zero.

Figure 34:
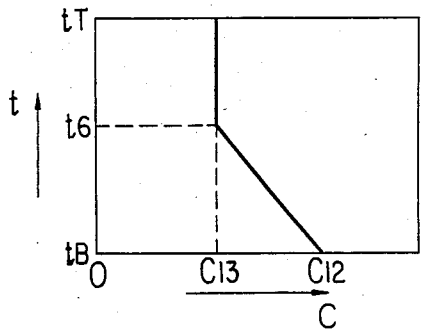

In FIG. 34, there is shown an embodiment, in which, from the position $t_B$ to the position $t_6$, the distribution concentration C of the substance C is decreased as a first order function from the concentration $C_{12}$ to the concentration $C_{13}$, and the concentration is made a constant value of $C_{13}$ between the position $t_6$ and the position $t_T$.

Figure 35:
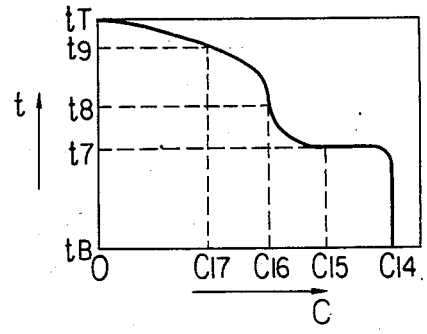

In the embodiment shown in FIG. 35, the distribution concentration C of the substance (C) is $C_{14}$ at the position $t_B$, which is gradually decreased initially from $C_{14}$ and then abruptly near the position $t_7$, where it is made $C_{15}$ at the position $t_7$.

Between the position $t_7$ and the position $t_8$, the concentration is initially abruptly decreased and then moderately gradually, until it becomes $C_{16}$ at the position $t_8$, and between the position $t_8$ and the position $t_9$, the concentration is gradually decreased to reach $C_{17}$ at the position $t_9$. Between the position $t_9$ and the position $t_T$, the concentration is decreased from $C_{17}$, following the curve with a shape as shown in Figure, to substantially zero.

As described above by referring to some typical examples of depth profiles in the layer thickness direction of the substance (C) contained in the layer region (PN) shown FIGS. 27 through 35, it is desirable in the present invention that a depth profile of the substance (C) should be provided in the layer region (PN) so as to have a portion with relatively higher distribution concentration C of the substance (C) on the substrate side, while having a portion on the interface $t_T$ side where said distribution concentration is made considerably lower as compared with the substrate side.

The layer region (PN) constituting the light-receiving member in the present invention is desired to have a localized region (B) containing the substance (C) preferably at a relatively higher concentration on the substrate side as described above.

In the present invention, the localized region (B) as explained in terms of the symbols shown in FIGS. 27 through 35, may be desirably provided within 5μ from the interface position $t_B$.

In the present invention, the above localized region (B) may be made to be identical with the whole of the layer region (L) from the interface position $t_B$ to the thickness of 5μ, or alternatively a part of the layer region (L).

It may suitably be determined depending on the characteristics required for the light-receiving layer to be formed whether the localized region (B) should be made a part or the whole of the layer region (L).

For formation of the layer region (PN) containing the aforesaid substance (C) by incorporating a substance (C) for controlling conductivity such as the group III atoms or the group V atoms structurally into the light-receiving layer, a starting material for introduction of the group III atoms or a starting material for introduction of the group V atoms may be introduced under gaseous state into a deposition chamber together with other starting materials for formation of the respective layers during layer formation.

As the starting material which can be used for introduction of the group III atoms, it is desirable to use those which are gaseous at room temperature under atmospheric pressure or can readily be gasified under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydrides such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, SbCl, $BiH_3$, $BiCl_3$, $BiBr_3$ and the like effectively as the starting material for introduction of the group V atoms.

In the light-receiving member of the present invention, for the purpose of obtaining higher photosensitivity and dark resistance, and further for the purpose of improving adhesion between the substrate and the light-receiving layer, at least one kind of atoms selected from oxygen atoms, carbon atoms and nitrogen atoms can be contained in the light-receiving layer in either uniform or ununiform distribution state in the layer thickness direction. Such atoms (OCN) to be contained in the light-receiving layer may be contained therein throughout the whole layer region of the light-receiving layer or localized by being contained in a part of the layer region of the light-receiving layer.

The distribution concentration C (OCN) of the atoms (OCN) should desirably be uniform within the plane parallel to the surface of the substrate.

In the present invention, the layer region (OCN) where atoms (OCN) are contained is provided so as to occupy the whole layer region of the light-receiving layer when it is primarily intended to improve photosensitivity and dark resistance, while it is provided so as to occupy the end portion layer region on the substrate side of the light-receving layer when it is primarily intended to strengthen adhesion between the substrate and the light-receiving layer.

In the former case, the content of atoms (OCN) contained in the layer region (OCN) should desirably be made relatively smaller in order to maintain high photosensitivity, while in the latter case relatively larger in order to ensure reinforcement of adhesion to the substrate.

In the present invention, the content of the atoms (OCN) to be contained in the layer region (OCN) provided in the light-receiving layer can be selected suitably in organic relationship with the characteristics required for the layer region (OCN) itself, or with the characteristic at the contacted interface with the substrate when the said layer region (OCN) is provided in direct contact with the substrate, etc.

When other layer regions are to be provided in direct contact with the layer region (OCN), the content of the atoms (OCN) may suitably be selected with due considerations about the characteristics of said other layer regions or the characteristics at the contacted interface with said other layer regions.

The amount of the atoms (OCN) contained in the layer region (OCN) may be determined as desired depending on the characteristics required for the light-receiving member to be formed, but it may preferably be 0.001 to 50 atomic %, more preferably 0.002 to 40 atomic %, most preferably 0.003 to 30 atomic %.

In the present invention, when the layer region (OCN) occupies the whole region of the light-receiving layer or, although not occupying the whole region, the proportion of the layer thickness $T_O$ of the layer region (OCN) occupied in the layer thickness T of the light-receiving layer is sufficiently large, the upper limit of the content of the atoms (OCN) contained in the layer region (OCN) should desirably be made sufficiently smaller than the value as specified above.

In the case of the present invention, when the proportion of the layer thickness $T_O$ of the layer region (OCN) occupied relative to the layer thickness T of the light-receiving layer is 2/5 or higher, the upper limit of the atoms (OCN) contained in the layer region (OCN) should desirably be made 30 atomc % or less, more preferably 20 atomic % or less, most preferably 10 atomic % or less.

According to a preferred embodiment of the present invention, it is desirable that the atoms (OCN) should be contained in at least the above first layer to be provided directly on the substrate. In short, by incorporating the atoms (OCN) at the end portion layer region on the substrate side in the light-receiving layer, it is possible to effect reinforcement of adhesion between the substrate and the light-receiving layer.

Further, in the case of nitrogen atoms, for example, under the co-presence with boron atoms, improvement of dark resistance and improvement of photosensitivity can further be ensured, and therefore they should preferably be contained in a desired amount in the light-receiving layer.

Plural kinds of these atoms (OCN) may also be contained in the light-receiving layer. For example, oxygen atoms may be contained in the first layer, nitrogen atoms in the second layer, or alternatively oxygen atoms and nitrogen atoms may be permitted to be co-present in the same layer region.

FIGS. 43 through 51 show typical examples of ununiform depth profiles in the layer thickness direction of the atoms (OCN) contained in the layer region (OCN) in the light-receiving member of the present invention.

In FIGS. 43 through 51, the abscissa indicates the distribution concentration C of the atoms (OCN), and the ordinate the layer thickness of the layer region (OCN), $t_B$ showing the position of the end surface of the layer region on the substrate side, while $t_T$ shows the position of the end face of the layer region (OCN) opposite to the substrate side. Thus, layer formation of the layer region (OCN) containing the atoms (OCN) proceeds from the $t_B$ side toward the $t_T$ side.

Figure 43:
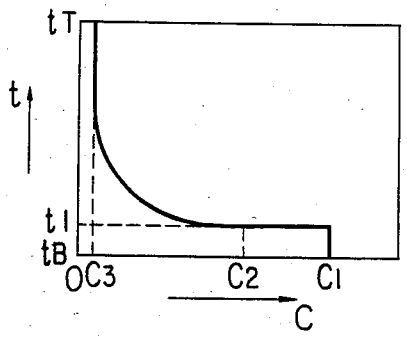
FIGS. 43 through 51 are each schematic illustrations of the depth profile of the atoms (OCN) in the layer region (OCN)

FIG. 43 shows a first typical embodiment of the depth profile in the layer thickness direction of the atoms (OCN) contained in the layer region (OCN).

In the embodiment shown in FIG. 43, from the interface position $t_B$ where the surface on which the layer region (OCN) containing the atoms (OCN) is formed contacts the surface of said layer region (OCN) to the position of $t_1$, the atoms (OCN) are contained in the layer region (OCN) to be formed while the distribution concentration of the atoms (OCN) taking a constant value of $C_1$, said distribution concentration being gradually continuously reduced from $C_2$ from the position $t_1$ to the interface position $t_T$, until at the interface position $t_T$, the distribution concentration C is made $C_3$.

Figure 44:
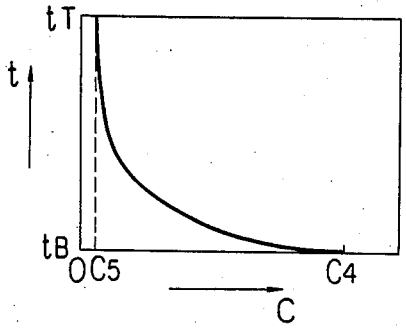

In the embodiment shown in FIG. 44, the distribution concentration C of the atoms (OCN) contained is reduced gradually continuously from the concentration $C_4$ from the position $t_B$ to the position $t_T$, at which it becomes the concentration $C_5$.

Figure 45:
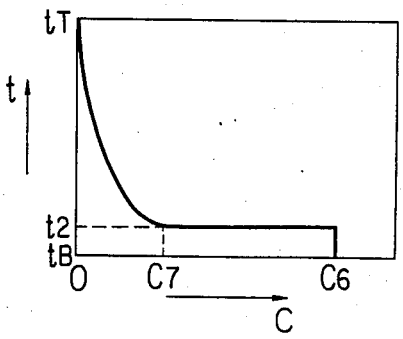

In the case of FIG. 45, from the position $t_B$ to the position $t_2$, the distribution concentration of the atoms (OCN) is made constantly at $C_6$, reduced gradually continuously from the concentration $C_7$ between the position $t_2$ and the position $t_T$, until at the position $t_T$, the distribution concentration C is made substantially zero (here substantially zero means the case of less than the detectable level).

Figure 46:
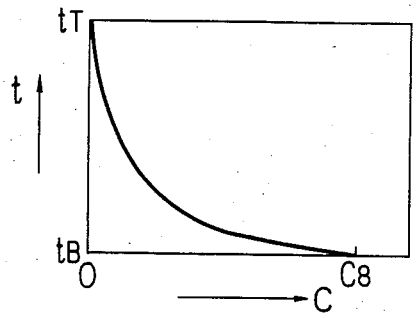

In the case of FIG. 46, the distribution concentration C of the atoms (OCN) is reduced gradually continuously from the concentration $C_8$ from the position $t_B$ up to the position $t_T$, to be made substantially zero at the position $t_T$.

Figure 47:
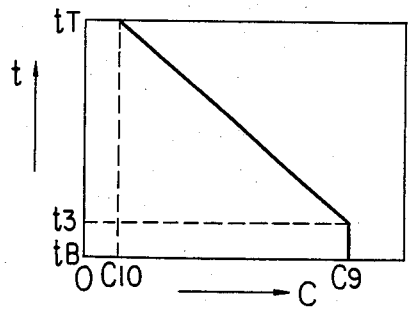

In the embodiment shown in FIG. 47, the distribution concentration C of the atoms (OCN) is made constantly $C_9$ between the position $t_B$ and the position $t_3$, and it is made the concentration $C_{10}$ at the position $t_T$. Between the position $t_3$ and the position $t_T$, the distribution concentration C is reduced from the concentration $C_9$ to substantially zero as a first order function from the position $t_3$ to the position $t_T$.

Figure 48:
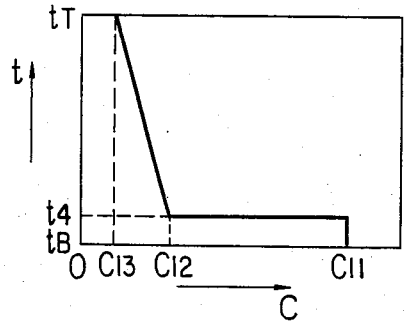

In the embodiment shown in FIG. 48, from the position $t_B$ to the position $t_4$, the distribution concentration C takes a constant value of $C_{11}$, while the distribution state is changed to a first order function in which the concentration is decreased from the concentration $C_{12}$ to the concentration $C_{13}$ from the position $t_4$ to the position $t_T$, and the concentration C is made substantially zero at the position $t_T$.

Figure 49:
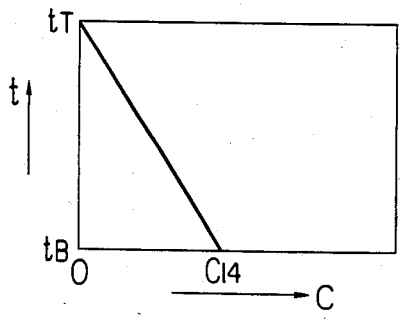

In the embodiment shown in FIG. 49, from the position $t_B$ to the position $t_T$, the distribution concentration C of the atoms (OCN) is reduced as a first order function from the concentration $C_{14}$ to substantially zero.

Figure 50:
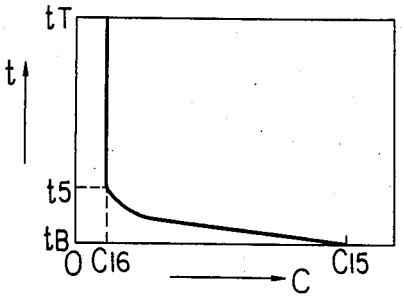

In FIG. 50, there is shown an embodiment, wherein from the position $t_B$ to the position $t_5$, the distribution concentration of the atoms (OCN) is reduced approximately as a first order function from the concentration $C_{15}$ to $C_{16}$, and it is made constantly $C_{16}$ between the position $t_5$ and the position $t_T$.

Figure 51:
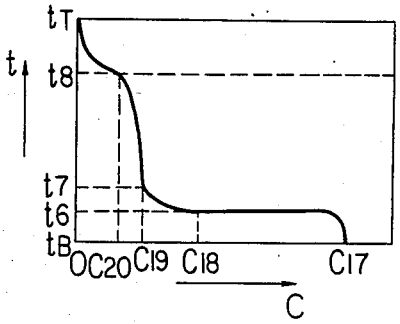

In the embodiment shown in FIG. 51, the distribution concentration C of the atoms (OCN) is $C_{17}$ at the position $t_B$, and, toward the position $t_6$, this $C_{17}$ is initially reduced gradually and then abruptly reduced near the position $t_6$, until it is made the concentration $C_{18}$ at the position $t_6$.

Between the position $t_6$ and the position $t_7$, the concentration is initially reduced abruptly and thereafter gently gradually reduced to become $C_{19}$ at the position $t_7$, and between the position $t_7$ and the position $t_8$, it is reduced very gradually to become $C_{20}$ at the position $t_8$. Between the position $t_8$ and the position $t_T$, the concentration is reduced from the concentration $C_{20}$ to substantially zero along a curve with a shape as shown in the Figure.

As described above about some typical examples of depth profiles in the layer thickness direction of the atoms (OCN) contained in the layer region (OCN) by referring to FIGS. 43 through 51, it is desirable in the present invention that, when the atoms (OCN) are to be contained ununiformly in the layer region (OCN), the atoms (OCN) should be distributed in the layer region (OCN) with higher concentration on the substrate side, while having a portion considerably depleted in concentration on the interface $t_T$ side as compared with the substrate side.

The layer region (OCN) containing atoms (OCN) should desirably be provided so as to have a localized region (B) containing the atoms (OCN) at a relatively higher concentration on the substrate side as described above, and in this case, adhesion between the substrate and the light-receiving layer can be further improved.

The above localized region (B) should desirably be provided within 5μ from the interface position $t_B$, as explained in terms of the symbols indicated in FIGS. 43 through 51.

In the present invention, the above localized region (B) may be made the whole of the layer region ($L_T$) from the interface position $t_B$ to 5μ thickness or a part of the layer region ($L_T$).

It may suitably be determined depending on the characteristics required for the light-receiving layer to be formed whether the localized region (B) is made a part or the whole of the layer region ($L_T$).

The localized region (B) should preferably be formed to have a depth profile in the layer thickness direction such that the maximum value Cmax of the distribution concentration of the atoms (OCN) may preferably be 500 atomic ppm or more, more preferably 800 atomic ppm or more, most preferably 1000 atomic ppm or more.

In other words, in the present invention, the layer region (OCN) containing the atoms (OCN) should preferably be formed so that the maximum value Cmax of the distribution concentration C may exist within 5μ layer thickness from the substrate side (in the layer region with 5μ thickness from $t_B$).

In the present invention, when the layer region (OCN) is provided so as to occupy a part of the layer region of the light-receiving layer, the depth profile of the atoms (OCN) should desirably be formed so that the refractive index may be changed moderately at the interface between the layer region (OCN) and other layer regions.

By doing so, reflection of the light incident upon the light-receiving layer from the interface between contacted interfaces can be inhibited, whereby appearance of interference fringe pattern can more effectively be prevented.

It is also preferred that the distribution concentration C of the atoms (OCN) in the layer region (OCN) should be changed along a line which is changed continuously and moderately, in order to give smooth refractive index change.

In this regard, it is preferred that the atoms (OCN) should be contained in the layer region (OCN) so that the depth profiles as shown, for example, in FIGS. 43 through 46, FIG. 49 and FIG. 51 may be assumed.

In the present invention, for provision of a layer region (OCN) containing the atoms (OCN) in the light-receiving layer, a starting material for introduction of the atoms (OCN) may be used together with the starting material for formation of the light-receiving layer during formation of the light-receiving layer and incorporated in the layer formed while controlling its amount.

When the glow discharge method is employed for formation of the layer region (OCN), a starting material for introduction of the atoms (OCN) is added to the material selected as desired from the starting materials for formation of the light-receiving layer as described above. For such a starting material for introduction of the atoms (OCN), there may be employed most of gaseous or gasified gasifiable substances containing at least the atoms (OCN) as the constituent atoms.

More specifically, there may be included, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$); lower siloxanes containing silicon atom (Si), oxygen atom (O) and hydrogen atom (H) as constituent atoms, such as disiloxane ($H_3SiOSiH_3$), trisiloxane ($H_3SiOSiH_2OSiH_3$), and the like; saturated hydrocarbons having 1–5 carbon atoms such as methane ($CH_4$), ethane ($C_2H_6$), propane ($C_3H_8$), n-butane (n-$C_4H_{10}$), pentane ($C_5H_{12}$); ethylenic hydrocarbons having 2–5 carbon atoms such as ethylene ($C_2H_4$), propylene ($C_3H_6$), butene-1 ($C_4H_8$), butene-2 ($C_4H_8$), isobutylene ($C_4H_8$), pentene ($C_5H_{10}$); acetylenic hydrocarbons having 2–4 carbon atoms such as acetylene ($C_2H_2$), methyl acetyllene ($C_3H_4$), butyne ($C_4H_6$); and the like; nitrogen ($N_2$), ammonia ($NH_3$), hydrazine ($H_2NNH_2$), hydrogen azide ($HN_3$), ammonium azide ($NH_4N_3$), nitrogen trifluoride ($F_3N$), nitrogen tetrafluoride ($F_4N$) and so on.

In the case of the sputtering method, as the starting material for introduction of the atoms (OCN), there may also be employed solid starting materials such as $SiO_2$, $Si_3N_4$ and carbon black in addition to those gasifiable as enumerated for the glow discharge method. These can be used in the form of a target for sputtering together with the target of Si, etc.

In the present invention, when forming a layer region (OCN) containing the atoms (OCN) during formation of the light-receiving layer, formation of the layer region (OCN) having a desired depth profile in the direction of layer thickness formed by varying the distribution concentration C of the atoms (OCN) contained in said layer region (OCN) may be conducted in the case of glow discharge by introducing a starting gas for introduction of the atoms (OCN) the distribution concentration C of which is to be varied into a deposition chamber, while varying suitably its gas flow rate according to a desired change rate curve.

For example, by the manual method or any other method conventionally used such as an externally driven motor, etc., the opening of a certain needle valve provided in the course of the gas flow channel system may be gradually varied. During this operation, the rate of variation is not necessarily required to be linear, but the flow rate may be controlled according to a variation rate curve previously designed by means of, for example, a microcomputer to give a desired content curve.

When the layer region (OCN) is formed according to the sputtering method, formation of a desired depth profile of the atoms (OCN) in the layer thickness direction by varying the distribution concentration C of the atoms (OCN) may be performed first similarly as in the case of the glow discharge method by employing a starting material for introduction of the atoms (OCN) under gaseous state and varying suitably as desired the gas flow rate of said gas when introduced into the deposition chamber. Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

The substrate to be used in the present invention may be either electroconductive or insulating. As the electroconductive substrate, there may be mentioned metals such as NiCr, stainless steel, Al, Cr, Mo, Au, Nb, Ta, V, Ti, Pt, Pd etc. or alloys thereof.

As insulating substrates, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. At least one side surface of these substrates is preferably subjected to treatment for imparting electroconductivity, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the light-receiving member 1004 in FIG. 10 is to be used as the light-receiving member for electrophotography, it may desirably be formed into an endless belt or a cylinder for use in continuous high speed copying. The substrate may have a thickness, which is conveniently determined so that the light-receiving member as desired may be formed. When the light-receiving member is required to have a flexibility, the substrate is made as thin as possible, so far as the function of a support can be exhibited. However, in such a case, the thickness is generally $10\mu$ or more from the points of fabrication and handling of the substrate as well as its mechanical strength.

Next, an example of the process for producing the light-receiving member of this invention is to be briefly described.

Figure 20:
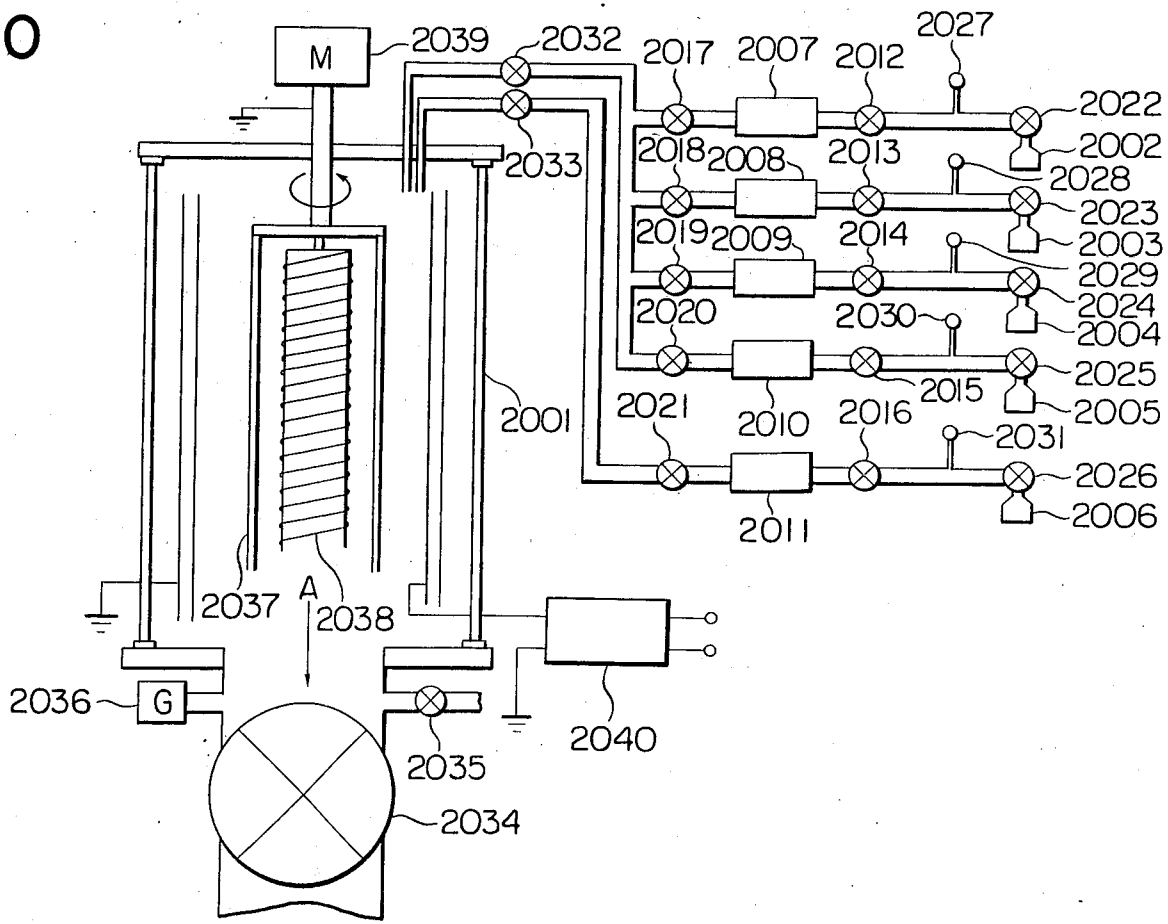
FIG. 20 is a schematic illustration of the vacuum deposition device for preparation of the light-receiving members employed in Examples.

FIG. 20 shows one example of a device for producing a light-receiving member.

In the gas bombs 2002 to 2006, there are hermetically contained starting gases for formation of the light-receiving member of the present invention. For example, 2002 is a bomb containing $SiH_4$ gas (purity 99.999%, hereinafter abbreviated as $SiH_4$), 2003 is a bomb contaiing $GeH_4$ gas (purity 99.999%, hereinafter abbreviated as $GeH_4$), 2004 is a bomb containing NO gas (purity 99.99%, hereinafter abbreviated as NO), 2005 is bomb containing $B_2H_6$ gas diluted with $H_2$ (purity 99.999%, hereinafter abbreviated as $B_2H_6/H_2$) and 2006 is a bomb containing $H_2$ gas (purity: 99.999%).

For allowing these gases to flow into the reaction chamber 2001, on confirmation of the valves 2022 to 2026 of the gas bombs 2002 to 2006 and the leak valve 2035 to be closed, and the inflow valves 2012 to 2016, the outflow valves 2017 to 2021 and the auxiliary valves 2032 and 2033 to be opened, the main valve 2034 is first opened to evacuate the reaction chamber 2001 and the gas pipelines. As the next step, when the reading on the vacuum indicator 2036 becomes $5\times10^{-6}$ Torr, the auxiliary valves 2032, 2033 and the outflow valves 2017 to 2021 are closed.

Referring now to an example of forming a light-receiving layer on the cylindrical substrate 2037, $SiH_4$ gas from the gas bomb 2002, $GeH_4$ gas from the gas bomb 2003, NO gas from the gas bomb 2004, $B_2H_6/H_2$ gas from the gas bomb 2005 and $H_2$ gas from the gas bomb 2006 are permitted to flow into the mass-flow controllers 2007, 2008, 2009, 2010 and 2011, respectively, by opening the valves 2022, 2023, 2024, 2025 and 2026 and controlling the pressures at the output pressure gauges 2027, 2028, 2029, 2030 and 2031 to 1 $Kg/cm^2$ and opening gradually the inflow valves 2012, 2013, 2014, 2015 and 2016, respectively. Subsequently, the outflow valves 2017, 2018, 2019, 2020 and 2021 and the auxiliary valves 2032 and 2033 were gradually opened to permit respective gases to flow into the reaction chamber 2001. The outflow valves 2017, 2018, 2019, 2020 and 2021 are controlled so that the flow rate ratio of $SiH_4$ gas, $GeH_4$ gas, $B_2H_6/H_2$ gas, NO gas and $H_2$ may have a desired value and opening of the main valve 2034 is also controlled while watching the reading on the vacuum indicator 2036 so that the pressure in the reaction chamber 2001 may reach a desired value. And, after confirming that the temperature of the substrate 2037 is set at 50° to 400 ° C. by the heater 2038, the power source 2040 is set at a desired power to excite glow discharge in the reaction chamber 2001, simultaneously with controlling of the distributed concentrations of germanium atoms and boron atoms to be contained in the layer formed by carrying out the operation to change gradually the openings of the valves 2018, 2020 by the manual method or by means of an externally driven motor, etc. thereby changing the flow rates of $GeH_4$ gas and $B_2H_6$ gas according to previously designed change rate curves.

By maintaining the glow discharge as described above for a desired period time, the first layer (G) is formed on the substrate 2037 to a desired thickness. At the stage when the first layer (G) is formed to a desired thickness, the second layer (S) containing substantially no germanium atom can be formed on the first layer (G) by maintaining glow discharge according to the same conditions and procedure as those in formation of the first layer (G) except for closing completely the outflow valve 2018 and changing, if desired, the discharging conditions. Also, in the respective layers of the first layer (G) and the second layer (S), by opening or closing as desired the outflow valves 2019 or 2020, oxygen atoms or boron atoms may be contained or not, or oxygen atoms or boron atoms may be contained only in a part of the layer region of the respective layers.

When nitrogen atoms or carbon atoms are to be contained in place of oxygen atoms, layer formation may be conducted by replacing NO gas in the gas bomb 2004 with $NH_3$ or $CH_4$. Also, when the kinds of the gases employed are desired to be increased, bombs of desirable gases may be provided additionally before carrying out layer formation similarly. During layer formation, for uniformization of the layer formation, it is desirable to rotate the substrate 2037 by means of a motor 2039 at a constant speed.

The present invention is described in more detail by referring to the following Examples.

EXAMPLE 1

An aluminum substrate having a shape as shown in FIG. 9 (length (L) 357 mm, outerdiameter (r) 80 mm, pitch (P) 25 μm, depth (D) 0.8 μm; spirally grooved surface shape) was prepared.

Next, by means of the deposition device as shown in FIG. 20, following the various procedures under the conditions shown in Table 3A, a-Si light-receiving layers were deposited on the above aluminum substrate (Sample No. 1-1A).

Figure 64:
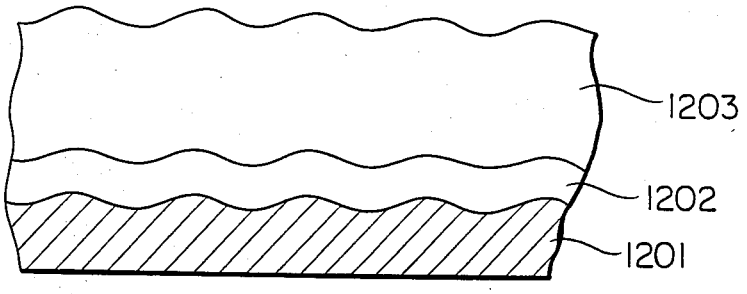
FIGS. 64 and 65 are illustrations of the structures of the light-receiving members prepared in Examples.

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of the substrate 1201. In this case, the difference in the total thickness between the center and both ends of the aluminum substrate was found to be 1 μm (Sample No. 1-2A).

Figure 65:
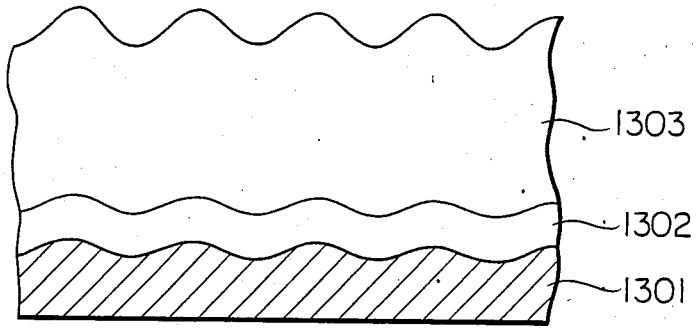
Figure 66:
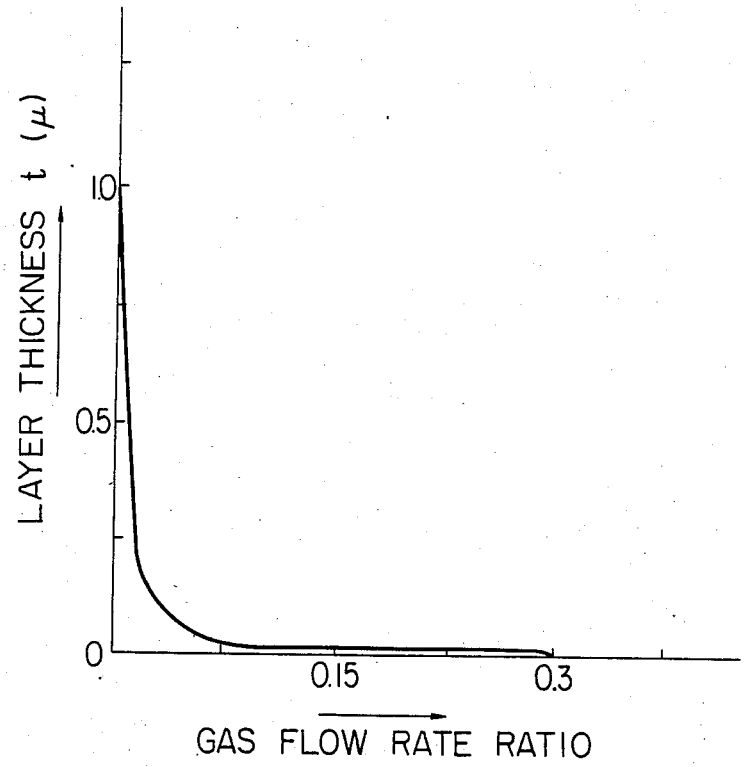
Figure 67:
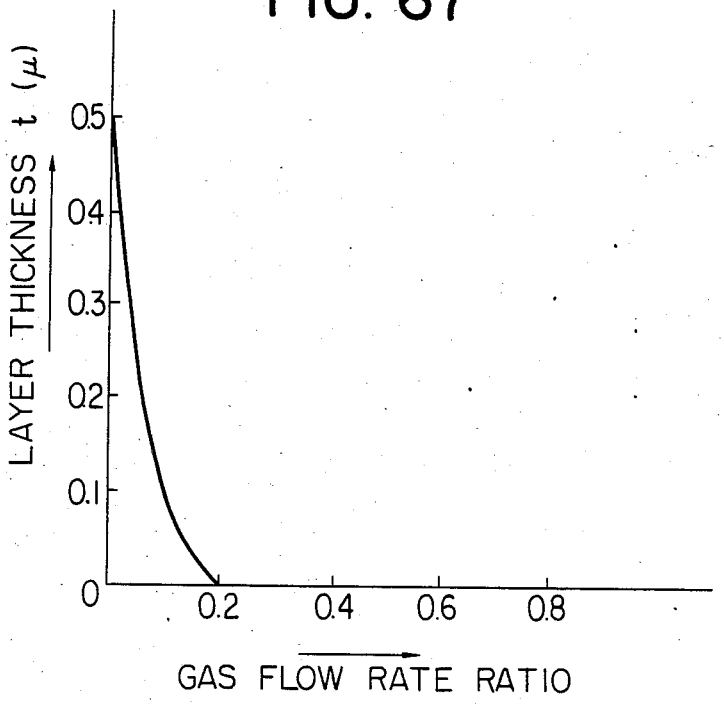
Figure 68:
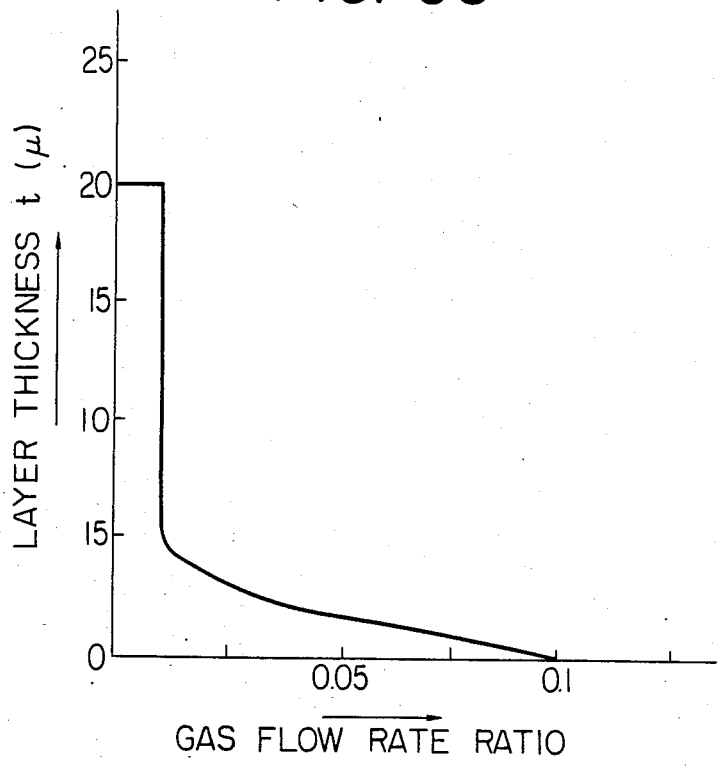

Also, in the case of the above Sample No. 1-1A, as shown in FIG. 65, the surface of the second layer 1303 was found to be non-parallel to the surface of the substrate 1301. In this case, the difference in the total thickness between the center and both ends of the aluminum substrate was found to be 2 μm.

Figure 26:
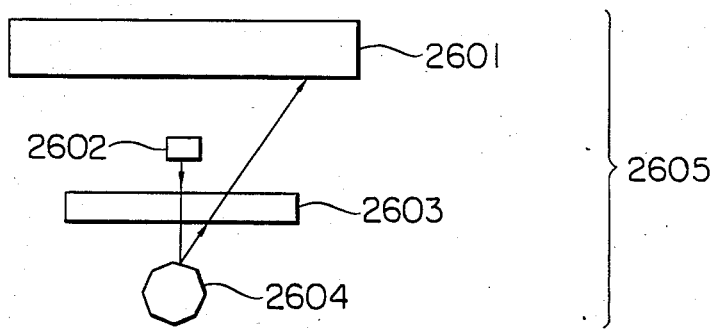
FIG. 26 is a schematic illustration of a device for image exposure employed in Examples.
Figure 26:
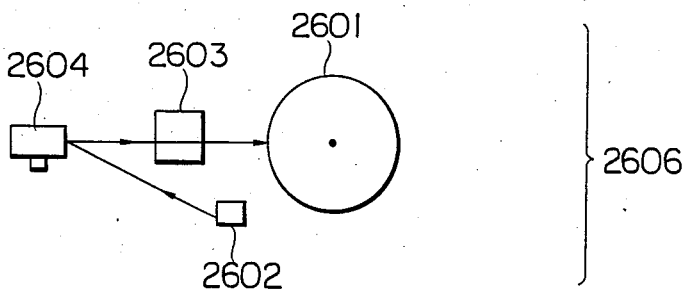

For the two kinds of the light-receiving members for electrophotography, image exposure was effected by means of a device as shown in FIG. 26 with a semiconductor laser of a wavelength of 780 nm at a spot diameter of 80 μm, followed by developement and transfer, to obtain an image. In the light-receiving member having the surface characteristic as shown in FIG. 64 (Sample No. 1-2A), an interference fringe pattern was observed.

On the other hand, in the light-receiving member having the surface characteristic as shown in FIG. 65 (Sample No. 1-1A), no interference fringe pattern was observed and the member obtained exhibited practically satisfactory electrophotographic characteristics.

EXAMPLE 2

By means of a lathe, the surface of a cylindrical aluminum substrate was worked as shown in Table 1A. On these cylindrical aluminum substrates (Cylinder No. 101A-108A), under the same condition as in the case of the Sample No. 1-1A in Example 1, light-receiving members for electrophotography were prepared (Sample No. 111A-118A). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2A. For these light-receiving members, image exposure was effected by means of the device shown in FIG. 26 with a semiconductor laser with a wavelength of 780 nm at a spot diameter of 80 μm similarly as in Example 1 to obtain the results shown in Table 2A.

EXAMPLE 3

Light-receiving members for electrophotography were formed in the same manner as in the case of No. 1-1A in Example 1 under the conditions as shown in Table 4A.

For these light-receiving members for electrophotography, by means of the same image exposure device as in Example 1, image exposure was effected, followed by development, transfer and fixing to obtain visible images on plain papers.

The images obtained in this case were free from any interference fringe pattern observed, exhibiting practically satisfactory characteristics.

EXAMPLE 4

Light-receiving members for electrophotography were formed in the same manner as in the case of No. 1-1A in Example 1 under the conditions as shown in Table 5A.

For these light-receiving members for electrophotography, by means of the same image exposure device as in Example 1, image exposure was effected, followed by development, transfer and fixing to obtain visible images on plain papers.

The images obtained in this case were free from any interference fringe pattern observed, exhibiting practically satisfactory characteristics.

EXAMPLE 5

Light-receiving members for electrophotography were formed in the same manner as in the case of No. 1-1A in Example 1 under the conditions as shown in Table 6A.

For these light-receiving members for electrophotography, by means of the same image exposure device as in Example 1, image exposure was effected, followed by development, transfer and fixing to obtain visible images on plain papers.

The images obtained in this case were free from any interference fringe pattern observed, exhibiting practically satisfactory characteristics.

COMPARATIVE EXAMPLE 1

As a comparative test, an a-Si light-receiving member for electrophotography was prepared in entirely the same manner as in the case of Sample No. 1-1A in Example 1 as described above except for employing an aluminum substrate roughened on its surface by the sand blasting method in place of the aluminum substrate used in preparation of the light-receiving member for electrophography in Example 1. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 1, clear interference fringe was found to be formed in the black image over all the surface.

EXAMPLE 6

An aluminum substrate having a shape as shown in FIG. 9, (length (L) 357 mm, outerdiameter (r) 80 mm, pitch (P) 25 μm, depth (D) 0.8 μm; spirally grooved surface shape) was prepared.

Next, by means of the deposition device as shown in FIG. 20, following the various procedures under the conditions shown in Table 3B, a-Si light-receiving layers were deposited on the above aluminum substrate (Sample No. 1-1B).

Figure 22:
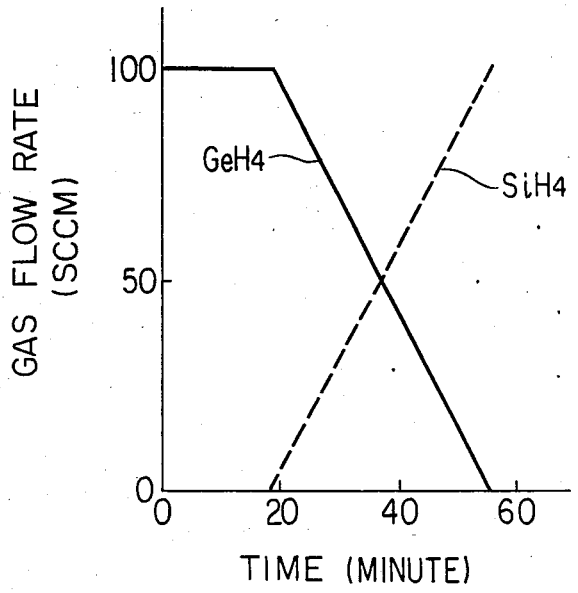

In preparation of the first layer of a-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of the substrate 1201. In this case, the difference in the total thickness between the center and both ends of the aluminum substrate was found to be 1 μm (Sample No. 1-2B).

Also, in the case of the above Sample No. 1-1B, as shown in FIG. 65, the surface of the second layer 1303 was found to be non-parallel to the surface of the substrate 1301. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 (Sample No. 1-2B), an interference fringe pattern was observed.

On the other hand, in the light-receiving member having the surface characteristic as shown in FIG. 65 (Sample No. 1-1B), no interference fringe pattern was observed and the member obtained exhibited practically satisfactory electrophotographic characteristics.

EXAMPLE 7

By means of a lathe, the surface of a cylindrical aluminum substrate was worked as shown in Table 1B. On these cylindrical aluminum substrates (Cylinder Nos. 101B-108B), under the same condition as in the case of the Sample No. 1-1B in Example 6, light-receiving members for electrophotography were prepared (Sample Nos. 111B-118B). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2B. For these light-receiving members, image exposure was effected by means of the device shown in FIG. 26 with a semiconductor laser with a wavelength of 780 nm at a spot diameter of 80 μm similarly as in Exmaple 6 to obtain the results shown in Table 2B.

EXAMPLE 8

Light-receiving members for electrophotography were formed in the same manner as in the case of No. 1-1B in Example 6 under the conditions as shown in Table 3B.

Figure 23:
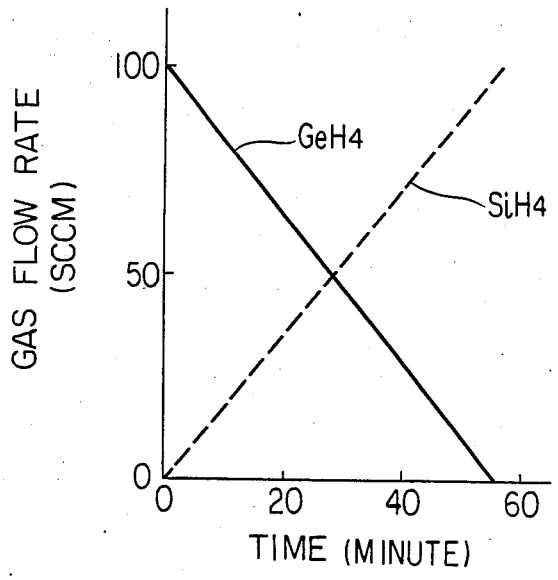

In preparation of the first layer of a-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 6, image exposure was effected, followed by development, transfer and fixing to obtain visible images on plain papers.

The images obtained in the case were free from any interference fringe pattern observed, exhibiting practically satisfactory characteristics

EXAMPLE 9

Light-receiving members for electrophotography were formed in the same manner as in the case of No. 1-1B in Example 6 under the conditions as shown in Table 4B.

Figure 24:
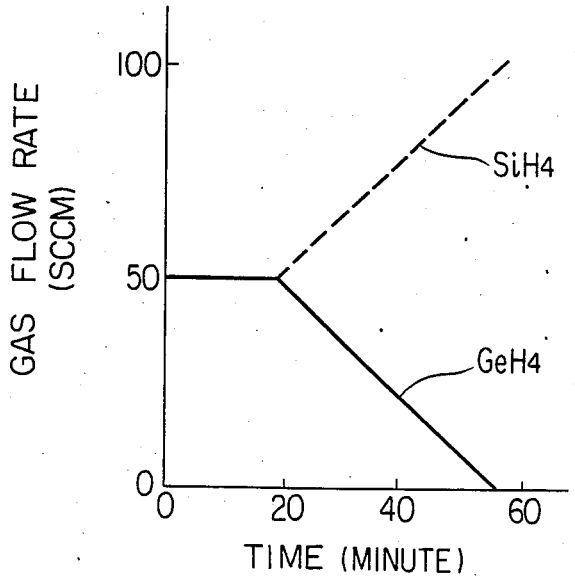

In preparation of the first layer of a-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same image exposure device as in Example 6, image exposure was effected, followed by development, transfer and fixing to obtain visible images on plain papers.

The images obtained in this case were free from any interference fringe pattern observed, exhibiting practically satisfactory characteristics.

EXAMPLE 10

Light-receiving members for electrophotography were formed in the same manner as in the case of No. 1-1B in Example 6 under the conditions as shown in Table 4B.

Figure 25:
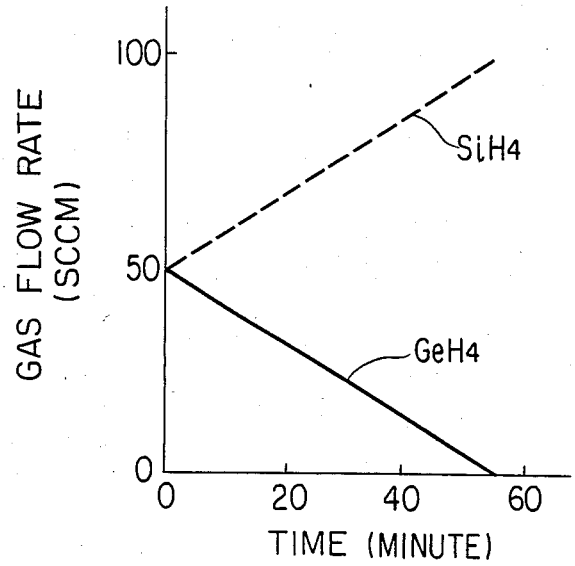

In preparation of the first layer of a-(Si:Ge):H layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same image exposure device as in Example 6, image exposure was effected, followed by development, transfer and fixing to obtain visible images on plain papers.

The images obtained in this case were free from any interference fringe pattern observed, exhibiting practically satisfactory characteristics

COMPARATIVE EXAMPLE 2

As a comparative test, an a-Si light-receiving member for electrophotography was prepared in entirely the same manner as in the case of Sample No. 1-1B in Example 6 as described above except for employing an aluminum substrate roughened on its surface by the sand blasting method in place of the aluminum substrate used in preparation of the light-receiving member for electrophotography in Example 6. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 6 clear interference fringe was found to be formed in the black image over all the surface.

EXAMPLE 11

An aluminum substrate having a shape as shown in FIG. 9 (length (L) 357 mm, outerdiameter (r) 80 mm, pitch (P) 25 μm, depth (D) 0.8 μm; spirally grooved surface shape) was prepared.

Next, by means of the deposition device as shown in FIG. 20, following the various procedures under the conditions shown in Table 3C, a-Si light-receiving layers were deposited on the above aluminum substrate (Sample No. 1-1C).

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of thc substrate 1201. In this case the difference in the total thickness between the center and both ends of the aluminum substrate was found to be 1 μm (Sample No. 1-2C).

Also, in the case of the above Sample No. 1-1C, as shown in FIG. 65, the surface of the second layer 1303 was found to be non-parallel to the surface of the substrate 1301. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 (Sample No. 1-2C), an interference fringe pattern was observed.

On the other hand, in the light-receiving member having the surface characteristic as shown in FIG. 65 (Sample No. 1-1C), no interference fringe pattern was observed and the member obtained exhibited practically satisfactory electrophotographic characteristics.

EXAMPLE 12

By means of a lathe, the surface of a cylindrical aluminum substrate was worked as shown in Table 1C. On these cylindrical aluminum substratcs (Cylinder No. 101C–108C), under the same condition as in the case of the Sample No. 1–1C in Example 11, light-receiving members for electrophotography were prepared (Sample No. 111C–118C). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2C. For these light-receiving members, image exposure was effected by means of the device shown in FIG. 26 with a semiconductor laser with a wavelength of 780 nm at a spot diameter of 80 μm similarly as in Example 11 to obtain the results shown in Table 2C.

EXAMPLE 13

Light-receiving members for electrophotography were formed in the same manner as in the case of No. 1–1C in Example 11 under the conditions as shown in Table 4C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 14

Light-receiving members for electrophotography were formed in the same manner as in the case of No. 1–1C in Example 11 under the conditions as shown in Table 5C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 15

Light-receiving members for electrophotography were formed in the same manner as in the case of No. 1–1C in Example 11 under the conditions as shown in Table 6C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 16

Light-receiving members for electrophotography were formed in the same manner as in the case of No. 1–1C in Example 11 under the conditions as shown in Table 7C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 17

Light-receiving members for electrophotography were formed in the same manner as in the case of No. 1–1C in Example 11 under the conditions as shown in Table 8C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 18

Light-receiving members for electrophotography were formed in the same manner as in the case of No. 1–1C in Example 11 under the conditions as shown in Table 9C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 19

Light-receiving members for electrophotography were formed in the same manner as in the case of No. 1–1C in Example 11 under thc conditions as shown in Table 10C.

For these light-receiving members for electrophotography, by means of the same image exposure device as in Example 11, image exposure was effected, followed by development. transfer and fixing to obtain visible images on plain paper.

The images obtained in this case were free from any interference fringe pattern observed, exhibiting practically satisfactory characteristics.

EXAMPLE 20

Light-receiving members for electrophotography were formed in the same manner as in the case of No. 1–1C in Example 11 under the conditions as shown in Table 11C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 21

Light-receiving members for electrophotography were formed in the same manner as in the case of No. 1–1C in Example 11 under the conditions as shown in Table 12C.

For these light-receiving members for electrophotography, by means of the same image exposure device as in Example 11, image exposure was effected, followed by development, transfer and fixing to obtain visible mages on plain papers.

The images obtained in this case were free from any interference fringe pattern observed, exhibiting practically satisfactory characteristics.

EXAMPLE 22

Light-receiving members for electrophotography were formed in the same manner as in the case of No. 1-1C in Example 11 under the conditions as shown in Table 13C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 23

Light-receiving members for elcctrophotography were formed in the same manner as in the case of No. 1-1C in Example 11 under the conditions as shown in Table 14C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 24

Light-receiving members for electrophotography were formed in the same manner as in the case of No. 1-1C in Example 11 under the conditions as shown in Table 15C.

For these light-receiving members for electrophotography, by means of the same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 25

Light-receiving members for electrophotography were formed in the same manner as in the case of No. 1-1C in Example 11 under the conditions as shown in Table 16C.

For these light-receiving members for electrophotography, by means of thc same image exposure device as in Example 11, image exposure was effected, followed by development, transfer and fixing to obtain visible images on plain papers.

The images obtained in this case were free from any interference fringe pattern observed, exhibiting practically satisfactory characteristics.

EXAMPLE 26

The case of No. 1-1C in Example 11 and Examples 13 to 25 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in the case of No. 1-1C in Example 11 and Examples 13 to 25.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 3

As a comparative test, an a-Si light-receiving member for electrophotography was prepared in entirely the same manner as in the case of Sample No. 1-1C in Example 11 as described above except for employing an aluminum substrate roughened on its surface by the sand blasting method in place of the aluminum substrate used in preparation of the light-receiving member for electrophotography in Example 11. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light receiving member for electrophotography for comparative purpose on the device shown in FIG. 26 employed in Example 11, clear interference fringe was found to be formed in the black image over all the surface.

EXAMPLE 27

An aluminum substrate having a shape as shown in FIG. 9 (length (L) 357 mm, outerdiameter (r) 80 mm, pitch (P) 25 μm, depth (D) 0.8 μm; spirally grooved surface shape) was prepared.

Next, by means of the deposition device as shown in FIG. 20, following the various procedures under the conditions shown in Table 3D, a-Si light-receiving layers were deposited on the above aluminum substrate (Sample No. 1-1D).

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of the substrate 1201. In this case, the difference in the total thickness between the center and both ends of the aluminum substrate was found to be 1 μm (Sample No. 1-2D).

Also, in the case of the above Sample No. 1-1D, as shown in FIG. 65, the surface of the second laycr 1303 was found to be non-parallel to the surface of the substrate 1301. In this case, the difference in thc total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 (Sample No. 1-2D), an interference fringe pattern was observed.

On the other hand, in the light-receiving member having the surface characteristic as shown in FIG. 64 (Sample No. 1-1D), no interference fringe pattern was observed and the member obtained exhibited practically satisfactory electrophotographic characteristics.

EXAMPLE 28

By means of a lathe, the surface of a cylindrical aluminum substrate was worked as shown in Table 1D. On these cylindrical aluminum substrates (Cylinder No. 101D-108D), under the same condition as in the case of the Sample No. 1-1D in Example 27, light-receiving members for electrophotography were prepared (Sample No. 111D-118D). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2D. For these light-receiving members, image exposure was effected by means of the device shown in FIG. 26 with a semiconductor laser with a wavelength of 780 nm at a spot diameter of 80 μm similarly as in Example 27 to obtain the results shown in Table 2D.

EXAMPLE 29

Light-receiving members for electrophotography were formed in the same manner as in the case of No. 1-1D in Example 27 under the conditions as shown in Table 3D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 27, image exposure was effected, followed by development, transfer and fixing to obtain visible mages on plain papers.

The images obtained in this case were free from any interference fringe pattern observed, exhibiting practically satisfactory characteristics.

EXAMPLE 30

Light-receiving members for electrophotography were formed in the same manner as in the case of No. 1-1D in Example 27 under the conditions as shown in Table 4D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 31

Light-receiving members for electrophotography were formed in the same manner as in the case of No. 1-1D in Example 27 under the condtions as shown in Table 4D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 32

Light-receiving members for electrophotography were formed in the same manner as in the case of No. 1-1D in Example 27 under the conditions as shown in Table 5D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 22.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 33

Light-receiving members for electrophotography were formed in the same manner as in the case of No. 1-1D in Example 27 under the conditions as shown in Table 6D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 34

Light-receiving members for electrophotography were formed in the same manner as in the case of No. 1-1D in Example 27 under the conditions as shown in Table 7D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 35

Light-receiving members for electrophotography were formed in the same manner as in the case of No. 1-1D in Example 27 under the conditions as shown in Table 8D.

In preparation of the first layer of a-(Si:Ge):H:B layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 27, image exposure was effected, followed by development, transfer and fixing to obtain visible images on plain papers.

The images obtained in this case were free from any interference fringe pattern observed, exhibiting practically satisfactory characteristics.

EXAMPLE 36

The case of No. 1-1D in Example 27 and Examples 29 to 35 were repeated except that PH3 gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in the case of No. 1-1D in Example 27 and Examples 29 to 35.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 4

As a comparative test, an a-Si light-receiving member for electrophotography was prepared in entirely the same manner as in the case of Sample No. 1-1D in Example 27 as described above except for employing an aluminum substrate roughened on its surface by the sand blasting method in place of the aluminum substrate used in preparation of the light receiving member for electrography in Example 27. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 27, clear interference fringe was found to be formed in the black image over all the surface.

EXAMPLE 37

An aluminum substrate having a shape as shown in FIG. 9 (length (L) 357 mm, outerdiameter (r) 80 mm pitch (P) 25 μm. depth (D) 0.8 μm; spirally grooved surface shape) was prepared.

Next, by means of the deposition device as shown in FIG. 20, following the various procedures under the conditions shown in Table 3E, a-Si light-receiving layers were deposited on the above aluminum substrate (Sample No. 1-1E).

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of the substrate 1201. In this case, the difference in the total thickness between the center and both ends of the aluminum substrate was found to be 1 μm (Sample No. 1-2E).

Also, in the case of the above Sample No. 1-1E, as shown in FIG. 65, the surface of the second layer 1303 was found to be non-parallel to the surface of the substrate 1301. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor lascr of a wavelength of 780 nm at a spot diameter of 80 μm, followed by development and transfer, to obtain an image. In the light-receiving member having the surface characteristic as shown in FIG. 64 (Sample No. 1-2E), an interference fringe pattern was observed.

On the other hand, in the light-receiving member having the surface characteristic as shown in FIG. 65 (Sample No. 1-1E), no interference fringe pattern was observed and the member obtained exhibited practically satisfactory electrophotographic characteristics.

EXAMPLE 38

By means of a lathe, the surface of a cylindrical aluminum substrate was worked as shown in Table 1E. On these cylindrical aluminum substrates (Cylinder Nos. 101E-108E), under the same condition as in the case of the Sample No. 1-1E in Example 37, light-receiving members for electrophotography were prepared (Sample Nos. 111E-118E). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2E. For these light-receiving members, image exposure was effected by means of the device shown in FIG. 26 with a semiconductor laser with a wavelength of 780 nm at a spot diameter of 80 μm similarly as in Example 37 to obtain the results shown in Table 2E.

EXAMPLE 39

Light-receiving members for electrophotography were formed in the same manner as in the case of No. 1-1E in Example 37 under the conditions as shown in Table 4E.

For these light-receiving members for electrophotography, by means of the same image exposure device as in Example 37, image exposure was effected, followed by development, transfer and fixing to obtain visible images on plain papers.

The image obtained in this case were free from any interference fringe pattern observed, exhibiting practicaly satisfactory characteristics.

EXAMPLE 40

Light-receiving members for electrophotography were formed in the same manner as in the case of No. 1-1E in Example 37 under the conditions as shown in Table 5E.

For these light-receiving members for electrophotography, by means of the same image exposure device as in Example 37, image exposure was effected, followed by development, transfer and fixing to obtain visible images on plain papers.

The images ootained in this case were free from any interference fringe pattern observed, exhibiting practicaly satisfactory characteristics.

EXAMPLE 41

Light-receiving members for electrophotography were formed in the same manner as in the case of No. 1-1E in Example 37 under the conditions as shown in Table 6E.

For these light-receiving members for electrophotography, by means of the same image exposure device as in Example 37, image exposure was effected, followed by development, transfer and fixing to obtain visible images on plain papers.

The images obtained in this case were free from any interference fringe pattern observed, exhibiting practicaly satisfactory characteristics.

EXAMPLE 42

Light-receiving members for electrophotography were formed in the same manner as in the case of No. 1-1E in Example 37 under the conditions as shown in Table 7E.

Figure 60:
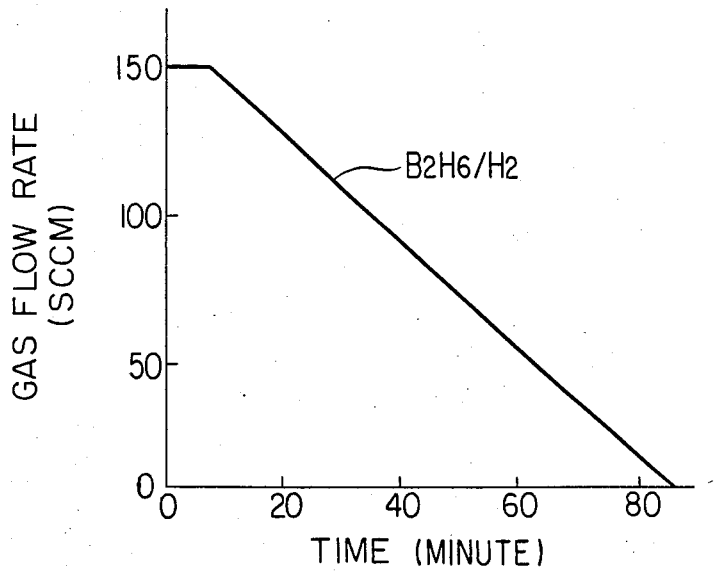

The boron containing layer was formed by controlling the mass flow controller 2010 for $B_2H_6/H_2$ by a computer (HP9845B) so that the flow rate of $B_2H_6/H_2$ may become as shown in FIG. 60.

For these light-receiving members for electrophotography, by means of the same image exposure device as in Example 37, image exposure was effected, followed by development, transfer and fixing to obtain visible images on plain papers.

The images obtained in this case were free from any interference fringe pattern observed, exhibiting practicaly satisfactory characteristics.

EXAMPLE 43

Light-receiving members for electrophotography were formed in the same manner as in the case of No. 1-1E in Example 37 under the conditions as shown in Table 8E.

Figure 61:
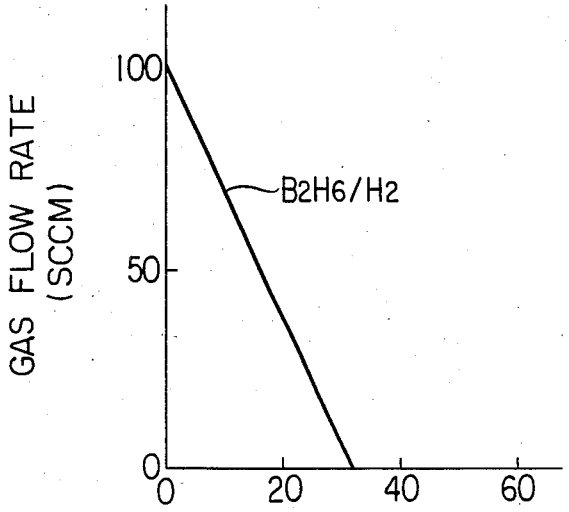

The boron containing layer was formed by controlling the mass flow controller 2010 for $B_2H_6/H_2$ by a computer (HP9845B) so that the flow rate of $B_2H_6/H_2$ may become as shown in FIG. 61.

For these light-receiving members for electrophotography, by means of the same image exposure device as in Example 1 , image exposure was effected, followed by development, transfer and fixing to obtain visible images on plain papers.

The images obtained in this case were free from any interference fringe pattern observed, exhibiting practicaly satisfactory characteristics.

EXAMPLE 44

Light-receiving members for electrophotography were formed in thc same manner as in the case of No. 1-1E in Example 37 under the conditions as shown in Table 9E.

Figure 21:
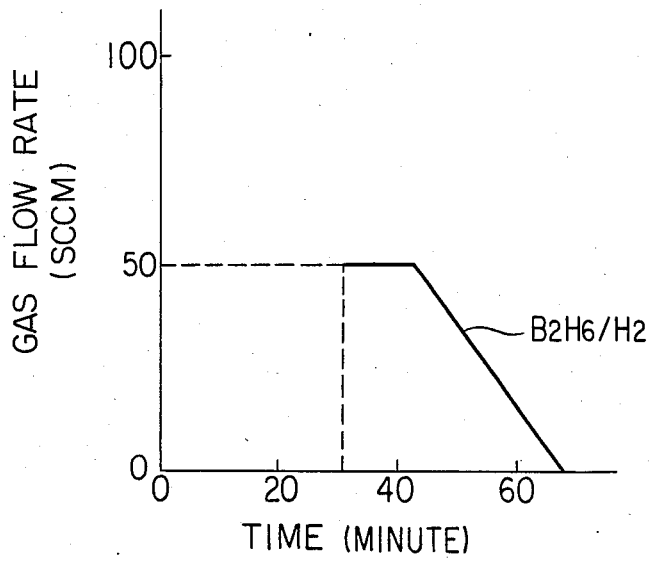
FIGS. 21 through 25, FIGS. 36 through 42, FIGS. 52 through 63 and FIGS. 66 through 79 are schematic illustrations showing changes in gas flow rates of respective gases in Examples.

The boron containing layer was formed by controlling the mass flow controller 2010 for $B_2H_6/H_2$ by a computer (HP9845B) so that the flow rate of $B_2H_6/H_2$ may become as shown in FIG. 21.

For these light-receiving members for electrophotography, by means of the same image exposure device as in Example 1, image exposure was effected, followed by development, transfer and fixing to obtain visible mages on plain papers.

The images obtained in this case were free from any interference fringe pattern observed, exhibiting practicaly satisfactory characteristics.

EXAMPLE 45

Light-receiving members for electrophotography were formed in the same manner as in the case of No. 1-1E in Example 37 under the conditions as shown in Table 10E.

Figure 63:
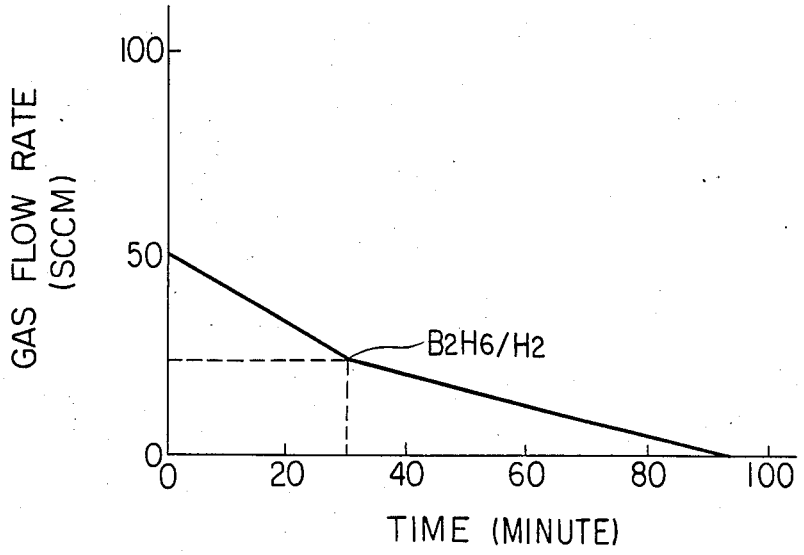

The boron containing layer was formed by controlling the mass flow controllor 2010 for $B_2H_6/H_2$ by a computer (HP9845B) so that the flow rate of $B_2H_6/H_2$ may become as shown in FIG. 63.

For these light-receiving members for electrophotography, by means of the same image exposure device as in Example 37, image exposure was effected, followed by development, transfer and fixing to obtain visible images on plain papers.

The images obtained in this case were free from any interference fringe pattern observed, exhibiting practicaly satisfactory characteristics.

EXAMPLE 46

The case of No. 1-1E in Example 37 and Examples 39 to 45 were repeated except that PH3 gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in the case of No. 1-1E in Example 37 and Examples 39 to 45.

For these light-receiving members for electrophotography, image exposure was effected by means of an image exposure device as shown in FIG. 26 (wavelength of laser beam: 780 nm, spot diameter 80 μm). followed by development and transfer, to obtain images. All of the images were free from interference fringe pattern and practically satisfactory.

COMPARATIVE EXAMPLE 5

As a comparative test, an a-Si light-receiving member for electrophotography was prepared in entirely the same manner as in the case of Sample No. 1-1E in Example 37 as described above except for employing an aluminum substrate roughened on its surface by the sand blasting method in place of the aluminum substrate used in preparation of the light-receiving member for electrophotography in Example 37. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 37, clear interference fringe was found to be formed in the black image over all the surface.

EXAMPLE 47

An aluminum substrate having a shape as shown in FIG. 9 (length (L) 357 mm, outerdiameter (r) 80 mm, pitch (P) 25 μm, depth (D) 0.8 μm; spirally grooved surface shape) was prepared.

Next, by means of the deposition device as shown in FIG. 20, following the various procedures under the conditions shown in Table 3F, a-Si light-receiving layers were deposited on the above aluminum substrate (Sample No. 1-1F).

Figure 36:
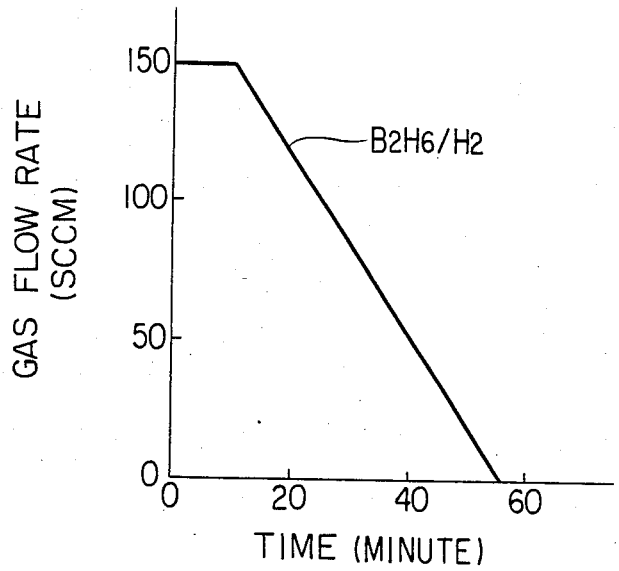

In preparation of the first layer, the mass flow controllers 2007, 2008 and 2010 for $GeH_4$ and $SiH_4$ were controlled by a computer (HP9845B) so that the flow rates of $GeH_4$, $SiH_4$ and $B_2H_6/H_2$ might be as shown in FIGS. 22 and 36.

Separately, on the cylindrical aluminum substarte with the same surface characteristic, light-receiving layers were formed in the same manner as described above except for changing the discharging power during formation of the first layer and the second layer each to 50 W. As the result, as shown in FIG. 64, the surface of the second layer 1203 was found to be in parallel to the surface of the substrate 1201. In this case, the difference in the total thickness between the center and both ends of the aluminum substrate was found to be 1 μm (Sample No. 1-2F).

Also, in the case of the above Sample No. 1-1F, as shown in FIG. 65, the surface of the second layer 1203 was found to be non-parallel to the surface of the substrate 1201. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer to obtain an image. In the light-receiving member having the surface characteristic as shown in FIG. 64 (Sample No. 1-2F), an interference fringe pattern was observed.

On the other hand, in the light-receiving member having the surface characteristic as shown in FIG. 65 (Sample No. 1-1F), no interference fringe pattern was observed and the member obtained exhibited practically satisfactory electrophotographic characteristics.

EXAMPLE 48

By means of a lathe, the surface of a cylindrical aluminum substrate was worked as shown in Table 1F. On these cylindrical aluminum substrates (Cylinder Nos. 101F-108F), under the same condition as in thc case of the Sample No. 1-1F in Example 47, light-receiving members for electrophotography were prepared (Sample Nos. 111F-118F). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 2F. For these light-receiving members, image exposure was effected by means of the device shown in FIG. 26 with a semiconductor laser with a wavelength of 780 nm at a spot diameter of 80 μm similarly as in Example 47 to obtain the results shown in Table 2F.

EXAMPLE 49

Light-receiving members for electrophotography were formed in the same manner as in the case of No. 1-1F in Example 47 under the conditions as shown in Table 3F.

Figure 37:
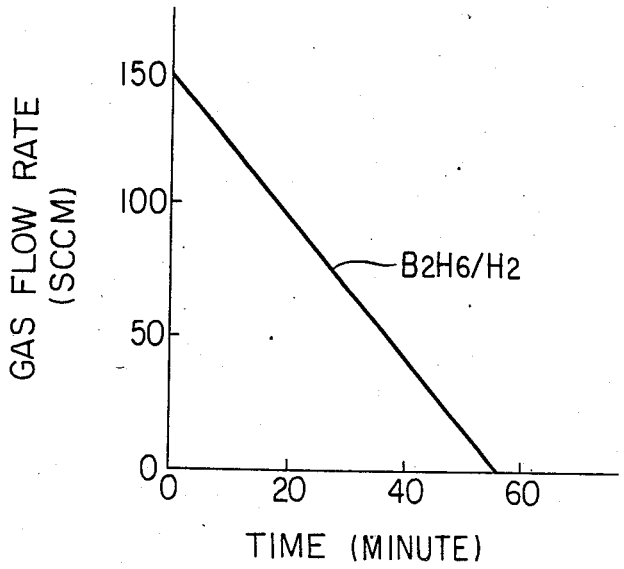

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIGS. 23 and 37.

For these light-receiving members for electrophotography, by means of the same image exposure device as in Example 47, image exposure was effected, followed by development, transfer and fixing to obtain visible images on plain papers.

The images obtained in this case were free from any interference fringe pattern observed, exhibiting practically satisfactory characteristics.

EXAMPLE 50

Light-receiving members for electrophotography were formed in the same manner as in the case of No. 1-1F in Example 47 under the conditions as shown in Table 4F.

Figure 38:
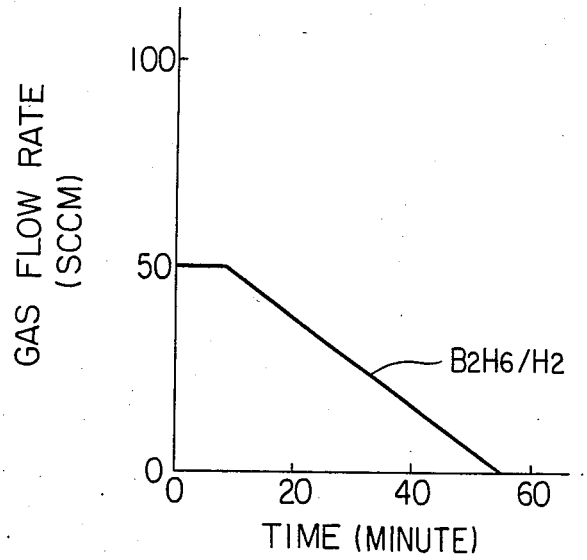

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIGS. 24 and 38.

For these light-receiving members for electrophotography, by means of the same image exposure device as in Example 47 , image exposure was effected, followed by development, transfer and fixing to obtain visible images on plain papers.

The images obtained in this case were free from any interference fringe pattern observed, exhibiting practically satisfactory characteristics.

EXAMPLE 51

Light-receiving members for electrophotography were formed in the same manner as in the case of No. 1-1F in Example 47 under the conditions as shown in Table 4F.

Figure 39:
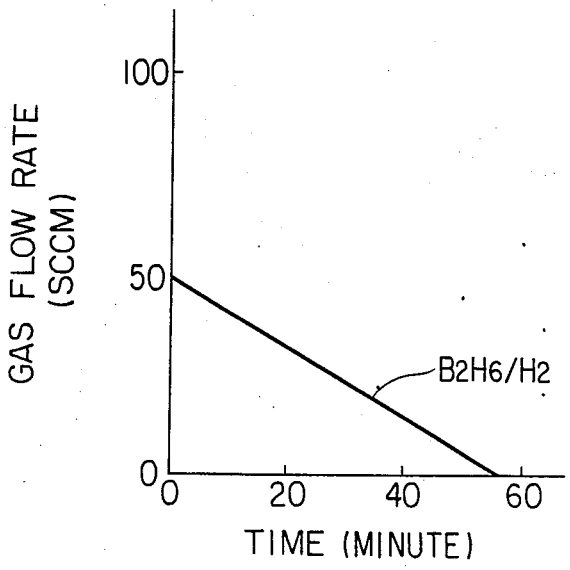

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIGS. 25 and 39.

For these light-receiving members for electrophotography, by means of the same image exposure device as in Example 47 , image exposure was effected, followed by development, transfer and fixing to obtain visible images on plain papers.

The images obtained in this case were free from any interference fringe pattern observed, exhibiting practically satisfactory characteristics.

EXAMPLE 52

Light-receiving members for electrophotography were formed in the same manner as in the case of No. 1-1F in Example 47 under the conditions as shown in Table 5F.

Figure 40:
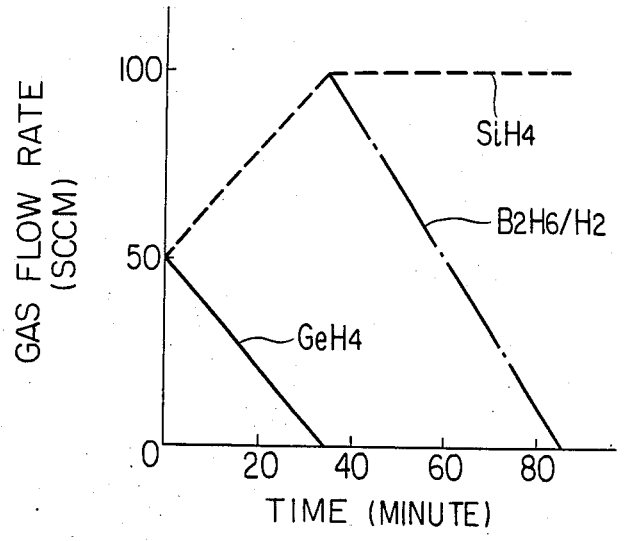

In preparat:on of the first layer and layer A. the mass flow controllers 2007, 2008 and 2010 were controlled by a computer (HP9845B) so that the flow rates of $GeH_4$, $SiH_4$ and $B_2H_6/H_2$ might be as shown FIG. 40.

For these light-receiving members for electrophotography, by means of the same image exposure device as in Example 47, image exposure was effected, followed by development, transfer and fixing to obtain visible images on plain papers.

The images obtained in this case were free from any interference fringe pattern observed, exhibiting practically satisfactory characteristics.

EXAMPLE 53

Light-receiving members for electrophotography were formed in the same manner as in the case of No. 1-1F in Example 47 under the conditions as shown in Table 6F.

Figure 41:
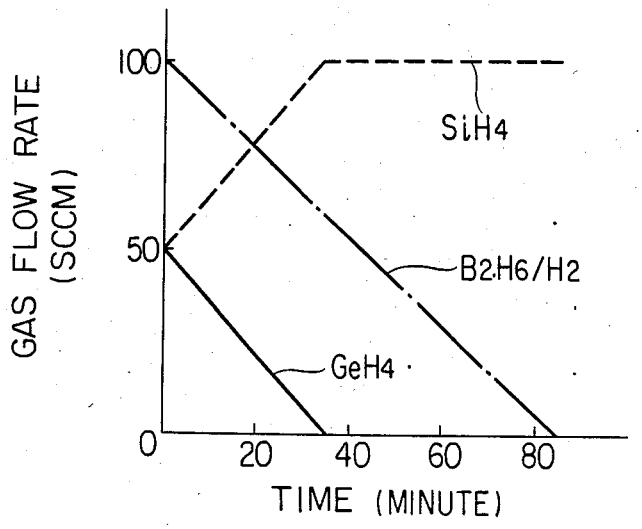

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 41.

For these light-receiving members for electrophotography, by means of the same image exposure device as in Example 47, image exposure was effected, followed by development, transfer and fixing to obtain visible images on plain papers.

The images obtained in this case were free from any interference fringe pattern observed, exhibiting practically satisfactory characteristics.

EXAMPLIE 54

Light-receiving members for electrophotography were formed in the same manner as in the case of No. 1-1F in Example 47 under the conditions as shown in Table 7F.

Figure 42:
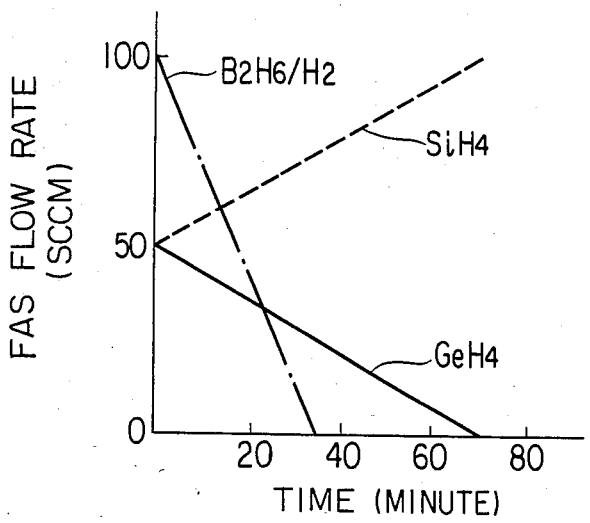

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 42.

For these light-receiving members for electrophotography, by means of the same image exposure device as in Example 47, image exposure was effected, followed by development, transfer and fixing to obtain visible images on plain papers.

The images obtained in this case were free from any interference fringe pattern observed exhibiting practically satisfactory characteristics.

COMPARATIVE EXAMPLE 6

As a comparative test, an a-Si light-receiving member for electrophotography was prepared in entirely the same manner as in the case of Sample No. 1-1F in Example 47 as described above except for employing an aluminum substrate roughened on its surface by the sand blasting method in place of the aluminum substrate used in preparation of the light-receiving member for electrophotography in Example 47. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 47, clear interference fringe was found to be formed in the black image over all the surface.

EXAMPLE 55

In this Example, a semiconductor laser (wavelength 780 nm) with a spot size of 80 μm was employed. Thus, on a cylindrical aluminum substrate (length (L) 357 mm, outer diameter (r) 80 mm) on which a-Si:H to be deposited, a spiral groove was prepared by a lathe with a pitch (P) of 25 μm and a depth (D) of 0.8 S. The form of the groove is shown in FIG. 9.

Next, under the conditions as shown in Table 1aG, by use of the film deposition device as shown in FIG. 20, an a Si type light-receiving member for electrophotography was prepared tollowing predetermined operational procedures (Sample No. 1-1 G).

NO gas was introduced, while controlling the flow rate by setting the mass flow controller so that its initial value may be 3.4 vol % based on the sum of $SiH_4$ gas flow rate and $GeH_4$ gas flow rate.

Separately, on the cylindrical aluminum substrate with the same surface characteristic, the first and second layers were formed in the same manner as described above except for changing the high frequency power to 40 W. As the result, as shown in FIG. 64, the surface of the light-receiving layer was found to be in parallel to the surface of the substrate 1201. In this case, the different in the total thickness between the center and both ends of the aluminum substrate was found to be 1 μm (Sample No. 1-2G).

Also, in the case when the above high frequency power was changed to 160 W, as shown in FIG. 65, the surface of the light-receiving layer was found to be non-parallel to the surface of the substrate 1301. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 40 W during layer preparation, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 56

By means of a lathe, the surface of a cylindrical aluminum substrate was worked as shown in Table 2G. On these cylindrical aluminum substrates (Cylinder Nos.10-1G-108G), under the same condition as in the case when no interference fringe pattern was observed (high frequency power 160 W) in Example 55, light receiving members for electrophotography were prepared (Sample Nos. 11G–118G). The difference in average layer thickness between the center and the both ends of the aluminum substrate of thc light receiving members for electrophotography was found to be 2.2 μum.

The cross-sections of these light-receiving members for electrophotography were observed by electron microscope and the difference within the pitch of the second layer was measured to give the results as shown in Table 3G. For these light-receiving members, image exposure was effected by means of the device shown in FIG. 26 with a semiconductor laser with a wavelength of 780 nm at a spot diameter of 80 μm similarly as in Example 55 to obtain the results shown in Table 3G.

EXAMPLE 57

Light-receiving members for electrophotography were formed in the same manner as in the case of No. 1–1G in Example 55 under the conditions as shown in Table 4G.

For these light-receiving members for electrophotography, by means of the same image exposure device as in Example 55, image exposure was effected, followed by development and transfer to obtain visible images.

The images obtained in this case were free from any interference fringe pattern observed. exhibiting practically satisfactory electrophotographic characteristics.

EXAMPLE 58

Light-receiving members for electrophotography were formed in the same manner as in the case of No. 1–1G in Example 55 under the conditions as shown in Table 5G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 59

Light-receiving members for electrophotography were formed in the same manner as in the case of No. 1–1G in Example 55 under the conditions as shown in Table 6G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 60

Light-receiving members for electrophotography were formed in the same manner as in the case of No. 1–1G in Example 55 under the conditions as shown in Table 7G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 61

During formation of the first layer, the NO gas flow rate ratio was varied as shown in FIG. 49 relative to the sum of the $SiH_4$ gas flow rate and $GeH_4$ gas flow rate until the NO gas flow rate was made zero on completion of the layer preparation, following otherwise thc same conditions as the case when the high frequency power was changed to 160 W in Example 55, to prepare a light-receiving member for electrophotography.

Separately, on the substrate, the first and the second layers were formed in the same manner as described above except for changing the high frequency power to 40 W. As the result, as shown in FIG. 64, the surface of the light-receiving layer was found to be in parallel to the surface of the substrate 1201. In this case, the difference in the total thickness between the center and both ends of the aluminum substrate 1201 was found to be 1 μm.

Also, in the case when the above high frequency power was changed to 160 W, as shown in FIG. 65, the surface of the second layer 1301 was found to be nonparallel to the surface of the substrate 1301. In this case, the difference in the total thickness between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 40 W during layer preparation, an interference fringe pattern was observed.

On the other hand, in the light receiving member having the surface characteristic as shown in FIG. 65, no interference fringe pattern was observed and the member obtained exhibited practically satisfactory electrophotographic characteristics.

EXAMPLE 62

Light receiving members for electrophotography were formed in the same manner as in the case of No. 1–1G in Example 55 under the conditions as shown in Table 8G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 63

Light-receiving members for electrophotography were formed in the same manner as in the case of No. 1–1G in Example 55 under the conditions as shown in Table 9G.

For thcse light-receiving members for electrophotography, by means of the same image exposure device as in Example 55, image exposure was effected, followed by development and transfer to obtain visible images.

The images obtained in this case were free from any interference fringe pattern observed, exhibiting practically sarisfactory electrophotographic characteristics.

EXAMPLE 64

Light-receiving members for electrophotography were formed in the same manner as in the case of No. 1-1G in Example 55 under the conditions as shown in Table 10G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 65

Light-receiving members for electrophotography were formed in the same manner as in the case of No. 1-1G in Example 55 under the conditions as shown in Table 11G.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 66

Light-receiving members for electrophotography were prepared following the same procedure as in the case of Sample No. -1G in Example 55 under the conditions as shown in Tables 12G to 15G. During the layer formation, the flow rate ratio of NO gas to $SiH_4$ gas was changed according to the change rate curve of gas flow rate ratio shown in FIG. 66 to FIG. 69.

For these light-receiving members for electrophotography, by means of the same image exposure device as in Example 55, image exposure was effected, followed by development and transfer to obtain visible images.

The images obtained in this case were free from any interference fringe partern observed, exhibiting practically satisfactory electrophotographic characteristics.

EXAMPLE 67

A light-receiving member for electrophotography was prepared following the same procedure as in the case of Sample No. 1-1G in Example 55 under the conditions as shown in Table 16G. During the layer formation the flow rate ratio of NO gas to $SiH_4$ gas was changed according to the change rate curve of gas flow rate ratio shown in FIG. 66.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

EXAMPLE 68

Light-receiving members for electrophotography were prepared following the same procedure as in the case of Sample No. 1-1G in Example 55 under the conditions as shown in Tables 17G and 18G. During the layer formation, the flow rate ratio of $NH_3$ gas to $SiH_4$ gas and the flow rate ratio of $CH_4$ gas to $SiH_4$ gas were changed according to the changc ratc curve of gas flow rate ratio shown in FIG. 68.

For these light-receiving members for electrophotography, by means of the same image exposure device as in Example 55, image exposure was effected, followed by development and transfer to obtain visible images.

The images obtained in this case were free from any interference fringe pattern observed, exhibiting practically satisfactory electrophotographic characteristics.

COMPARATIVE EXAMPLE 7

As a comparative test, an a-Si light-receiving member for electrophotography was prepared in entirely the same manner as in the case of Sample No. 1-1G in Example 55 as described above except for employing an aluminum substrate roughened on its surface by the sand blasting method in place of the aluminum substrate used in preparation of the light-receiving member for electrography in Example 55. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the samc measurement was conductcd by mounting the light-receiving member for electrophotography for comparative purpose on the device shown in FIG. 26 employed in Example 55, clear interference fringe was found to be formed in the black image over all the surface.

EXAMPLE 39

An aluminum substrate having a shape as shown in FIG. 9 (length (L) 357 mm, outerdiameter (r) 80 mm, pitch (P) 25 μm, depth (D) 0.8 μm; spirally grooved surface shape) was prepared.

Next, by means of the film deposition device as shown in FIG. 20, following the various procedures under the conditions shown in Table 1H, a-Si light-receiving layers were deposited on the above aluminum substrate (Sample No. 1-1H).

In preparation of the first layer, the mass flow controllers 2007 and 2008 were controlled by a computer (HP9845B) so that the flow rates of $GeH_4$ and $SiH_4$ might be as shown in FIG. 22.

Separately, on the cylindrical aluminum substrate with the same surface characteristic, light-receiving layers were formed in the same manner as described above except for changing the discharging power durng formation of the first layer and the second 1ayer each to 50 W. As the result, as shown in FIG. 64, the surface of the light receiving layer was found to be in parallel to the surface of the substrate 1201. In this case, the difference in the total thickness between the center and both ends of the alumiunum substrate was found to be 1 μm (Sample No. 1-2H).

Also, in the case of the above Sample No 1-1H, as shown in FIG. 65, the surface of the light-receiving layer was found to be non-parallel to the surface of the substrate 1301. In this case, the difference in the total thickness between the center and both ends of the aluminum substrate was found to be 2 μm.

For the above light-receiving members for electrophotography, image exposure was effected by mean of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64, an interference fringe pattern was observed.

On the other hand, in the light receiving member having the surface characteristic as shown in FIG. 65, no interference fringe pattern was observed and the member obtained exhibited practically satisfactory electrophotographic characteristics.

EXAMPLE 70

By means of a 1athe, the surface of a cylindrical aluminum substrate was worked as shown in Table 2H . On these cylindrical aluminum substrates (Cylinder Nos 101H–108H), under the same condition as in the case of the Sample No. 1–1H in Example 69, light-receiving members for electrophotography were prepared (Sample No. 111H–118H). The difference in average layer thickness between the center and the both ends of the aluminum substrate of the light-receiving members for electrophotography was found to be 2.2 $\mu$m.

The cross-sections of these light-receiving members for electrophotography were observed by electron microscope and the difference within the pitch of the light-receiving layer was measured to give the results as shown in Table 3H. For these light-receiving members, image exposure was effected by means of the device shown in FIG. 26 with a semiconductor laser with a wavelength of 780 nm at a spot diameter of 80 $\mu$m similarly as in Example 69 to obtain the results shown in Table 3H.

EXAMPLE 71

Light-receiving members for electrophotography were formed in the same manner as in the case of No. 1–1H in Example 69 under the conditions as shown Table 4H.

In preparation of the first layer, the mass flow controllers 2007 and 2008 were controlled by a computer (HP9845B) so that the flow rates of $GeH_4$ and $SiH_4$ might be as shown in FIG. 23.

For these light receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 72

Light-receiving members for electrophotography were formed in the same manner as in the case of No. 1–1H in Example 69 under the conditions as shown in Table 6H.

In preparation of the first layer, the mass flow controllers 2007 and 2008 were controlled by a computer (HP9845B) so that the flow rates of $GeH_4$ and $SiH_4$ might be as shown in FIG. 24.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 73

Light-receiving members for electrophotography were formed in the same manner as in the case of No. 1–1H in Example 69 under the conditions as shown in Table 6H.

In preparation of the first layer, the mass flow controllers 2007 and 2008 were controlled by a computer (HP9845B) so that the flow rates of $GeH_4$ and $SiH_4$ might be as shown in FIG. 25.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 74

A light-receiving member for electrophotography was prepared following the same condition and the procedure as described in Example 73 except for changing NH3 gas employed in Example 73 to NO gas.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 75

A light-receiving member for electrophotography was prepared following the same condition and the procedure as described in Example 73 except for changing $NH_3$ gas employed in Example 73 to $CH_4$ Q gas.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 76

Figure 70:
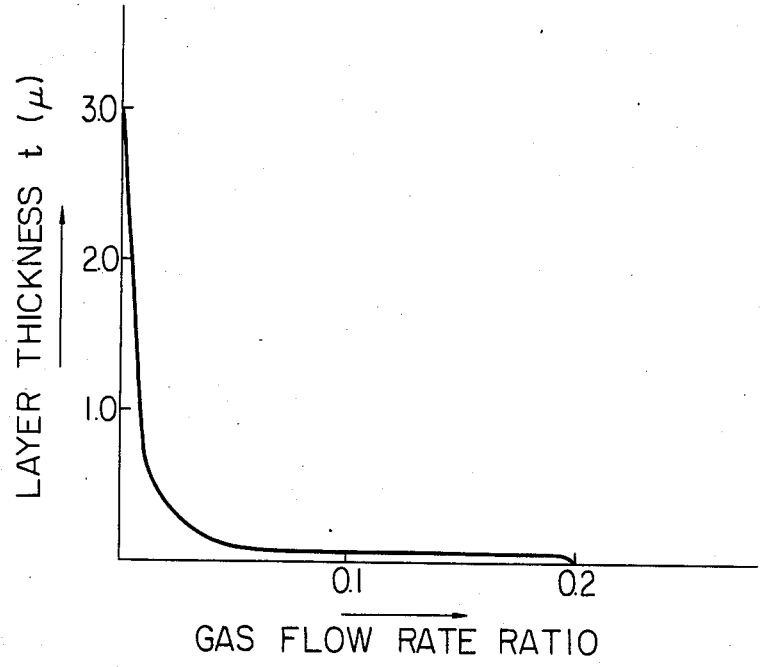

A light-receiving member for electrophotography was prepared following the same procedure as in the case of Sample No. 1–1H in Example 69 except for changing the flow rate ratio of NO gas according to the change rate curve of gas flow rate ratio shown in FIG. 70 under the conditions as shown in Table 7H with lapse of layer formation time.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 77

Figure 71:
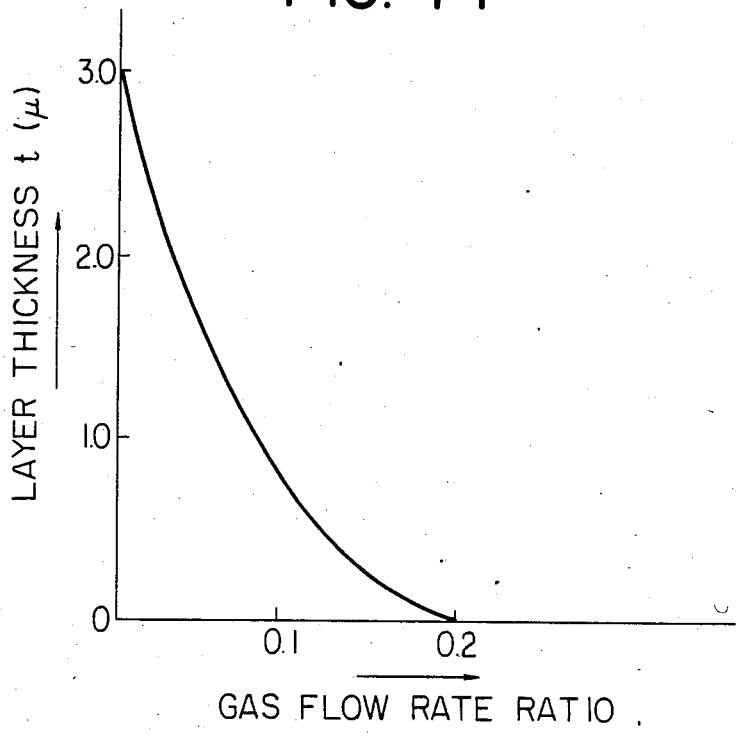

A light-receiving member for electrophotography was prepared following the same procedure as in the case of Sample No. 1–1H in Example 69 except for changing the flow rate ratio of $NH_3$ gas according to the change rate curve of gas flow rate ratio shown in FIG. 71 under the conditions as shown in Table 8H with lapse of layer formation time.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 78

Figure 58:
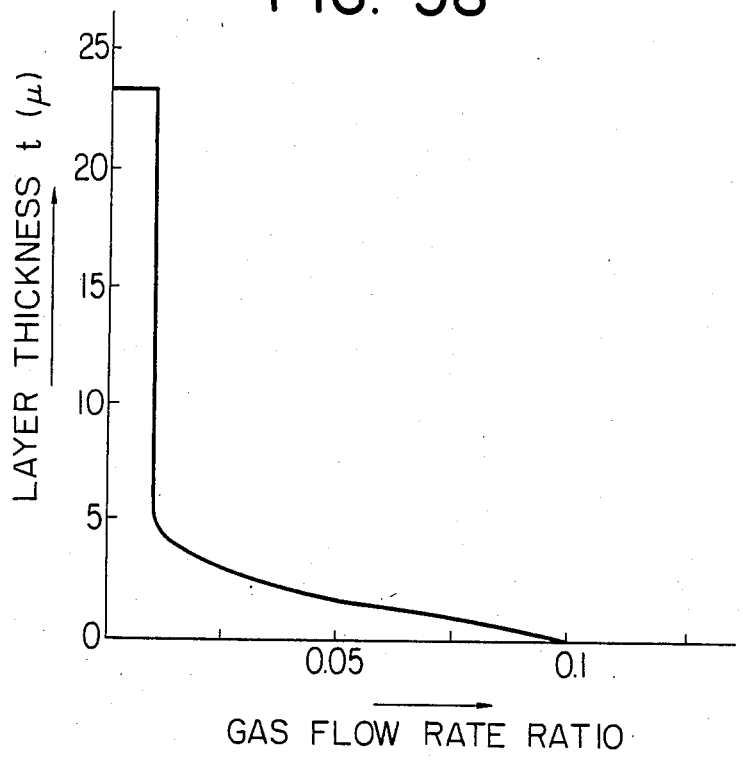

A light-receiving member for electrophotography was prepared following the same procedure as in the case of Sample No. 1-1H in Example 69 except for changing the flow rate ratio of NO gas according to the change rate curve of gas flow rate ratio shown in FIG. 58 under the conditions as shown in Table 9H with lapse of layer formation time.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 79

A light-receiving member for electrophotography was prepared following the same condition and the procedure as described in Example 78 except for changing NO gas employed in Example 78 to $NH_3$ gas.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 80

A light-receiving member for electrophotography was prepared following the same condition and the procedure as described in Example 78 except for changing NO gas employed in Example 78 to $CH_4$ gas.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

EXAMPLE 81

Figure 72:
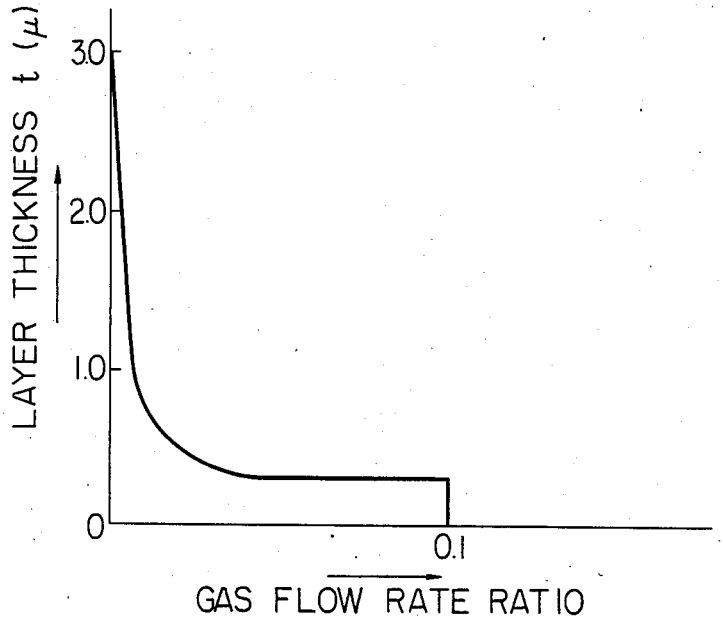

A light-receiving member for electrophotography was prepared following the same procedure as in the case of Sample No. 1-1H in Example 69 except for changing the flow rate ratio of $CH_4$ gas according to the change rate curve of gas flow rate ratio shown in FIG. 72 under the conditions as shown in Table 10H with lapse of layer formation time.

For these light-receiving members for electrophotography, by means of the same image exposure device as in Example 69, image exposure was effected, followed by development, transfer and fixing to obtain visible images on plain papers.

The images obtained in this case were free from any interference fringe pattern observed, exhibiting practically satisfactory characteristics.

COMPARATIVE EXAMPLE 8

As a comparative test, an a-Si light-receiving member for electrophotography was prepared in entirely the same manner as in the case of Sample No. 1-1H in Example 69 as described above except for employing an aluminum substrate roughened on its surface by the sand blasting method in place of the aluminum substrate used in preparation of the light-receiving member for electrophotography in Example 69. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 69, clear interference fringe was found to be formed in the black image over all the surface.

EXAMPLE 82

An aluminum substrate having a shape as shown in FIG. 9 [length (L) 357 mm, outerdiameter (r) 80 mm, pitch (P) 25 μ, depth (D) 0.8 μm; spirally grooved surface shape] was prepared.

Next, by means of the film deposition device as shown in FIG. 20, following the various procedures under the conditions shown in Table II, a-Si lightreceiving layers were deposited on the above aluminum substrate (Sample No. 1-1I).

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the light-receiving layer was found to be in parallel to the surface of the substrate 1201. In this case, the difference in the total thickness between the center and both ends of the aluminum substrate was found to be 1μm (Sample No. 1-2I).

Figure 69:
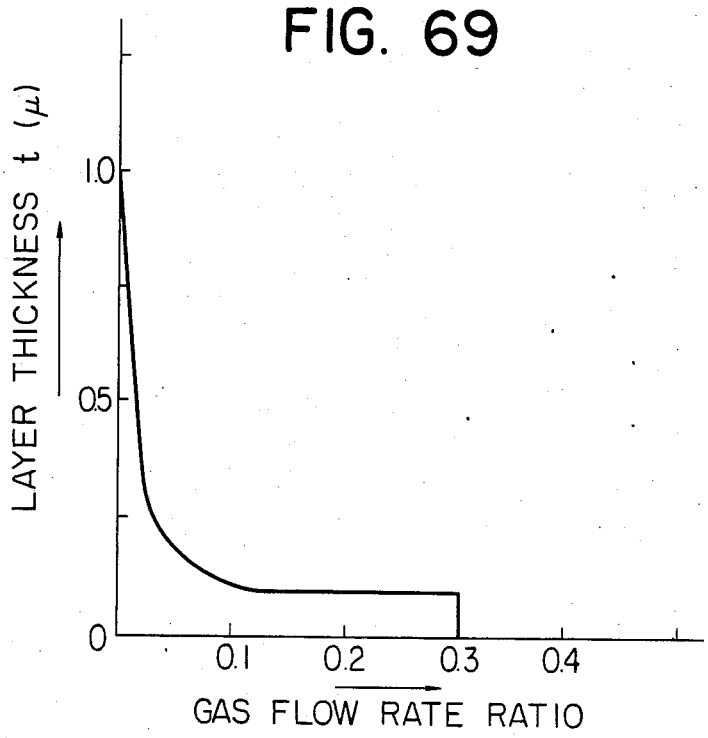

Also, in the case of the above Sample No. 1-1I, as shown in FIG. 69, the surface of the light-receiving layer was found to be non-parallel to the surface of the substrate 1301. In this case, the difference in the total thickness between the center and both ends of the aluminum substrate was found to be 2μm .

For these light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristics as shown in FIG. 64, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 83

By means of a lathe, the surface of a cylindrical aluminum substrate was worked as shown in Table 2I. On these cylindrical aluminum substrates (Cylinder No. 101I–108I), under the same condition as in the case of the Sample No. 1–1I in Example 82, light-receiving members for electrophotography were prepared (Sample No. 111I–118I). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3I. For these light-receiving members, image exposure was effected by means of the device shown in FIG. 26 with a semiconductor laser with a wavelength of 780 nm at a spot diameter of 80 μm similarly as in Example 82 to obtain the results shown in Table 3I.

EXAMPLE 84

Light-receiving members for electrophotography were formed in the same manner as in the case of No. 1'I in example 82 under the conditions as shown in Table 4I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 85

Light-receiving members for electrophotography were formed in the same manner as in the case of No. 1–1I in Example 82 under the conditions as shown in Table 5I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 86

Light-receiving members for electrophotography were formed in the same manner as in the case of No. 1–1I in Example 82 under the conditions as shown in Table 6I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 87

Light-receiving members for electrophotography were formed in the same manner as in the case of No. 1–1I in Example 82 under the conditions as shown in Table 7I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 88

Light-receiving members for electrophotography were formed in the same manner as in the case of No. 1–1I in Example 82 under the conditions as shown in Table 8I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 89

Light-receiving members for electrophotography were formed in the same manner as in the case of No. 1–1I in Example 82 under the conditions as shown in Table 9I.

Figure 74:
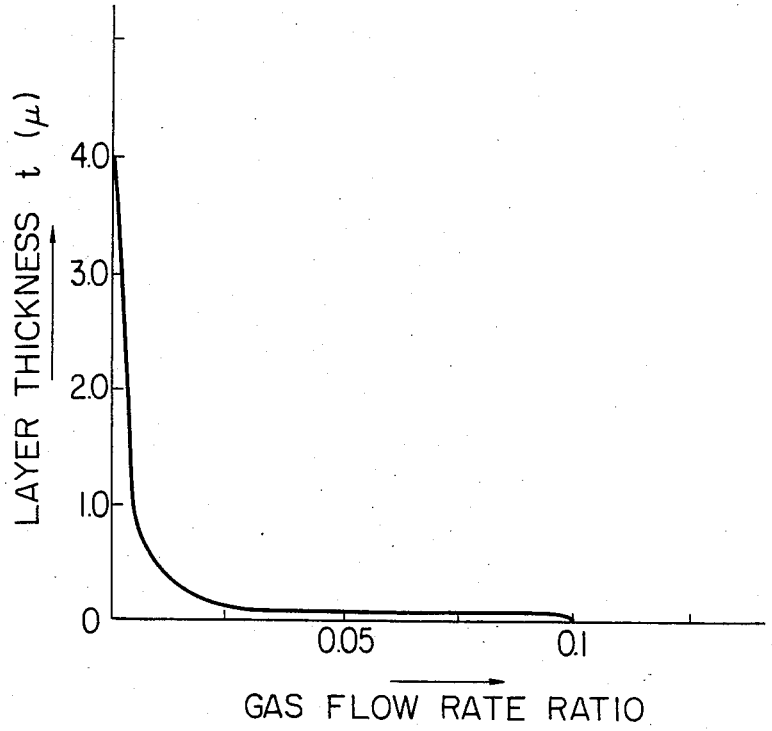

During the layer formation, the flow rate ratio of NO gas relative to the sum of $GeH_4$ gas and $SiH_4$ gas was changed according to the change rate curve shown in FIG. 74.

For these light-receiving members for electrophotography, by means of the same image exposure device as in Example 82 image exposure was effected, followed by development, transfer and fixing to obtain visible images on plain papers.

The images obtained in this case were free from any interference fringe pattern observed, exhibiting practically satisfactory characteristics.

EXAMPLE 90

Light-receiving members for electrophotography were formed in the same manner as in the case of No. 1–1I in Example 82 under the conditions as shown in Table 10I.

Figure 75:
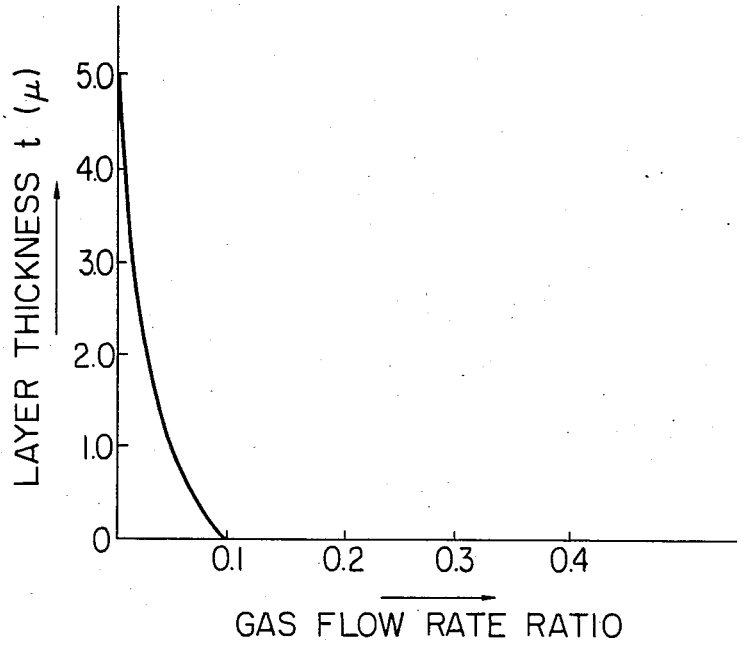

During the layer formation, the flow rate ratio of $NH_3$ gas relative to the sum of $GeH_4$ gas and $SiH_4$ gas was changed according to the change rate curve shown in FIG. 75.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 91

Light-receiving members for electrophotography were formed in the same manner as in the case of No.

1-1I in Example 82 under the conditions as shown in Table 11I.

Figure 57:
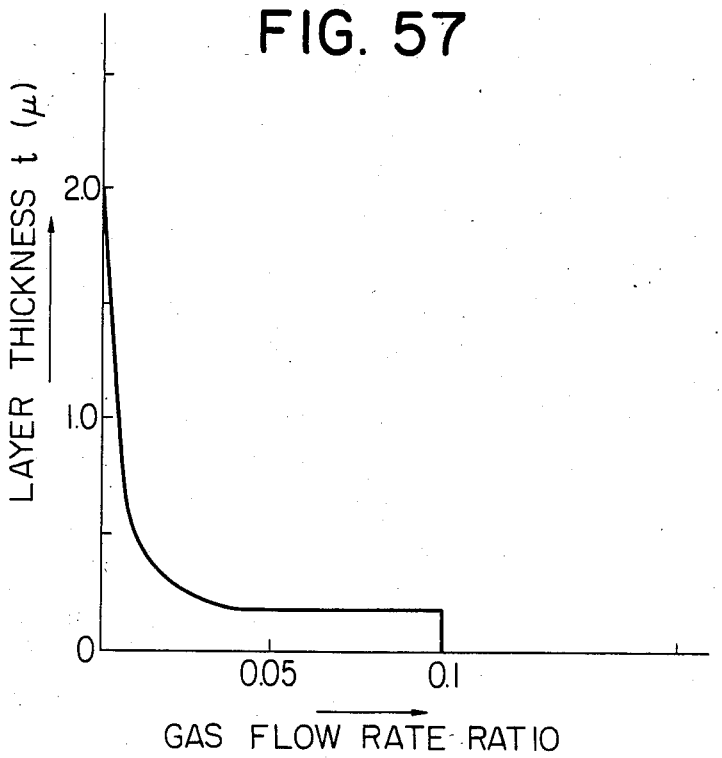

During the layer formation, the flow rate ratio of $CH_4$ gas relative to the sum of $GeH_4$ gas and $SiH_4$ gas was changed according to the change rate curve shown in FIG. 57.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 92

Light-receiving members for electrophotography were formed in the same manner as in the case of No. 1-1I in Example 82 under the conditions as shown in Table 12I.

Figure 76:
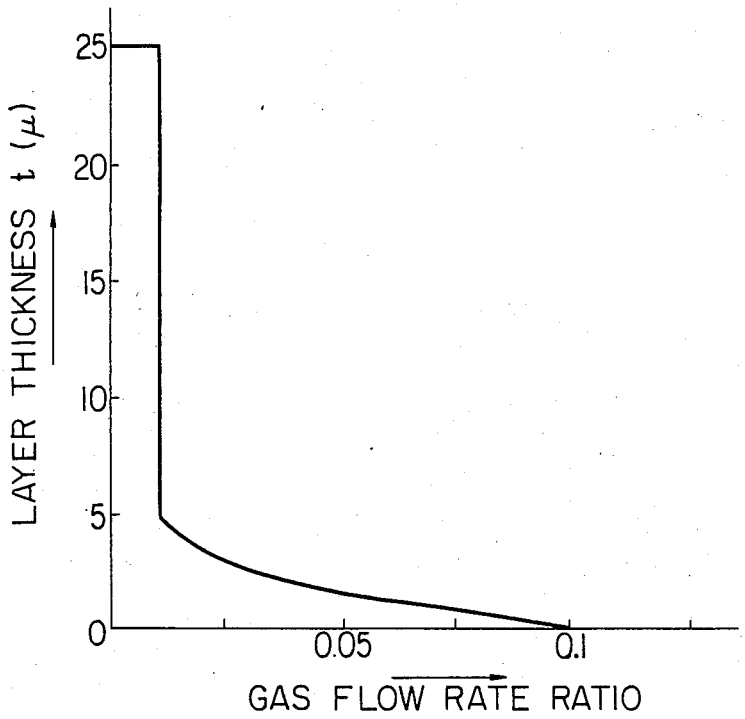

During the layer formation, the flow rate ratio of NO gas relative to the sum of $GeH_4$ gas and $SiH_4$ gas was changed according to the change rate curve shown in FIG. 76.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 93

Light-receiving members for electrophotography were formed in the same manner as in the case of No. 1-1I in Example 82 under the conditions as shown in Table 13I.

Figure 77:
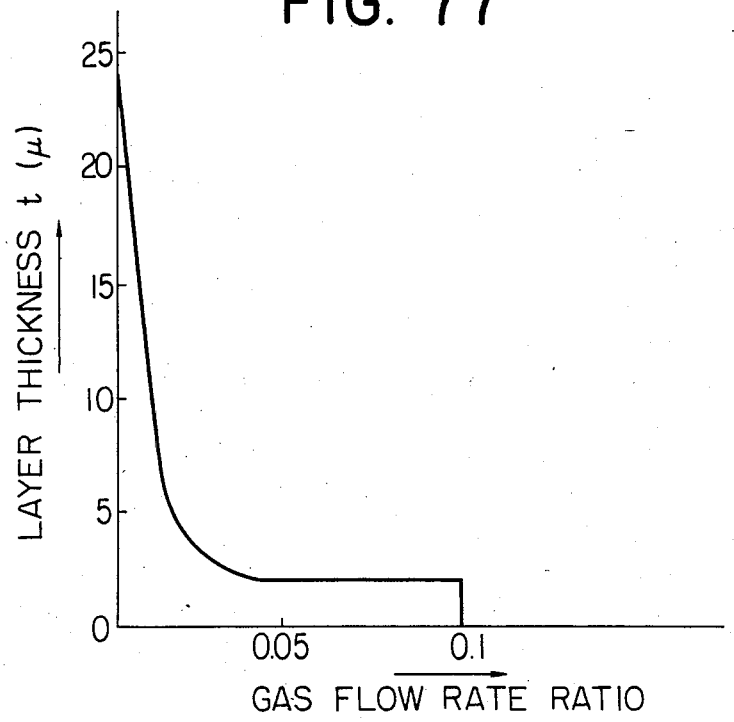

During the layer formation, the flow rate ratio of $NH_3$ gas relative to the sum of $GeH_4$ gas and $SiH_4$ gas was changed according to the change rate curve shown in FIG. 77.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 94

Light-receiving members for electrophotography were formed in the same manner as in the case of No. 1-1I in Example 82 under the conditions as shown in Table 14I.

Figure 73:
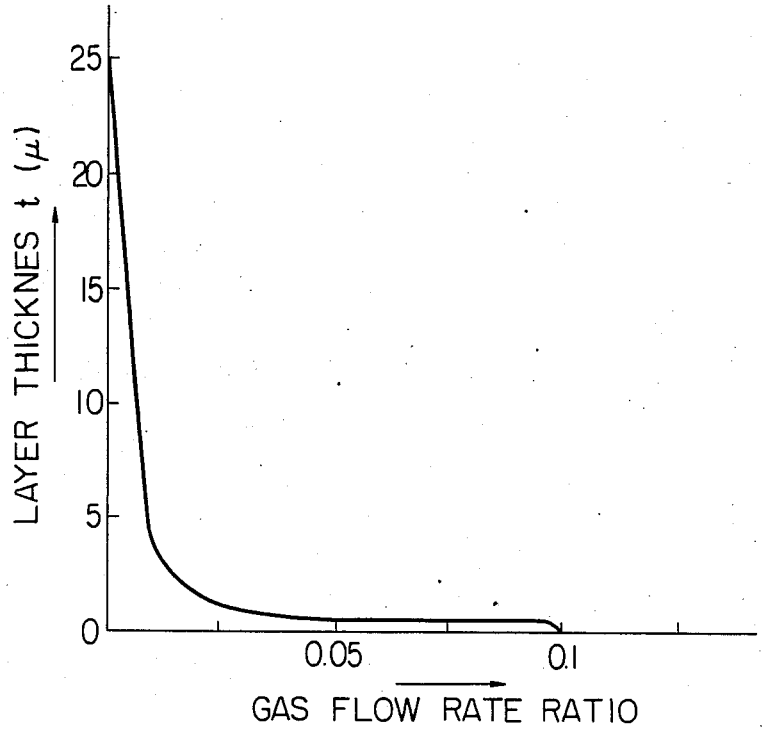

During the layer formation, the flow rate ratio of $CH_4$ gas relative to the sum of $GeH_4$ gas and $SiH_4$ gas was changed according to the change rate curve shown in FIG. 73.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 95

Light-receiving members for electrophotography were formed in the same manner as in the case of No. 1-1I in Example 82 under the conditions as shown in Table 15I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 96

Light-receiving members for electrophotography were formed in the same manner as in the case of No. 1-1I in Example 82 under the conditions as shown in Table 16I.

For these light-receiving members for electrophotography, by means of the same image exposure device as in Example 82, image exposure was effected, followed by development, transfer and fixing to obtain visible images on plain papers.

The images obtained in this case were free from any interference fringe pattern observed, exhibiting practically satisfactory characteristics.

EXAMPLE 97

The case of No. 1-1I in Example 82 and Examples 84 to 96 were repeated except that $PH_3$ gas diluted to 3000 vol ppm with $H_2$ was employed in place of $B_2H_6$ gas diluted to 3000 vol ppm with $H_2$ to prepare light-receiving members for electrophotography respectively.

Other preparation conditions were the same as in the case of No. 1-1I in Example 82 and Examples 84 to 96.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARITIVE EXAMPLE 9

As a comparative test, an a-Si light-receiving member for electrophotography was prepared in entirely the same manner as in the case of Sample No. 1-1I in Example 82 as described above except for employing an aluminum substrate roughened on its surface by the sand blasting method in place of the aluminum substrate used in preparation of the light-receiving member for electrography in Example 82. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 82, clear interference fringe was found to be formed in the black image over all the surface.

EXAMPLE 98

In this Example, on a cylindrical aluminum substrate [length (L) 357 mm, outer diameter (r) 80 mm] a spiral groove was prepared by a lathe with a pitch (P) of 25 μm and a depth (D) of 0.8 S. The form of the groove is shown in FIG. 9.

Next, under the conditions as shown in Table 3J, by use of the film deposition device as shown in FIG. 20, a a-Si type light-receiving member for electrophotography was prepared following predetermined operational procedures (Sample No. 1-1J).

In preparation of the first layer of a-SiGe:H:B:O layer, the mass flow controllers 2007, 2008 and 2010 were controlled by a computer (HP9845B) so that the flow rates of $GeH_4$ and $SiH_4$ might be as shown in FIG. 22.

Separately, on the cylindrical aluminum substrate with the same surface characteristic, the first layer and the second layer were formed in the same manner as described above except for changing the high frequency power to 40 W. As the result, as shown in FIG. 64, the surface of the light receiving layer was found to be in parallel to the surface of the substrate 1201. In this case, the difference in the total thickness between the center and both ends of the aluminum substrate was found to be 1 μm (Sample No. 1-2J).

Also, in the case when the above high frequency power was changed to 160 W, as shown in FIG. 65, the surface of the light receiving layer was found to be non-parallel to the surface of the substrate 1301. In this case, the difference in the total thickenss between the center and both ends of the aluminum substrate was found to be 2 μm.

For the two kinds of the light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64 at a high frequency power of 40 W during layer preparation, an interference fringe pattern was observed On the other hand, in the light-receiving member having the surface characteristic as shown in FIG. 65, no interference fringe pattern was observed and the member obtained exhibited practically satisfactory electrophotographic characteristics.

EXAMPLE 99

By means of a lathe, the surface of a cylindrical aluminum substrate was worked as shown in Table 1J. On these cylindrical aluminum substrates (Cylinder Nos. 101J-108J, under the same condition as in the case when the interference fringe pattern disappeared (high frequency power 160 W) in Example 98, light-receiving members for electrophotography were prepared (Sample Nos. 111J-118J). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the second layer was measured to give the results as shown in Table 2J. For these light-receiving members, image exposure was effected by means of the device shown in FIG. 26 with a semiconductor laser with a wavelength of 780 nm at a spot diameter of 80 μm similarly as in Example 98 to obtain the results shown in Table 2J.

EXAMPLE 100

Light-receiving members for electrophotography were formed in the same manner as in the case of No. 1-1J in Example 98 under the conditions as shown in Table 3J except for during the preparation of the first layer of a-SiGe:H:B:O layer, the mass flow controllers 2007 and 2008 for $GeH_4$ and $SiH_4$ were controlled by a computer (HP9845B) so that the flow rates of $GeH_4$ and $SiH_4$ might be as shown in FIG. 23.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 101

An a-Si type light-receiving member for electrophotography was prepared following the same condition and the procedure as the case of No. 1-1J in Example 100 except for changing NO gas employed in Example 100 to $NH_3$ gas.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 102

An a-Si type light-receiving member for electrophotography was prepared following the same condition and the procedure as the case of No. 1-1J in Example 100 except for changing NO gas employed in Example 100 to $CH_4$ gas.

For these light-receiving members for electrophotography, by means of the same image exposure device as in Example 98, image exposure was effected, followed by development and transfer fixing to obtain visible images.

The images obtained in this case were free from any interference fringe pattern observed, exhibiting practically satisfactory electrophotographic characteristics.

EXAMPLE 103

Light-receiving members for electrophotography were formed in the same manner as in the case of No. 1-1J in Example 98 under the conditions as shown in Table 4J.

In preparation of the first layer of a-SiGe:H:B:N layer, the mass flow controllers 2007 and 2008 for $GeH_4$ and $SiH_4$ were controlled by a computer (HP9845B) so that the flow rates of $GeH_4$ and $SiH_4$ might be as shown in FIG. 24.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 104

Light-receiving members for electrophotography were formed in the same manner as in the case of No. 1-1J in Example 98 under the conditions as shown in Table 4J.

In preparation of the first layer of a-SiGe:H:B:N layer, the mass flow controllers 2007 and 2008 for $GeH_4$ and $SiH_4$ were controlled by a computer (HP9845B) so that the flow rates of $GeH_4$ and $SiH_4$ might be as shown in FIG. 25.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 105

An a-Si type light-receiving member for electrophotography was prepared following the same condition and the procedure as described in Example 103 except for changing $NH_3$ gas employed in Example 103 to NO gas.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 106

An a-Si type light-receiving member for electrophotography was prepared following the same condition and the procedure as described in Example 103 except for changing $NH_3$ gas employed in Example 103 to $CH_4$ gas.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 107

Light-receiving members for electrophotography were formed in the same manner as in the case of No. 1-1J in Example 98 under the conditions as shown in Table 5J.

In preparation of the first layer of a-SiGe:H:B:C layer, the mass flow controllers 2008 and 2007 for $GeH_4$ and $SiH_4$ were controlled by a computer (HP9845B) so that the flow rates of $GeH_4$ and $SiH_4$ might be as shown in FIG. 22.

Also, the flow rate ratio of $CH_4$ gas relative to the sum of $GeH_4$ gas and $SiH_4$ gas was changed according to the change rate curve shown in FIG. 72.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 108

An a-Si type light-receiving member for electrophotography was prepared following the same condition and the procedure as described in Example 107 except for changing $CH_4$ gas employed in Example 107 to NO gas.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 109

An a-Si type light-receiving member for electrophotography was prepared following the same condition and the procedure as described in Example 107 except for changing $CH_4$ gas employed in Example 107 to $NH_3$ gas.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 110

Light-receiving members for electrophotography were formed in the same manner as in the case of No. 1-1J in Example 98 under the conditions as shown in Table 6J.

In preparation of the first layer of a-SiGe:H:B:O layer, the mass flow controllers 2008 and 2007 for $GeH_4$ and $SiH_4$ were controlled by a computer (HP9845B) so that the flow rates of $GeH_4$ and $SiH_4$ might be as shown in FIG. 24.

Also, the flow rate ratio of NO gas relative to the sum of $GeH_4$ gas and $SiH_4$ gas was changed according to the change rate curve shown in FIG. 58.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 111

Light-receiving members for electrophotography were formed in the same manner as in the case of No. 1-1J in Example 98 under the conditions as shown in Table 7J.

In preparation of the first layer of a-SiGe:H:B:N layer, the mass flow controllers 2008 and 2007 for $GeH_4$ and $SiH_4$ were controlled by a computer (HP9845B) so that the flow rates of $GeH_4$ and $SiH_4$ might be as shown in FIG. 25.

Figure 78:
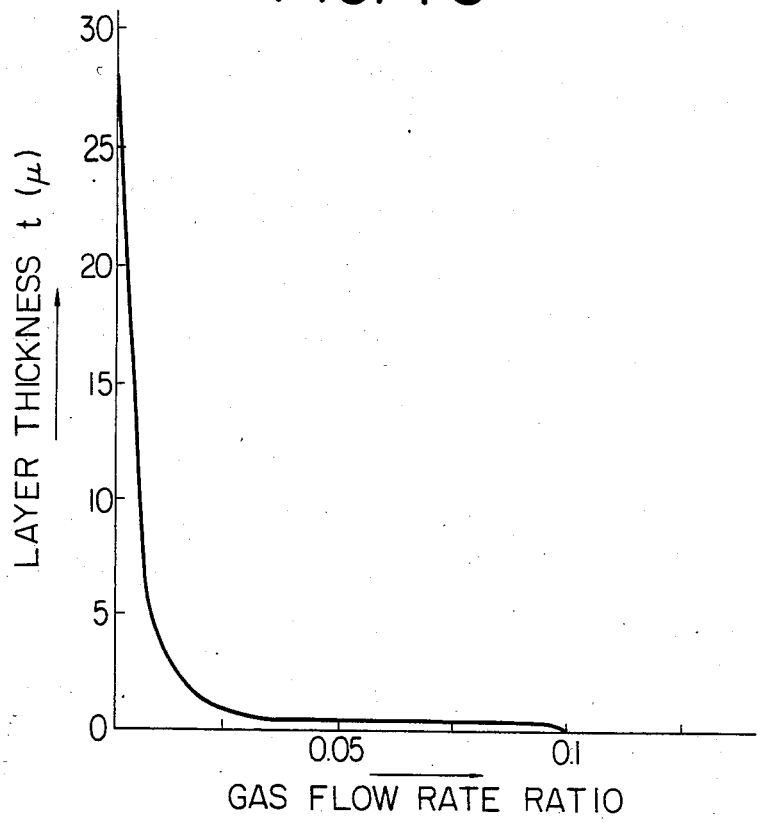

Also, the flow rate ratio of $NH_3$ gas relative to the sum of $GeH_4$ gas and $SiH_4$ gas was changed according to the change rate curve shown in FIG. 78.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 112

Light-receiving members for electrophotography were formed in the same manner as in the case of No. 1-1J in Example 98 under the conditions as shown in Table 8J.

In preparation of the first layer of a-SiGe:H:B:C layer, the mass flow controllers 2008 and 2007 for $GeH_4$ and $SiH_4$ were controlled by a computer (HP9845B) so that the flow rates of $GeH_4$ and $SiH_4$ might be as shown in FIG. 23.

Figure 79:
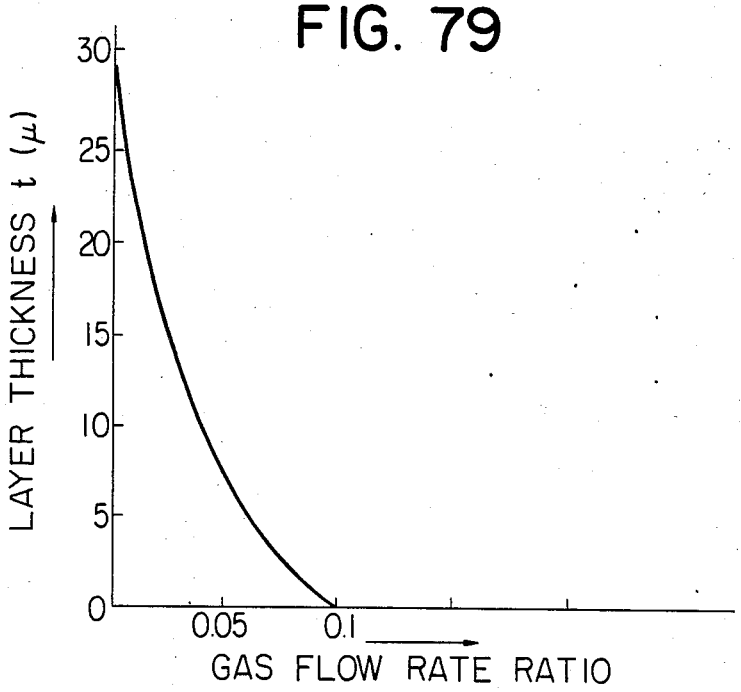

Also, the flow rate ratio of $CH_4$ gas relative to the sum of $GeH_4$ gas and $SiH_4$ gas was changed according to the change rate curve shown in FIG. 79.

For these light-receiving members for electrophotography, by means of the same image exposure device as in Example 98, image exposure was effected, followed by development and transfer to obtain visible images.

The images obtained in this case were free from any interference fringe pattern observed, exhibiting practically satisfactory electrophotographic characteristics.

EXAMPLE 113

Example 100 to 112 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as in Examples 100 to 112.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 10

As a comparative test, an a-Si light-receiving member for electrophotography was prepared in entirely the same manner as in the case of Sample No. 1-1J in Example 98 as described above except for employing an aluminum substrate roughened on its surface by the sand blasting method in place of the aluminum substrate used in preparation of the light-receiving member for electrography in Example 98. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 98, clear interference fringe was found to be formed in the black image over all the surface.

EXAMPLE 114

An aluminum substrate having a shape as shown in FIG. 9 [length (L) 357 mm, outerdiameter (r) 80 mm, pitch (P) 25 μm, depth (D) 0.8 μm; spirally grooved surface shape] was prepared.

Next, by means of the film deposition device as shown in FIG. 20, following the various procedures under the conditions shown in Table 1K, a-Si light-receiving layers were deposited on the above aluminum substrate (Sample No. 1-1K).

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the light-receiving layer was found to be in parallel to the surface of the substrate 1201. In this case, the difference in the total thickness between the center and both ends of the aluminum substrate was found to be 1 μm (Sample No. 1-2K).

Also, in the case of the above Sample No. 1-1K, as shown in FIG. 65, the surface of the light-receiving layer was found to be non-parallel to the surface of the substrate 1301. In this case, the difference in the total thickness between the center and both ends of the aluminum substrate was found to be 2 μm.

For these light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 115

By means of a lathe, the surface of a cylindrical aluminum substrate was worked as shown in Table 2K. On these cylindrical aluminum substrates (Cylinder Nos. 101K-108K), under the same condition as in the case of the Sample No. 1-1K in Example 114, light-receiving members for electrophotography were prepared (Sample Nos. 111K-118K). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3K. For these light-receiving members, image exposure was effected by means of the device shown in FIG. 26 with a semiconductor laser with a wavelength of 780 nm at a spot diameter of 80 μm similarly as in Example 114 to obtain the results shown in Table 3K.

EXAMPLE 116

Light-receiving members for electrophotography were formed in the same manner as in the case of No. 1-1K in Example 114 under the conditions as shown in Table 4K.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 117

Light-receiving members for electrophotography were formed in the same manner as in the case of No. 1-1K in Example 114 under the conditions as shown in Table 5K.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 118

Light-receiving members for electrophotography were formed in the same manner as in the case of No. 1-1K in Example 114 under the conditions as shown in Table 6K.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 119

A light-receiving member for electrophotography was prepared following the same condition and the procedure as described in Example 117 except for changing $CH_4$ gas employed in Example 117 to $NH_3$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 120

A light-receiving member for electrophotography was prepared following the same condition and the procedure as described in Example 118 except for changing NO gas employed in Example 118 to $CH_4$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 121

Light-receiving members for electrophotography were formed in the same manner as in the case of No. 1-1K in Example 114 under the conditions as shown in Table 7K.

Figure 56:
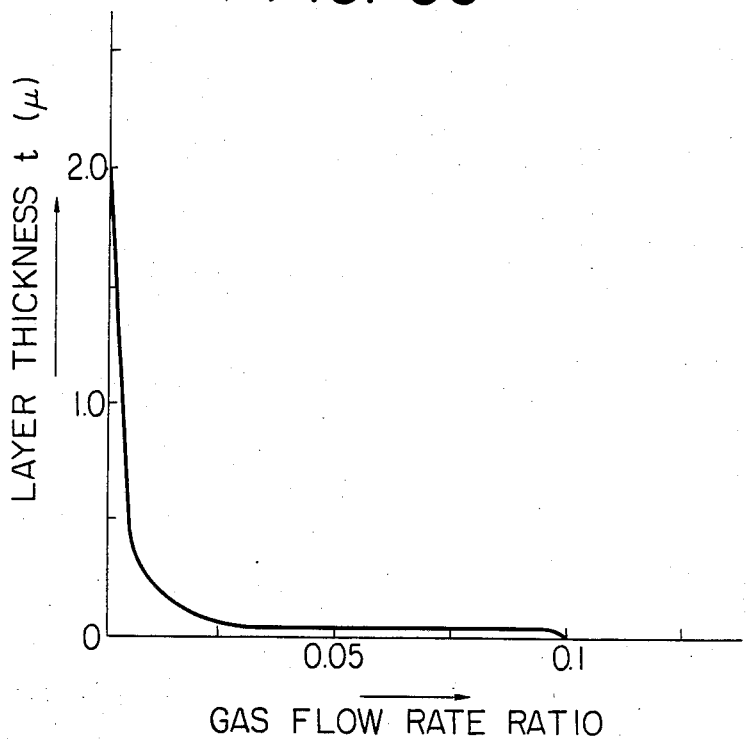

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 60 and the flow rate of $NH_3$ as shown in FIG. 56.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed exhibiting practically satisfactory characteristics.

EXAMPLE 122

A light-receiving member for electrophotography was prepared following the same condition and the procedure as described in Example 121 except for changing NH gas employed in Example 121 to NO gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 123

A light-receiving member for electrophotography was prepared following the same condition and the procedure as described in Example 121 except for changing $NH_3$ gas employed in Example 121 to $CH_4$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 124

Light-receiving members for electrophotography were formed in the same manner as in the case of No. 1-1K in Example 114 under the conditions as shown in Table 8K.

In formation of the boron containing layer, the respective mass flow controllers for $B_2H_6/H_2$ and $CH_4$ 2010 and 2009 were controlled by a computer (HP9845B) so that the flow rate of $B_2H_6/H_2$ might be as shown in FIG. 61 and the flow rate of $CH_4$ as shown in FIG. 57.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 125

A light-receiving member for electrophotography was prepared following the same condition and the procedure as described in Example 124 except for changing $CH_4$ gas employed in Example 124 to NO gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 126

A light-receiving member for electrophotography was prepared following the same condition and the procedure as described in Example 124 except for changing $CH_4$ gas employed in Example 124 to $NH_3$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 127

Light-receiving members for electrophotography were formed in the same manner as in the case of No. 1-1K in Example 114 under the conditions as shown in Table 9K.

Figure 62:
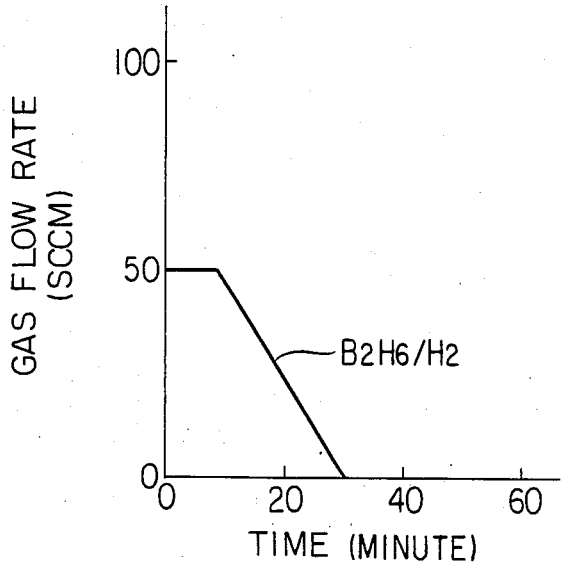

In formation of the boron containing layer, the respective mass flow controllers for $B_2H_6/H_2$ and NO 2010 and 2009 were controlled by a computer (HP9845B) so that the flow rate of $B_2H_6/H_2$ might be as shown in FIG. 62 and the flow rate of NO as shown in FIG. 58.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 128

A light-receiving member for electrophotography was prepared following the same condition and the procedure as described in Example 127 except for changing NO gas employed in Example 127 to $NH_3$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 129

A light-receiving member for electrophotography was prepared following the same condition and the procedure as described in Example 127 except for changing NO gas employed in Example 127 to $CH_4$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 130

Light-receiving members for electrophotography were formed in the same manner as in the case of No. 1-1K in Example 114 under the conditions as shown in Table 10K.

Figure 59:
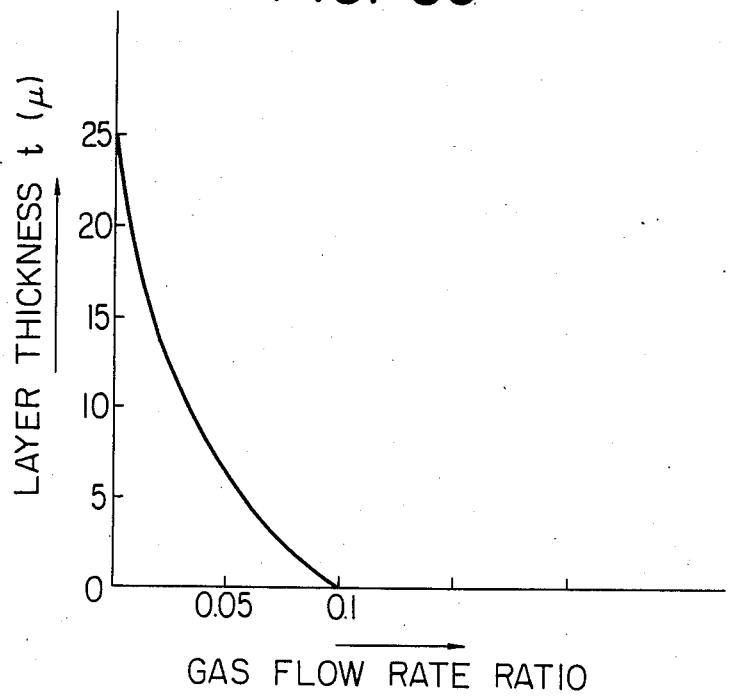

In formation of the boron containing layer, the respective mass flow controllers for $B_2H_6/H_2$ and $NH_3$ 2010 and 2009 were controlled by a computer (HP9845B) so that the flow rate of $B_2H_6/H_2$ might be as shown in FIG. 39 and the flow rate of $NH_3$ as shown in FIG. 59.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 131

A light-receiving member for electrophotography was prepared following the same condition and the procedure as described in Example 130 except for changing $NH_3$ gas employed in Example 130 to NO gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 132

A light-receiving member for electrophotography was prepared following the same condition and the procedure as described in Example 130 except for changing $NH_3$ gas employed in Example 130 to $CH_4$ gas.

For these light-receiving members for electrophotography, by means of the same image exposure device as in Example 114, image exposure was effected, followed by development, transfer and fixing to obtain visible images on plain papers.

The images obtained in this case were free from any interference fringe pattern observed, exhibiting practically satisfactory characteristics.

EXAMPLE 133

The case of Sample No. 1-1K in Example 114 and Examples 116 to 132 were repeated except that $PH_3$ gas diluted to 3000 vol ppm with $H_2$ was employed in place of $B_2H_6$ gas diluted to 3000 vol ppm with $H_2$ to prepare light-receiving members for electrophotography, respectively.

Other preparation conditions were the same as in the case of Sample No. 1-1K in Example 114 and Examples 116 to 132.

For these light-receiving members for electrophotography, image exposure was effected by means of an image exposure device as shown in FIG. 26 (wavelength of laser beam: 780 nm, spot diameter 80 μm), followed by development and transfer, to obtain images. All of the images were free from interference fringe pattern and practically satisfactory.

COMPARATIVE EXAMPLE 11

As a comparative test, an a-Si light-receiving member for electrophotography was prepared in entirely the same manner as in the case of Sample No. 1-1K in Example 114 as described above except for employing an aluminum substrate roughened on its surface by the sand blasting method in place of the aluminum substrate used in preparation of the light-receiving member for electrography in Example 114. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 114, clear interference fringe was found to be formed in the black image over all the surface.

EXAMPLE 134

An aluminum substrate having a shape as shown in FIG. 9 [length (L) 357 mm, outerdiameter (r) 80 mm, pitch (P) 25 μm, depth (D) 0.8 μm; spirally grooved surface shape]was prepared.

Next, by means of the film deposition device as shown in FIG. 20, following the various procedures under the conditions shown in Table 1L, a-Si light-receiving layers were deposited on the above aluminum substrate (Sample No. 1-1L).

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 22 and FIG. 36.

Separately, on the cylindrical aluminum substrate with the same surface characteristic, light-receiving layers were formed in the same manner as described above except for changing the discharging power during formation of the first layer and the second layer each to 50 W. As the result, as shown in FIG. 64, the surface of the light-receiving layer was found to be in parallel to the surface of the substrate 1201. In this case, the difference in the total thickness between the center and both ends of the aluminum substrate was found to be 1 μm (Sample No. 1-2L).

Also, in the case of the above Sample No. 1-1A, as shown in FIG. 65, the surface of the light-receiving layer was found to be non-parallel to the surface of the substrate 1301. In this case, the difference in the total thickness between the center and both ends of the aluminum substrate was found to be 2 μm.

For these light-receiving members for electrophotography, image exposure was effected by means of a device as shown in FIG. 26 with a semiconductor laser of a wavelength of 780 nm at a spot diameter of 80 μm, followed by development and transfer, to obtain an image. In the light-receiving member having the surface characteristic as shown in FIG. 64, an interference fringe pattern was observed.

On the other hand, in the light-receiving member having the surface characteristic as shown in FIG. 65, no interference fringe pattern was observed and the member obtained exhibited practically satisfactory electrophotographic characteristics.

EXAMPLE 135

By means of a lathe, the surface of a cylindrical aluminum substrate was worked as shown in Table 2L. On these cylindrical aluminum substrates (Cylinder Nos. 101L-108L), under the same condition as in the case of the Sample No. 1-1L in Example 134, light-receiving members for electrophotography were prepared (Sample Nos. 111L-118L). The difference in average layer thickness between the center and the both ends of the aluminum substrate of the light-receiving members for electrophotography was found to be 2.2 μm.

The cross-sections of these light-receiving members for electrophotography were observed by electron microscope and the difference within the pitch of the light-receiving layer was measured to give the results as shown in Table 3L. For these light-receiving members, image exposure was effected by means of the device shown in FIG. 26 with a semiconductor laser with a wavelength of 780 nm at a spot diameter of 80 μm similarly as in Example 134 to obtain the results shown in Table 3L.

EXAMPLE 136

Light-receiving members for electrophotography were formed in the same manner as in the case of No. 1-1L in Example 134 except for during the preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 23 and FIG. 37.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 137

Light-receiving members for electrophotography were formed in the same manner as in the case of No. 1-1L in Example 134 under the conditions as shown in Table 4L.

In preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 24 and FIG. 38.

For these light-receiving members for electrophotography, by means of the same image exposure device as in Example 134, image exposure was effected, followed by development, transfer and fixing to obtain visible images on plain papers.

The images obtained in this case were free fron any interference fringe pattern observed, exhibiting practically satisfactory characteristics.

EXAMPLE 138

Light-receiving members for electrophotography were formed in the same manner as in Example 137 except that in preparation of the first layer, the mass flow controllers 2007, 2008 and 2010 were controlled by a computer (HP9845B) so that the flow rates of $GeH_4$, $SiH_4$ and $B_2H_6/H_2$ might be as shown in FIG. 25 and FIG. 39.

For these light-receiving members for electrophotography, by means of the same image exposure device as in Example 137, image exposure was effected, followed by development, transfer and fixing to obtain visible images on plain papers.

The images obtained in this case were free from any interference fringe pattern observed, exhibiting practically satisfactory characteristics.

EXAMPLE 139

Light-receiving members for electrophotography were formed in the same manner as in the case of No. 1-1L in Example 134 under the conditions as shown in Table 5L.

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 40.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 140

Light-receiving members for electrophotography were formed in the same manner as in the case of No. 1-1L in Example 134 under the conditions as shown in Table 6L.

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 41.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 141

Light-receiving members for electrophotography were formed in the same manner as in the case of No. 1-1L in Example 134 under the conditions as shown in Table 7L.

In preparation of the first layer and layer A, the mass flow controllers 2007, 2008 and 2010 were controlled by a computer (HP9845B) so that the flow rates of $GeH_4$, $SiH_4$ and $B_2H_6/H_2$ might be as shown in FIG. 42.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 142

A light-receiving member for electrophotography was prepared following the same condition and the procedure as in the case of No. 1-1L in Example 134 except for changing NO gas employed in Example 134 to $NH_3$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 143

A light-receiving member for electrophotography was prepared following the same condition and the procedure as in the case of No. 1-1L in Example 134 except for changing NO gas employed in Example 134 to $CH_4$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 144

A light-receiving member for electrophotography was prepared following the same condition and the procedure as described in Example 137 except for changing $NH_3$ gas employed in Example 137 to NO gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 145

A light-receiving member for electrophotography was prepared following the same condition and the procedure as described in Example 137 except for changing $NH_3$ gas employed in Example 137 to $CH_4$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 146

A light-receiving member for electrophotography was prepared following the same condition and the procedure as described in Example 139 except for changing $CH_4$ gas employed in Example 139 to NO gas.

For these light-receiving members for electrophotography, by means of the same image exposure device as in Example 134, image exposure was effected, followed by development, transfer and fixing to obtain visible images on plain papers The images obtained in this case were free from any interference fringe pattern observed, exhibiting practically satisfactory characteristics.

EXAMPLE 147

A light-receiving member for electrophotography was prepared following the same condition and the procedure as described in Example 139 except for changing $CH_2$ gas employed in Example 139 to $NH_3$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 148

Light-receiving members for electrophotography were formed in the same manner as in the case of No. 1-1L in Example 134 under the conditions as shown in Table 8L.

Figure 52:
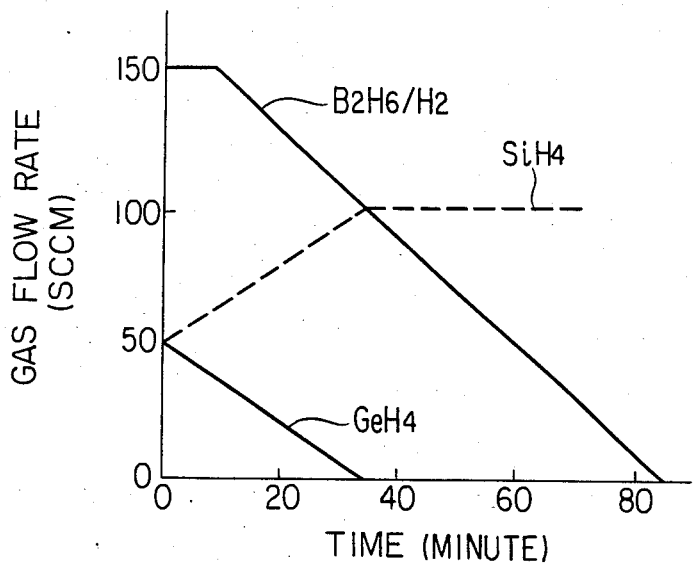

The mass flow controllers 2007, 2008, 2010 and 009 for $SiH_4$, $GeH_4$, $B_2H_6/H_2$ and $NH_3$ were controlled by a computer (HP9845B) so that the flow rates of $SiH_4$, $GeH_4$ and $B_2H_6/H_2$ gases might be as shown in FIG. 52 and the flow rate of $NH_3$ during formation of the nitrogen containing layer might be as shown in FIG. 56.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 149

A light-receiving member for electrophotography was prepared following the same condition and the procedure as described in Example 148 except for changing $NH_3$ gas employed in Example 148 to NO gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 150

A light-receiving member for electrophotography was prepared following the same condition and the procedure as described in Example 148 except for changing $NH_3$ gas employed in Example 148 to $CH_4$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 151

Light-receiving members for electrophotography were formed in the same manner as in the case of No. 1-1L in Example 134 under the conditions as shown in Table 9L.

Figure 53:
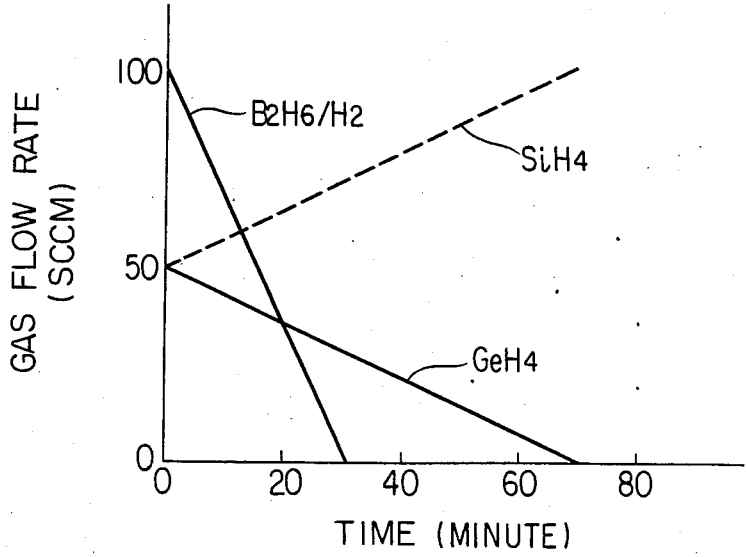

The mass flow controllers 2007, 2008, 2010 and 2009 for $SiH_4$, $GeH_4$, $B_2H_6/H_2$ and $CH_4$ were controlled by a computer (HP9845B) so that the flow rates of $SiH_4$, $GeH_4$ and $B_2H_6/H_2$ gases might be as shown in FIG. 53 and the flow rate of $CH_4$ during formation of the carbon containing layer might be as shown in FIG. 57.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 152

A light-receiving member for electrophotography was prepared following the same condition and the procedure as described in Example 151 except for changing $CH_4$ gas employed in Example 151 to NO gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 153

A light-receiving member for electrophotography was prepared following the same condition and the procedure as described in Example 151 except for changing $CH_4$ gas employed in Example 151 to $NH_3$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 154

Light-receiving members for electrophotography were formed in the same manner as in the case of No. 1-1L in Example 134 under the conditions as shown in Table 10L.

Figure 54:
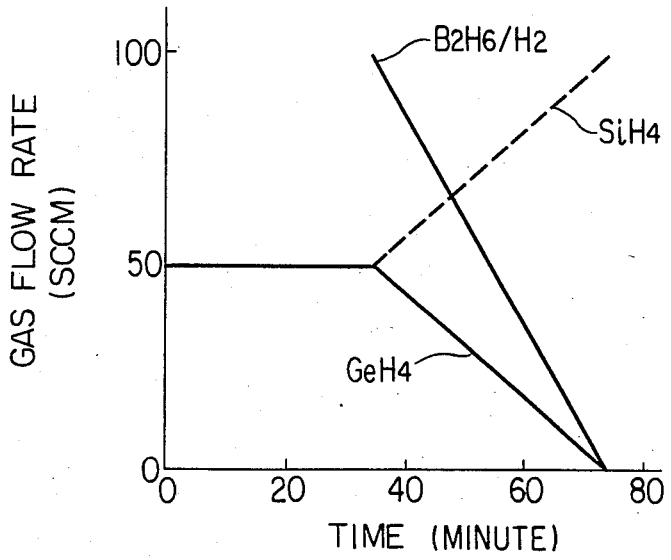

The mass flow controllers 2007, 2008, 2010 and 2009 for $SiH_4$, $GeH_4$, $B_2H_6/H_2$ and NO were controlled by a computer (HP9845B) so that the flow rates of $SiH_4$, $GeH_4$ and $B_2H_6/H_2$ gases might be as shown in FIG. 54 and the flow rate of NO during formation of the oxygen containing layer might be as shown in FIG. 58.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 155

A light-receiving member for electrophotography was prepared following the same condition and the procedure as described in Example 154 except for changing NO gas employed in Example 154 to $NH_3$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 156

A light-receiving member for electrophotography was prepared following the same condition and the procedure as described in Example 154 except for changing NO gas employed in Example 154 to $CH_4$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 157

Light-receiving members for electrophotography were formed in the same manner as in the case of No. 1-1L in Example 134 under the conditions as shown in Table 11L.

Figure 55:
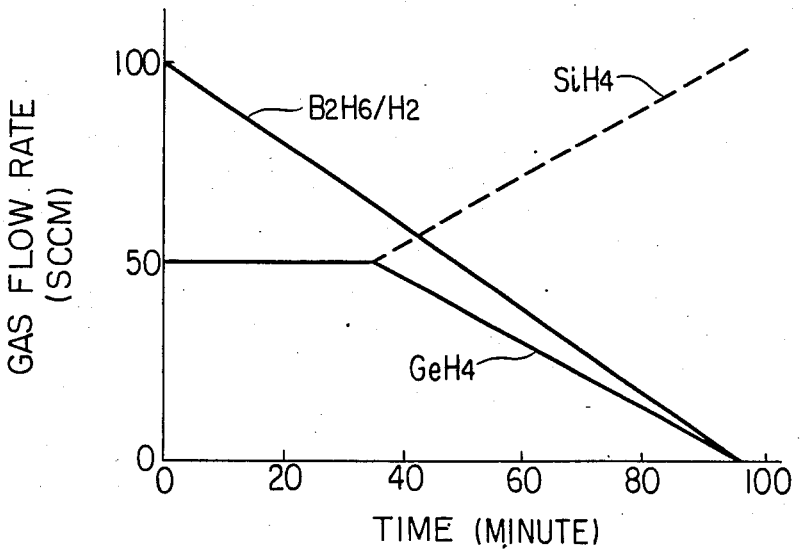

The mass flow controllers 2007, 2008, 2010 and 2009 for $SiH_4$, $GeH_4$, $B_2H_6/H_2$ and $NH_3$ were controlled by a computer (HP9845B) so that the flow rates of $SiH_4$, $GeH_4$ and $B_2H_6/H_2$ gases might be as shown in FIG. 55 and the flow rate of $NH_3$ during formation of the nitrogen containing layer might be as shown in FIG. 59.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 158

A light-receiving member for electrophotography was prepared following the same condition and the procedure as described in Example 157 except for changing $NH_3$ gas employed in Example 157 to NO gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 159

A light-receiving member for electrophotography was prepared following the same condition and the procedure as described in Example 157 except for changing $NH_3$ gas employed in Example 157 to $CH_4$ gas.

For these light-receiving members for electrophotography, by means of the same image exposure device as in Example 134, image exposure was effected, followed by development, transfer and fixing to obtain visible images on plain papers.

The images obtained in this case were free from any interference fringe pattern observed, exhibiting practically satisfactory characteristics.

EXAMPLE 160

The case of Sample No. 1-1L in Example 134 and Examples 136 to 159 were repeated except that $PH_3$ gas diluted to 3000 vol ppm with $H_2$ was employed in plate of $B_2H_6$ gas diluted to 3000 vol ppm with $H_2$ to prepare light-receiving members for electrophotography, respectively.

Other preparation conditions were the same as in the case of sample No. 1-1 L in Example 134 and Examples 136 to 159.

For these light-receiving members for electrophotography, image exposure was effected by means of an image exposure device as shown in FIG. 26 (wavelength of laser beam: 780 nm, spot diamter 80 μm), followed by development and transfer, to obtain images. All of the images were free from any interference fringe pattern and practically satisfactory.

COMPARATIVE EXAMPLE 12

As a comparative test, an a-Si light-receiving member for electrophotography was prepared in entirely the same manner as in the case of Sample No. 1-1L in Example 134 as described above except for employing an aluminum substrate roughened on its surface by the sand blasting method in place of the aluminum substrate used in preparation of the light-receiving member for electrography in Example 134. The surface condition of the aluminum substrate subjected to the surface roughening treatment according to the sand blasting method was measured by the Universal Surface Shape Measuring Instrument (SE-3C) produced by Kosaka Research Institute before provision of the light-receiving layer. As the result, the average surface roughness was found to be 1.8 μm.

When the same measurement was conducted by mounting the light-receiving member for electrophotography for comparative purpose on the device shown in FIG. 26 employed in Example 134, clear interference fringe was found to be formed in the black image over all the surface.

TABLE 1A

| Cylinder No. | 101A | 102A | 103A | 104A | 105A | 106A | 107A | 108A |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2A

| | Sample No. | | | | | | | |
|---|---|---|---|---|---|---|---|---|
| | 111A | 112A | 113A | 114A | 115A | 116A | 117A | 118A |
| | Cylinder No. | | | | | | | |
| | 101A | 102A | 103A | 104A | 105A | 106A | 107A | 108A |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent TABLE 1B-continued

| Cylinder No. | 101B | 102B | 103B | 104B | 105B | 106B | 107B | 108B |
|---|---|---|---|---|---|---|---|---|
| Angle (degree) | 0.2 | 5.7 | 2.1 | 5.0 | 4.8 | 3.7 | 2.3 | 38 |

TABLE 2B

| | Sample No. | | | | | | | |
|---|---|---|---|---|---|---|---|---|
| | 111B | 112B | 113B | 114B | 115B | 116B | 117B | 118B |
| | Cylinder No. | | | | | | | |
| | 101B | 102B | 103B | 104B | 105B | 106B | 107B | 108B |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 3A

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 4A

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| Second layer | $H_2$ | 300 | 300 | 24 | 20 |
| | $SiH_4$ | 300 | | | |

TABLE 5A

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| Second layer | $H_2$ | 300 | 300 | 24 | 20 |
| | $SiH_4$ | 300 | | | |

TABLE 6A

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| Second layer | $H_2$ | 300 | 300 | 24 | 20 |
| | $SiH_4$ | 300 | | | |

TABLE 1B

| Cylinder No. | 101B | 102B | 103B | 104B | 105B | 106B | 107B | 108B |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |

TABLE 3B

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | | $GeH_4 + SiH_4 = 100$ | | | |

TABLE 3B-continued

| Layer constitution | Starting gas | Gas flow rate (SCCM) | Discharging power (W) | Deposition rate (Å/sec) | Layer thickness (μm) |
|---|---|---|---|---|---|
| Second layer | $H_2$ | 300 | 300 | 24 | 20 |
| | $SiH_4$ | 300 | | | |

TABLE 4B

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | | $GeH_4 + SiH_4 = 100$ | | | |
| Second layer | $H_2$ | 300 | 300 | 24 | 20 |
| | $SiH_4$ | 300 | | | |

TABLE 1C

| Cylinder No. | 101C | 102C | 103C | 104C | 105C | 106C | 107C | 108C |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2C

| | Sample No. | | | | | | | |
|---|---|---|---|---|---|---|---|---|
| | 111C | 112C | 113C | 114C | 115C | 116C | 117C | 118C |
| | Cylinder No. | | | | | | | |
| | 101C | 102C | 103C | 104C | 105C | 106C | 107C | 108C |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 3C

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 4C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ (= 3000 vol ppm) | 100 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 5C

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 75 | | | |
| | $SiH_4$ | 25 | | | |
| | $B_2H_6/H_2$ (= 3000 vol ppm) | 50 | | | |

TABLE 5C-continued

| Layer constitution | | Starting gas | Gas flow rate (SCCM) | Discharging power (W) | Deposition rate (Å/sec) | Layer thickness (μm) |
|---|---|---|---|---|---|---|
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 6C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ (= 3000 vol ppm) | 150 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 7C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 25 | | | |
| | | $SiH_4$ | 75 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 8C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 9C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 10C

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 11C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 12 C

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 13 C

| Layer constitution | | Starting gas | Gas flow rate (SCCM) | Discharging power (w) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 14C

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |

TABLE 14C-continued

| Layer constitution | Starting gas | Gas flow rate (SCCM) | Discharging power (W) | Deposition rate (Å/sec) | Layer thickness (μm) |
|---|---|---|---|---|---|
| Second layer | $H_2$ | 300 | 300 | 24 | 20 |
| | $SiH_4$ | 300 | | | |

TABLE 15C

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 100 | | | |
| Layer B | $H_2$ | 300 | 100 | 10 | 2 |
| | $GeH_4$ | 50 | | | |
| | $SiH_4$ | 50 | | | |
| Second layer | $H_2$ | 300 | 300 | 24 | 20 |
| | $SiH_4$ | 300 | | | |

TABLE 16C

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| Layer B | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 1D

| Cylinder No. | 101D | 102D | 103D | 104D | 105D | 106D | 107D | 108D |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2D

| | Sample No. | | | | | | | |
|---|---|---|---|---|---|---|---|---|
| | 111D | 112D | 113D | 114D | 115D | 116D | 117D | 118D |
| | Cylinder No. | | | | | | | |
| | 101D | 102D | 103D | 104D | 105D | 106D | 107D | 108D |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 3D

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ (= 3000 vol ppm) | 100 | | | |
| | | $GeH_4 + SiH_4 = 100$ | | | |
| Second layer | $H_2$ | 300 | 300 | 24 | 20 |
| | $SiH_4$ | 300 | | | |

TABLE 4D

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |

TABLE 4D-continued

| Layer constitution | | Starting gas | Gas flow rate (SCCM) | Discharging power (W) | Deposition rate (Å/sec) | Layer thickness (μm) |
|---|---|---|---|---|---|---|
| | | $SiH_4$ | 0 → 100 | | | |
| | | $B_2H_6/H_2$ (= 3000 vol ppm) | 100 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 5D

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ (= 3000 vol ppm) | 100 | | | |
| | | $GeH_4 + SiH_4 = 100$ | | | |
| Second layer | $H_2$ | 300 | 300 | 24 | 20 |
| | $SiH_4$ | 300 | | | |

TABLE 6D

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 50 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 7D

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ = 3000 ppm | 100 | | | |
| | | | $GeH_4 + SiH_4 = 100$ | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | Layer B | $H_2$ | 300 | 300 | 24 | 20 |
| | | $SiH_4$ | 300 | | | |

TABLE 8D

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 1.5 |
| | | $GeH_4$ | 100 → 50 | | | |
| | | $SiH_4$ | 0 → 50 | | | |
| | | $B_2H_6/H_2$ (= 3000 vol ppm) | 100 | | | |
| | Layer B | $H_2$ | 300 | 100 | 10 | 1.5 |
| | | $GeH_4$ | 50 → 0 | | | |
| | | $SiH_4$ | 50 → 100 | | | |
| Second layer | | $H_2$ | 300 | 300 | 24 | 20 |

TABLE 8D-continued

| Layer constitution | Starting gas | Gas flow rate (SCCM) | Discharging power (W) | Deposition rate (Å/sec) | Layer thickness (μm) |
|---|---|---|---|---|---|
| | $SiH_4$ | 300 | | | |

TABLE 1E

| Cylinder No. | 101E | 102E | 103E | 104E | 105E | 106E | 107E | 108E |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2E

| | Sample No. | | | | | | | |
|---|---|---|---|---|---|---|---|---|
| | 111E | 112E | 113E | 114E | 115E | 116E | 117E | 118E |
| | Cylinder No. | | | | | | | |
| | 101E | 102E | 103E | 104E | 105E | 106E | 107E | 108E |
| Difference in layer thickness (μm) | 0.06 | 0.08 | 0.16 | 0.18 | 0.41 | 0.31 | 0.11 | 3.2 |
| Interference fringe | X | X | ○ | ○ | ⊛ | ◎ | Δ | X |

X . . . Practically unusable
Δ . . . Practically satisfactory
○ . . . Practically very good
◎ . . . Practically excellent

TABLE 3E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ (= 3000 vol ppm) | $B_2H_6/(GeH_4 + SiH_4)$ = 3/100 → 0 | | | |
| Second layer | $H_2$ | 300 | 300 | 24 | 20 |
| | $SiH_4$ | 300 | | | |

TABLE 4E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| | $B_2H_6/H_2$ (= 3000 vol ppm) | $B_2H_6/(GeH_4 + SiH_4)$ = 5/100 → 0 | | | |
| Second layer | $H_2$ | 300 | 300 | 24 | 20 |
| | $SiH_4$ | 300 | | | |

TABLE 5E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| | $B_2H_6/H_2$ (= 3000 vol ppm) | $B_2H_6/(GeH_4 + SiH_4)$ = 1/100 → 0 | | | |
| Second layer | $H_2$ | 300 | 300 | 24 | 20 |
| | $SiH_4$ | 300 | | | |

TABLE 6E

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| | $B_2H_6/H_2$ (= 3000 vol ppm) | $B_2H_6/(GeH_4 + SiH_4)$ = 1/100 → 0 | | | |
| Second layer | $H_2$ | 300 | 300 | 24 | 20 |
| | $SiH_4$ | 300 | | | |

TABLE 7E

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 → 110 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |

TABLE 8E

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 → 0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 9E

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 → 0 | | | |
| Second layer | | $H_2$ | 300 | 300 | 24 | 20 |
| | | $SiH_4$ | 300 | | | |

TABLE 10E

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 → 25 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 25 → 0 | | | |
| Second layer | | $H_2$ | 300 | 300 | 24 | 20 |
| | | $SiH_4$ | 300 | | | |

TABLE 1F

| Cylinder No. | 101F | 102F | 103F | 104F | 105F | 106F | 107F | 108F |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2F

| | Sample No. | | | | | | | |
|---|---|---|---|---|---|---|---|---|
| | 111F | 112F | 113F | 114F | 115F | 116F | 117F | 118F |
| | Cylinder No. | | | | | | | |
| | 101F | 102F | 103F | 104F | 105F | 106F | 107F | 108F |
| Difference in layer thickness (μm) | 0.06 | 0.08 | 0.16 | 0.18 | 0.41 | 0.31 | 0.11 | 3.2 |
| Interference | X | X | ○ | ○ | ◎ | ◎ | Δ | X |

TABLE 2F-continued

| Sample No. | | | | | | | |
|---|---|---|---|---|---|---|---|
| 111F | 112F | 113F | 114F | 115F | 116F | 117F | 118F |
| Cylinder No. | | | | | | | |
| 101F | 102F | 103F | 104F | 105F | 106F | 107F | 108F |

fringe

X . . . Practically unusable
Δ . . . Practically satisfactory
O . . . Practically very good
◎ . . . Practically excellent

TABLE 3F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ | 150 → 0 | | | |
| | (= 3000 vol ppm) | $GeH_4 + SiH_4 = 100$ | | | |
| Second layer | $H_2$ | 300 | 300 | 24 | 20 |
| | $SiH_4$ | 300 | | | |

TABLE 4F

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | $B_2H_6/H_2$ | 50 → 0 | | | |
| | (= 3000 vol ppm) | $GeH_4 + SiH_4 = 100$ | | | |
| Second layer | $H_2$ | 300 | 300 | 24 | 20 |
| | $SiH_4$ | 300 | | | |

TABLE 5F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| Second layer | Layer A | $H_2$ | 300 | 100 | 10 | 3 |
| | | $SiH_4$ | 100 | | | |
| | | $B_2H_6/H_2$ | 100 → 0 | | | |
| | | (= 3000 vol ppm) | | | | |
| | Layer B | $H_2$ | 300 | 300 | 24 | 20 |
| | | $SiH_4$ | 300 | | | |

TABLE 6F

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ | 100 → * | | | |
| | | (= 3000 vol ppm) | | | | |
| Second layer | Layer A | $H_2$ | 300 | 100 | 10 | 3 |
| | | $SiH_4$ | 100 | | | |
| | | $B_2H_6/H_2$ | * → 0 | | | |
| | | (= 3000 vol ppm) | | | | |
| | Layer B | $H_2$ | 300 | 300 | 24 | 20 |
| | | $SiH_4$ | 300 | | | |

Note:
The symbol * represents continuity of change in gas flow rate.

TABLE 7F

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 → 25 | | | |
| | | $SiH_4$ | 50 → 75 | | | |
| | | $B_2H_6/H_2$ | 100 → 0 | | | |
| | | (= 3000 vol ppm) | | | | |
| | Layer | $H_2$ | 300 | 100 | 10 | 2 |

TABLE 7F-continued

| Layer constitution | Starting gas | Gas flow rate (SCCM) | Discharging power (W) | Deposition rate (Å/sec) | Layer thickness (μm) |
|---|---|---|---|---|---|
| B | $GeH_4$ | 25 → 0 | | | |
| | $SiH_4$ | 75 → 100 | | | |
| Second layer | $H_2$ | 300 | 300 | 24 | 20 |
| | $SiH_4$ | 300 | | | |

TABLE 1aG

| Layer | Starting gas | Flow rate (SCCM) | High frequency power (W) | Layer thickness (μm) |
|---|---|---|---|---|
| First layer | $H_2$ | 300 | 160 | 5 |
| | $GeH_4$ | 50 | | |
| | $SiH_4$ | 100 | | |
| | NO | | | |
| Second layer | $H_2$ | 300 | 150 | 20 |
| | $SiH_4$ | 300 | | |

TABLE 2G

| Cylinder No. | 101G | 102G | 103G | 104G | 105G | 106G | 107G | 108G |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3G

| | Sample No. | | | | | | | |
|---|---|---|---|---|---|---|---|---|
| | 111G | 112G | 113G | 114G | 115G | 116G | 117G | 118G |
| | Cylinder No. | | | | | | | |
| | 101G | 102G | 103G | 104G | 105G | 106G | 107G | 108G |
| Difference in layer thickness (μm) | 0.06 | 0.08 | 0.16 | 0.18 | 0.41 | 0.31 | 0.11 | 3.2 |
| Interference fringe | X | X | ○ | ○ | ◎ | ◎ | Δ | X |

X . . . Practically unusable
Δ . . . Practically satisfactory
○ . . . Practically very good
◎ . . . Practically excellent

TABLE 4G

| Layer | Starting gas | Flow rate (SCCM) | High frequency power (W) | Layer thickness (μm) |
|---|---|---|---|---|
| First layer | $H_2$ | 300 | 160 | 3 |
| | $SiH_4$ | 100 | | |
| | $GeH_4$ | 50 | | |
| | $NH_3$ | 30 | | |
| Second layer | $H_2$ | 300 | 300 | 20 |
| | $SiH_4$ | 300 | | |

TABLE 5G

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15 | | |
| Second layer | $H_2$ | 300 | 200 | 20 |
| | $SiH_4$ | 300 | | |
| | $NH_3$ | 15 | | |

TABLE 6G

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 50 | | |
| | $GeH_4$ | 100 | | |
| | $CH_4$ | 15 | | |
| Second layer | $H_2$ | 300 | 200 | 21 |
| | $SiH_4$ | 300 | | |
| | $CH_4$ | 15 | | |

TABLE 7G

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $CH_4$ | 16 | | |
| Second layer | $H_2$ | 300 | 230 | 22 |
| | $SiH_4$ | 300 | | |

TABLE 8G

| Layer | Starting gas | Flow rate (SCCM) | High frequency power (W) | Layer thickness (μm) |
|---|---|---|---|---|
| First layer | $H_2$ | 300 | 160 | 3 |
| | $SiH_4$ | 50 | | |
| | $GeH_4$ | 100 | | |
| | $NH_3$ | 30~0 | | |
| Second layer | $H_2$ | 300 | 300 | 20 |
| | $SiH_4$ | 300 | | |

TABLE 9G

| Layer | Starting gas | Flow rate (SCCM) | High frequency power (W) | Layer thickness (μm) |
|---|---|---|---|---|
| First layer | $H_2$ | 300 | 160 | 5 |
| | $SiH_4$ | 100 | | |
| | $GeH_4$ | 50 | | |
| | $NH_3$ | 15~0 | | |
| Second layer | $H_2$ | 300 | 200 | 20 |
| | $SiH_4$ | 300 | | |
| | $NH_3$ | | | |

TABLE 10G

| Layer | Starting gas | Flow rate (SCCM) | High frequency power (W) | Layer thickness (μm) |
|---|---|---|---|---|
| First layer | $H_2$ | 300 | 170 | 2.8 |
| | $SiH_4$ | 100 | | |
| | $GeH_4$ | 50 | | |
| | $CH_4$ | 15~0 | | |
| Second layer | $H_2$ | 300 | 200 | 21 |
| | $SiH_4$ | 300 | | |

TABLE 11G

| Layer | Starting gas | Flow rate (SCCM) | High frequency power (W) | Layer thickness (μm) |
|---|---|---|---|---|
| First layer | $H_2$ | 300 | 170 | 5.1 |
| | $SiH_4$ | 100 | | |
| | $GeH_4$ | 60 | | |
| | $CH_4$ | 16~0 | | |

TABLE 11G-continued

| Layer | Starting gas | Flow rate (SCCM) | High frequency power (W) | Layer thickness (μm) |
|---|---|---|---|---|
| Second layer | $H_2$ | 300 | 230 | 22 |
| | $SiH_4$ | 300 | | |
| | $CH_4$ | | | |

TABLE 12G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 150 | 12 | 1 |
| Second layer | $SiH_4/He = 0.05$ | $SiH_4 = 50$ | | 150 | 12 | 20 |

TABLE 13G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 2/10 \sim 0$ | 150 | 12 | 0.5 |
| Second layer | $SiH_4/He = 0.05$ | $SiH_4 = 50$ | | 150 | 12 | 20 |

TABLE 14G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 1/10 \sim 1/100$ | 160 | 14 | 5 |
| Second layer | $SiH_4/He = 0.05$ | $SiH_4 = 50$ | | 160 | 14 | 15 |

TABLE 15G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 160 | 14 | 1.0 |
| Second layer | $SiH_4/He = 0.05$ | $SiH_4 = 50$ | | 160 | 12 | 15 |

TABLE 16G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>NO | $SiH_4 + GeH_4 = 50$ | $NO/(SiH_4 + GeH_4) = 3/10 \sim 0$ | 170 | 15 | 1 |
| Second layer | $SiH_4/He = 0.05$ | $SiH_4 = 50$ | | 170 | 15 | 20 |

TABLE 17G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4He = 0.05$<br>$NH_3$ | $SiH_4 + GeH_4 = 50$ | $NH_3/SiH_4 + GeH_4) = 1/10 \sim 1/100$ | 160 | 14 | 5 |
| Second | $SiH_4/He = 0.05$ | $SiH_4 = 50$ | $NH_3/SiH_4 = 1/100$ | 160 | 14 | 15 |

TABLE 17G-continued

| Layer constitution | Gases employed | Flow rate (SCCM) | Flow rate ratio | Discharging power (W) | Layer formation rate (Å/sec) | Layer thickness (μm) |
|---|---|---|---|---|---|---|
| layer | $NH_3$ | | | | | |

TABLE 18G

| Layer constitution | Gases employed | Flow rate (SCCM) | Flow rate ratio | Discharging power (W) | Layer formation rate (Å/sec) | Layer thickness (μm) |
|---|---|---|---|---|---|---|
| First layer | $SiH_4/He = 0.05$<br>$GeH_4/He = 0.05$<br>$CH_4$ | $SiH_4 + GeH_4 = 50$ | $CH_4/(SiH_4 + GeH_4) = 1/10 \sim 1/100$ | 160 | 14 | 5 |
| Second layer | $SiH_4/He = 0.05$<br>$CH_4$ | $SiH_4 = 50$ | $CH_4/SiH_4 = 1/100$ | 160 | 14 | 15 |

TABLE 1H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | NO | $GeH_4 + SiH_4 = 100$ | | | |
| | | 10 | | | |
| Second layer | $H_2$ | 300 | 300 | 24 | 20 |
| | $SiH_4$ | 300 | | | |

TABLE 2H

| Cylinder No. | 101H | 102H | 103H | 104H | 105H | 106H | 107H | 108H |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3H

| | Sample No. | | | | | | | |
|---|---|---|---|---|---|---|---|---|
| | 111H | 112H | 113H | 114H | 115H | 116H | 117H | 118H |
| | Cylinder No. | | | | | | | |
| | 101H | 102H | 103H | 104H | 105H | 106H | 107H | 108H |
| Difference in layer thickness (μm) | 0.06 | 0.08 | 0.16 | 0.18 | 0.41 | 0.31 | 0.11 | 3.2 |
| Interference fringe | X | X | ○ | ○ | ◉ | ◎ | Δ | X |

X . . . Practically unusable
Δ . . . Practically satisfactory
○ . . . Practically very good
◎ . . . Practically excellent

TABLE 4H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $100 \rightarrow 0$ | | | |
| | $SiH_4$ | $0 \rightarrow 100$ | | | |
| | $CH_4$ | $GeH_4 + SiH_4 = 100$ | | | |
| | | 10 | | | |
| Second layer | $H_2$ | 300 | 300 | 24 | 20 |
| | $SiH_4$ | 300 | | | |

TABLE 5H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | $50 \rightarrow 0$ | | | |
| | $SiH_4$ | $50 \rightarrow 100$ | | | |
| | $NH_3$ | $GeH_4 + SiH_4 = 100$ | | | |
| | | 10 | | | |
| Second layer | $H_2$ | 300 | 300 | 24 | 20 |
| | $SiH_4$ | 300 | | | |

TABLE 6H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | $NH_3$ | $GeH_4 + SiH_4 = 100$ | | | |
| | | 6 | | | |
| Second layer | $H_2$ | 300 | 300 | 24 | 20 |
| | $SiH_4$ | 300 | | | |
| | $NH_3$ | 6 | | | |

TABLE 7H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | NO | $GeH_4 + SiH_4 = 100$ | | | |
| | | 20 → 0 | | | |
| Second layer | $H_2$ | 300 | 300 | 24 | 20 |
| | $SiH_4$ | 300 | | | |

TABLE 8H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $NH_3$ | $GeH_4 + SiH_4 = 100$ | | | |
| | | 20 → 0 | | | |
| Second layer | $H_2$ | 300 | 300 | 24 | 20 |
| | $SiH_4$ | 300 | | | |

TABLE 9H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | NO | $GeH_4 + SiH_4 = 100$ | | | |
| | | 10 → * | | | |
| Second layer | $H_2$ | 300 | 300 | 24 | 20 |
| | $SiH_4$ | 300 | | | |
| | NO | * → 0 | | | |

Note:
The symbol * represents continuity of change in the gas flow rate.
The same note applies to Table 9I.

TABLE 10H

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $CH_4$ | $GeH_4 + SiH_4 = 100$ | | | |
| | | 10 → 0 | | | |
| Second layer | $H_2$ | 300 | 300 | 24 | 20 |
| | $SiH_4$ | 300 | | | |

TABLE 1I

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 50 | | | |

TABLE 1I-continued

| | Starting gas | Gas flow rate (SCCM) | Discharging power (W) | Deposition rate (Å/sec) | Layer thickness (μm) |
|---|---|---|---|---|---|
| | $SiH_4$ | 50 | | | |
| | $B_2H_6/H_2$ | 100 | | | |
| | (= 3000 vol ppm) | 10 | | | |
| | NO | | | | |
| Second layer | $H_2$ | 300 | 300 | 24 | 20 |
| | $SiH_4$ | 300 | | | |

TABLE 2I

| Cylinder No. | 101I | 102I | 103I | 104I | 105I | 106I | 107I | 108I |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3I

| | Sample No. | | | | | | | |
|---|---|---|---|---|---|---|---|---|
| | 111I | 112I | 113I | 114I | 115I | 116I | 117I | 118I |
| | Cylinder No. | | | | | | | |
| | 101I | 102I | 103I | 104I | 105I | 106I | 107I | 108I |
| Difference in layer thickness (μm) | 0.06 | 0.08 | 0.16 | 0.18 | 0.41 | 0.31 | 0.11 | 3.2 |
| Interference fringe | X | X | ◎ | ◎ | ◎ | ◎ | Δ | X |

X . . . Practically unusable
Δ . . . Practically satisfactory
○ . . . Practically very good
◎ . . . Practically excellent

TABLE 4I

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 50 | | | |
| | | $SiH_4$ | 50 | | | |
| | | $B_2H_6/H_2$ | 100 | | | |
| | | (= 3000 vol ppm) | 11 | | | |
| | | $NH_3$ | | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | Layer B | $H_2$ | 300 | 300 | 24 | 20 |
| | | $SiH_4$ | 300 | | | |

TABLE 5I

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ | 50 | | | |
| | | (= 3000 vol ppm) | 10 | | | |
| | | $CH_4$ | | | | |
| Second layer | Layer A | $H_2$ | 300 | 100 | 8 | 5 |
| | | $SiH_4$ | 100 | | | |
| | | $B_2H_6/H_2$ | 100 | | | |
| | | (= 3000 vol ppm) | | | | |
| | Layer B | $H_2$ | 300 | 300 | 24 | 20 |
| | | $SiH_4$ | 300 | | | |

TABLE 6I

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 1 |
| | | $GeH_4$ | 75 | | | |
| | | $SiH_4$ | 25 | | | |
| | | $B_2H_6/H_2$ | 150 | | | |
| | | (= 3000 vol ppm) | | | | |
| | | NO | 10 | | | |
| Second layer | Layer A | $H_2$ | 300 | 100 | 8 | 5 |
| | | $SiH_4$ | 100 | | | |
| | | $B_2H_6/H_2$ | 100 | | | |

TABLE 6I-continued

| Layer constitution | | Starting gas | Gas flow rate (SCCM) | Discharging power (W) | Deposition rate (Å/sec) | Layer thickness (μm) |
|---|---|---|---|---|---|---|
| | | (= 3000 vol ppm) | | | | |
| | | NO | 10 | | | |
| | Layer | $H_2$ | 300 | 300 | 24 | 20 |
| | B | $SiH_4$ | 300 | | | |
| | | NO | 10 | | | |

TABLE 7I

| Layer constitution | | Starting gas | Gas flow rate (SCCM) | Discharging power (W) | Deposition rate (Å/sec) | Layer thickness (μm) |
|---|---|---|---|---|---|---|
| First | | $H_2$ | 300 | 100 | 10 | 1 |
| layer | | $GeH_4$ | 25 | | | |
| | | $SiH_4$ | 75 | | | |
| | | $NH_3$ | 12 | | | |
| Second | Layer | $H_2$ | 300 | 100 | 8 | 5 |
| layer | A | $SiH_4$ | 100 | | | |
| | | $B_2H_6/H_2$ | 100 | | | |
| | | (= 3000 vol ppm) | | | | |
| | | $NH_3$ | 12 | | | |
| | Layer | $H_2$ | 300 | 300 | 24 | 20 |
| | B | $SiH_4$ | 300 | | | |
| | | $NH_3$ | 12 | | | |

TABLE 8I

| Layer constitution | | Starting gas | Gas flow rate (SCCM) | Discharging power (W) | Deposition rate (Å/sec) | Layer thickness (μm) |
|---|---|---|---|---|---|---|
| First | Layer | $H_2$ | 300 | 100 | 10 | 2 |
| layer | A | $GeH_4$ | 50 | | | |
| | | $SiH_4$ | 50 | | | |
| | | $B_2H_6/H_2$ | 100 | | | |
| | | (= 3000 vol ppm) | | | | |
| | | $CH_4$ | 8 | | | |
| | Layer | $H_2$ | 300 | 100 | 10 | 2 |
| | B | $GeH_4$ | 50 | | | |
| | | $SiH_4$ | 50 | | | |
| | | $CH_4$ | 8 | | | |
| Second layer | | $H_2$ | 300 | 300 | 24 | 20 |
| | | $SiH_4$ | 300 | | | |
| | | $CH_4$ | 8 | | | |

TABLE 9I

| Layer constitution | | Starting gas | Gas flow rate (SCCM) | Discharging power (W) | Deposition rate (Å/sec) | Layer thickness (μm) |
|---|---|---|---|---|---|---|
| First | Layer | $H_2$ | 300 | 100 | 10 | 2 |
| layer | A | $GeH_4$ | 50 | | | |
| | | $SiH_4$ | 50 | | | |
| | | | 10~* | | | |
| | Layer | $H_2$ | 300 | 100 | 10 | 2 |
| | B | $GeH_4$ | 50 | | | |
| | | $SiH_4$ | 50 | | | |
| | | $B_2H_6/H_2$ | 100 | | | |
| | | (= 3000 vol ppm) | | | | |
| | | NO | *~0 | | | |
| Second layer | | $H_2$ | 300 | 300 | 24 | 20 |
| | | $SiH_4$ | 300 | | | |

TABLE 10I

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 5 |
| | $GeH_4$ | 50 | | | |
| | $SiH_4$ | 50 | | | |
| | $B_2H_6/H_2$ | 100 | | | |
| | (= 3000 vol ppm) | 10~0 | | | |
| | $NH_3$ | - | | | |
| Second layer | $H_2$ | 300 | 300 | 24 | 20 |

TABLE 10I-continued

| | Starting gas | Gas flow rate (SCCM) | Discharging power (W) | Deposition rate (Å/sec) | Layer thickness (μm) |
|---|---|---|---|---|---|
| | $SiH_4$ | 300 | | | |

TABLE 11I

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | 10~0 | | | |
| | Layer B | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | 100 | | | |
| Second layer | | $H_2$ | 300 | 300 | 24 | 20 |
| | | $SiH_4$ | 300 | | | |

TABLE 12I

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 | | | |
| | | NO | 10~* | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | NO | *~** | | | |
| | Layer B | $H_2$ | 300 | 300 | 24 | 20 |
| | | $SiH_4$ | 300 | | | |
| | | NO | **~0 | | | |

TABLE 13I

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 150 | | | |
| | | $NH_3$ | 10~* | | | |
| Second layer | Layer A | $H_2$ | 300 | 100 | 8 | 3 |
| | | $SiH_4$ | 100 | | | |
| | | $B_2H_6/H_2$ (= 3000 vol ppm) | 100 | | | |
| | | $NH_3$ | *~** | | | |
| | Layer B | $H_2$ | 300 | 300 | 24 | 20 |
| | | $SiH_4$ | 300 | | | |
| | | $NH_3$ | **~0 | | | |

TABLE 14I

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $CH_4$ | 10~* | | | |
| | Layer B | $H_2$ | 300 | 100 | 8 | 3 |
| | | $GeH_4$ | 50 | | | |
| | | $SiH_4$ | 50 | | | |

TABLE 14I-continued

| Layer constitution | Starting gas | Gas flow rate (SCCM) | Discharging power (W) | Deposition rate (Å/sec) | Layer thickness (μm) |
|---|---|---|---|---|---|
| | $B_2H_6/H_2$ (= 3000 vol ppm) | 100 | | | |
| | $CH_4$ | *~** | | | |
| Second layer | $H_2$ | 300 | 300 | 24 | 20 |
| | $SiH_4$ | 300 | | | |
| | $CH_4$ | **~0 | | | |

TABLE 15I

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 100 | | | |
| | NO | 8 | | | |
| Layer B | $H_2$ | 300 | 100 | 10 | 2 |
| | $GeH_4$ | 50 | | | |
| | $SiH_4$ | 50 | | | |
| Second layer | $H_2$ | 300 | 300 | 24 | 20 |
| | $SiH_4$ | 300 | | | |

TABLE 16I

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | $NH_3$ | 11 | | | |
| Layer B | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 100 | | | |
| Second layer | $H_2$ | 300 | 300 | 24 | 20 |
| | $SiH_4$ | 300 | | | |

TABLE 1J

| Cylinder No. | 101J | 102J | 103J | 104J | 105J | 106J | 107J | 108J |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 2J

| | Sample No. | | | | | | | |
|---|---|---|---|---|---|---|---|---|
| | 111J | 112J | 113J | 114J | 115J | 116J | 117J | 118J |
| | Cylinder No. | | | | | | | |
| | 101J | 102J | 103J | 104J | 105J | 106J | 107J | 108J |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎ . . . Practically excellent

TABLE 3J

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4 + SiH_4 = 100$ | | | |
| | NO | 12 | | | |
| Second layer | $H_2$ | 300 | 300 | 24 | 20 |
| | $SiH_4$ | 300 | | | |

TABLE 4J

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 100 | | | |
| | | | $GeH_4 + SiH_4 = 100$ | | | |
| | | $NH_3$ | 8 | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | 8 | | | |
| | Layer B | $H_2$ | 300 | 300 | 24 | 20 |
| | | $SiH_4$ | 300 | | | |
| | | $NH_3$ | 8 | | | |

TABLE 5J

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 3 |
| | $GeH_4$ | 100 → 0 | | | |
| | $SiH_4$ | 0 → 100 | | | |
| | $B_2H_6/H_2$ (= 3000 vol ppm) | 100 | | | |
| | | $GeH_4 + SiH_4 = 100$ | | | |
| | $CH_4$ | 10 → 0 | | | |
| Second layer | $H_2$ | 300 | 300 | 24 | 20 |
| | $SiH_4$ | 300 | | | |

TABLE 6J

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | $B_2H_6/H_2$ (= 3000 vol ppm) | 50 | | | |
| | | | $GeH_4 + SiH_4 = 100$ | | | |
| | | NO | 10 → * | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | NO | * → ** | | | |
| | Layer B | $H_2$ | 300 | 300 | 24 | 20 |
| | | $SiH_4$ | 300 | | | |
| | | NO | ** → 0 | | | |

TABLE 7J

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 3 |
| | | $GeH_4$ | 50 → 0 | | | |
| | | $SiH_4$ | 50 → 100 | | | |
| | | | $GeH_4 + SiH_4 = 100$ | | | |
| | | $NH_3$ | 10 → * | | | |
| Second layer | Layer A | $H_2$ | 300 | 100 | 8 | 5 |
| | | $SiH_4$ | 100 | | | |
| | | $B_2H_6/H_2$ (= 3000 vol ppm) | 100 | | | |
| | | $NH_3$ | * → ** | | | |
| | Layer B | $H_2$ | 300 | 300 | 24 | 20 |
| | | $SiH_4$ | 300 | | | |
| | | $NH_3$ | ** → 0 | | | |

TABLE 8J

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 1.5 |
| | | $GeH_4$ | 100 → 0 | | | |
| | | $SiH_4$ | 0 → 100 | | | |
| | | $B_2H_6/H_2$ (= 3000 vol ppm) | 100 | | | |
| | | $CH_4$ | 10 → * | | | |
| | Layer B | $H_2$ | 300 | 100 | 10 | 1.5 |
| | | $GeH_4$ | 50 → 0 | | | |
| | | $SiH_4$ | 50 → 100 | | | |
| | | $CH_4$ | * → ** | | | |
| Second layer | | $H_2$ | 300 | 300 | 24 | 20 |
| | | $SiH_4$ | 300 | | | |
| | | $CH_4$ | ** → 0 | | | |

TABLE 1K

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 1 |
| | $GeH_4$ | 100 | | | |
| | $SiH_4$ | 100 | | | |
| | $B_2H_6/H_2$ (= 3000 vol ppm) | $B_2H_6/(GeH_4 + SiH_4)$ = 3/100 → 0 | | | |
| | NO | 12 | | | |
| Second layer | $H_2$ | 300 | 300 | 24 | 20 |
| | $SiH_4$ | 300 | | | |

TABLE 2K

| Cylinder No. | 101K | 102K | 103K | 104K | 105K | 106K | 107K | 108K |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3K

| | Sample No. | | | | | | | |
|---|---|---|---|---|---|---|---|---|
| | 111K | 112K | 113K | 114K | 115K | 116K | 117K | 118K |
| | Cylinder No. | | | | | | | |
| | 101K | 102K | 103K | 104K | 105K | 106K | 107K | 108K |
| Difference in layer thickness (μm) | 0.06 | 0.08 | 0.16 | 0.18 | 0.41 | 0.31 | 0.11 | 3.2 |
| Interference fringe | X | X | | | | | Δ | X |

X . . . Practically unusable
Δ . . . Practically satisfactory
. . . Practically very good
. . . Practically excellent

TABLE 4K

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 14 | 3 |
| | $GeH_4$ | 100 | | | |
| | $SiH_4$ | 50 | | | |
| | $B_2H_6/H_2$ (= 3000 vol ppm) | $B_2H_6/(GeH_4 + SiH_4)$ = 5/100 → 0 | | | |
| | $NH_3$ | 10 | | | |
| Second layer | $H_2$ | 300 | 300 | 24 | 20 |
| | $SiH_4$ | 300 | | | |
| | $NH_3$ | 10 | | | |

TABLE 5K

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 12 | 5 |
| | $GeH_4$ | 50 | | | |
| | $SiH_4$ | 100 | | | |
| | $B_2H_6/H_2$ (= 3000 vol ppm) | $B_2H_6/(GeH_4 + SiH_4)$ = 1/100 → 0 | | | |
| | $CH_4$ | 15 | | | |
| Second layer | $H_2$ | 300 | 300 | 24 | 20 |

TABLE 5K-continued

| | Starting gas | Gas flow rate (SCCM) | Discharging power (W) | Deposition rate (Å/sec) | Layer thickness (μm) |
|---|---|---|---|---|---|
| | $SiH_4$ | 300 | | | |

TABLE 6K

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 8 | 7 |
| | $GeH_4$ | 15 | | | |
| | $SiH_4$ | 135 | | | |
| | $B_2H_6/H_2$ (= 3000 vol ppm) | $B_2H_6/(GeH_4 + SiH_4)$ = 1/100 → 0 | | | |
| | NO | 15 | | | |
| Second layer | $H_2$ | 300 | 300 | 24 | 20 |
| | $SiH_4$ | 300 | | | |
| | NO | 15 | | | |

TABLE 7K

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 → 110 | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |

TABLE 8K

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | $CH_4$ | 10 → 0 | | | |
| | Layer B | $H_2$ | 300 | 100 | 10 | 2 |
| | | $GeH_4$ | 50 | | | |
| | | $SiH_4$ | 50 | | | |
| Second layer | | $H_2$ | 300 | 300 | 24 | 20 |
| | | $SiH_4$ | 300 | | | |

TABLE 9K

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 | | | |
| | | $SiH_4$ | 50 | | | |
| | | NO | 10 → * | | | |
| | Layer B | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 100 | | | |
| | | | 50 → 0 | | | |
| | | NO | * → ** | | | |
| Second layer | | $H_2$ | 300 | 300 | 24 | 20 |
| | | $SiH_4$ | 300 | | | |
| | | NO | ** → 0 | | | |

TABLE 10K

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 | | | |
| | | $SiH_4$ | 50 | | | |
| | | $B_2H_6/H_2$ (= 3000 vol ppm) | 50 → *** | | | |
| | | $NH_3$ | 10 → * | | | |
| Second layer | Layer A | $H_2$ | 300 | 100 | 8 | 3 |
| | | $GeH_4$ | 50 | | | |
| | | $SiH_4$ | 50 | | | |
| | | $B_2H_6/H_2$ (= 3000 vol ppm) | *** → 0 | | | |
| | | $NH_3$ | * → ** | | | |
| | Layer B | $H_2$ | 300 | 300 | 24 | 20 |
| | | $SiH_4$ | 300 | | | |
| | | $NH_3$ | ** → 0 | | | |

Note:
The symbol *** represents continuity of change in the gas flow rate.

TABLE 1L

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 100 → 0 | | | |
| | $SiH_4$ | 0 → 100 | | | |
| | $B_2H_6/H_2$ (= 3000 vol ppm) | $GeH_4 + SiH_4 = 100$ 150 → 0 | | | |
| | NO | 12 | | | |
| Second layer | $H_2$ | 300 | 300 | 24 | 20 |
| | $SiH_4$ | 300 | | | |

TABLE 2L

| Cylinder No. | 101L | 102L | 103L | 104L | 105L | 106L | 107L | 108L |
|---|---|---|---|---|---|---|---|---|
| Pitch (μm) | 600 | 200 | 100 | 50 | 40 | 25 | 10 | 5.0 |
| Depth (μm) | 1.0 | 10 | 1.8 | 2.1 | 1.7 | 0.8 | 0.2 | 2 |
| Angle (degree) | 0.2 | 5.7 | 2.1 | 5.0 | 4.8 | 3.7 | 2.3 | 38 |

TABLE 3L

| | Sample No. | | | | | | | |
|---|---|---|---|---|---|---|---|---|
| | 111L | 112L | 113L | 114L | 115L | 116L | 117L | 118L |
| | Cylinder No. | | | | | | | |
| | 101L | 102L | 103L | 104L | 105L | 106L | 107L | 108L |
| Difference in layer thickness (μm) | 0.06 | 0.08 | 0.16 | 0.18 | 0.41 | 0.31 | 0.11 | 3.2 |
| Interference fringe | X | X | ○ | ◎ | ◎ | ◎ | Δ | X |

X . . . Practically unusable
Δ . . . Practically satisfactory
○ . . . Practically very good
◎ . . . Practically excellent

TABLE 4L

| | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 9 | 3 |
| | $GeH_4$ | 50 → 0 | | | |
| | $SiH_4$ | 50 → 100 | | | |
| | $B_2H_6/H_2$ (= 3000 vol ppm) | $GeH_4 + SiH_4 = 100$ 50 → 0 | | | |
| | $NH_3$ | 12 | | | |
| Second layer | $H_2$ | 300 | 300 | 24 | 20 |
| | $SiH_4$ | 300 | | | |
| | $NH_3$ | 12 | | | |

TABLE 5L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $CH_4$ | 15 | | | |
| Second | Layer | $H_2$ | 300 | 100 | 10 | 3 |

TABLE 5L-continued

| Layer constitution | | Starting gas | Gas flow rate (SCCM) | Discharging power (W) | Deposition rate (Å/sec) | Layer thickness (μm) |
|---|---|---|---|---|---|---|
| layer | A | $SiH_4$ | 100 | | | |
| | | $B_2H_6/H_2$ (= 3000 vol ppm) | 100 → 0 | | | |
| | Layer B | $H_2$ | 300 | 300 | 24 | 20 |
| | | $SiH_4$ | 300 | | | |

TABLE 6L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 100 | | | |
| | | NO | 10 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 100 → 0 | | | |
| | | NO | 10 | | | |
| | Layer B | $H_2$ | 300 | 300 | 24 | 20 |
| | | $SiH_4$ | 300 | | | |
| | | NO | 10 | | | |

TABLE 7L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 → 25 | | | |
| | | $SiH_4$ | 50 → 75 | | | |
| | | $B_2H_6/H_2$ (= 3000 vol ppm) | 100 → 0 | | | |
| | | $NH_3$ | 10 | | | |
| | Layer B | $H_2$ | 300 | 100 | 10 | 2 |
| | | $GeH_4$ | 25 → 0 | | | |
| | | $SiH_4$ | 75 → 100 | | | |
| | | $NH_3$ | 10 | | | |
| Second layer | | $H_2$ | 300 | 300 | 24 | 20 |
| | | $SiH_4$ | 300 | | | |

TABLE 8L

| Layer constitution | | Starting gas | Gas flow rate (SCCM) | Discharging power (W) | Deposition rate (Å/sec) | Layer thickness (μm) |
|---|---|---|---|---|---|---|
| First layer | | $H_2$ | 300 | 100 | 10 | 2 |
| | | $GeH_4$ | 50 → 0 | | | |
| | | $SiH_4$ | 50 → 100 | | | |
| | | $B_2H_6/H_2$ (= 3000 vol ppm) | 150 → 110 | | | |
| | | $NH_3$ | 10 → 0 | | | |
| Second layer | Layer A | $H_2$ | 300 | 100 | 10 | 3 |
| | | $SiH_4$ | 100 | | | |
| | | $B_2H_6/H_2$ (= 3000 vol ppm) | 110 → 0 | | | |
| | Layer B | $H_2$ | 300 | 300 | 24 | 20 |
| | | $SiH_4$ | 300 | | | |

TABLE 9L

| Layer constitution | | Starting gas | Gas flow rate (SCCM) | Discharging power (W) | Deposition rate (Å/sec) | Layer thickness (μm) |
|---|---|---|---|---|---|---|
| First layer | Layer A | $H_2$ | 300 | 100 | 10 | 2 |
| | | $GeH_4$ | 50 → * | | | |
| | | $SiH_4$ | 50 → ** | | | |
| | | $B_2H_6/H_2$ (= 3000 vol ppm) | 100 → 0 | | | |
| | | $CH_4$ | 10 → 0 | | | |

TABLE 9L-continued

| Layer constitution | Starting gas | Gas flow rate (SCCM) | Discharging power (W) | Deposition rate (Å/sec) | Layer thickness (μm) |
|---|---|---|---|---|---|
| Layer B | $H_2$ | 300 | 100 | 10 | 2 |
| | $GeH_4$ | * → 0 | | | |
| | $SiH_4$ | ** → 100 | | | |
| Second layer | $H_2$ | 300 | 300 | 24 | 20 |
| | $SiH_4$ | 300 | | | |

TABLE 10L

| Layer constitution | Starting gas | Gas flow rate (SCCM) | Discharging power (W) | Deposition rate (Å/sec) | Layer thickness (μm) |
|---|---|---|---|---|---|
| First layer Layer A | $H_2$ | 300 | 100 | 10 | 2 |
| | $GeH_4$ | 50 | | | |
| | $SiH_4$ | 50 | | | |
| | NO | 10 → * | | | |
| Layer B | $H_2$ | 300 | 100 | 10 | 2 |
| | $GeH_4$ | 50 → 0 | | | |
| | $SiH_4$ | 50 → 100 | | | |
| | $B_2H_6/H_2$ (= 3000 vol ppm) | 100 → 0 | | | |
| | NO | * → ** | | | |
| Second layer | $H_2$ | 300 | 300 | 24 | 20 |
| | $SiH_4$ | 300 | | | |
| | NO | ** → 0 | | | |

TABLE 11L

| Layer constitution | Starting gas | Gas flow rate (SCCM) | Discharging power (W) | Deposition rate (Å/sec) | Layer thickness (μm) |
|---|---|---|---|---|---|
| First layer | $H_2$ | 300 | 100 | 10 | 2 |
| | $GeH_4$ | 50 | | | |
| | $SiH_4$ | 50 | | | |
| | $B_2H_6/H_2$ (= 3000 vol ppm) | 100 → *** | | | |
| | $NH_3$ | 10 → * | | | |
| Second layer Layer A | $H_2$ | 300 | 100 | 8 | 3 |
| | $GeH_4$ | 50 → 0 | | | |
| | $SiH_4$ | 50 → 100 | | | |
| | $B_2H_6/H_2$ (= 3000 vol ppm) | *** → 0 | | | |
| | $NH_3$ | * → ** | | | |
| Layer B | $H_2$ | 300 | 300 | 24 | 20 |
| | $SiH_4$ | 300 | | | |
| | $NH_3$ | ** → 0 | | | |

Note:
The symbol *** represents continuity of change in the gas flow rate.

We claim:

1. A light receiving member comprising a substrate and a light-receiving layer of a multi-layer structure having a first layer comprising an amorphous material containing silicon atoms and germanium atoms and a second layer comprising an amorphous material containing silicon atoms and exhibiting photoconductivity provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

2. The invention according to claim 1, wherein the light-receiving layer has a layer thickness of 1 to 100 μm.

3. The invention according to claim 1, wherein the layer thickness $T_B$ of the first layer and the layer thickness T of the second layer satisfy the relationship of $TB/T \leqq 1$.

4. The invention comprising a light-receiving member comprising a substrate and a light-receiving layer of a multi-layer structure having a first layer comprising an amorphous material containing silicon atoms and germanium atoms and a second layer comprising an amorphous material containing silicon atoms and exhibiting photoconductivity provided successively from the substrate side, said light-receiving layer having at least one pair of non-parallel interfaces within a short range and said non-parallel interfaces being arranged in a large number in at least one direction within the plane perpendicular to the layer thickness direction, said non-parallel interfaces being connected to one another smoothly in the direction in which they are arranged.

5. The invention according to claim 1 or 4 wherein the arrangement is made regularly.

6. The invention according to claim 1 or 4, wherein the arrangement is made in cycles.

7. The invention according to claim 1 or 4, wherein the short range is 0.3 to 500 μm.

8. The invention according to claim 1 or 4, wherein the non-parallel interfaces are formed on the basis of the smooth unevenness arranged regularly provided on the surface of the substrate.

9. The invention according to claim 8, wherein the unevenness is formed by sinusoidal linear projections.

10. The invention according to claim 1 or 4, wherein the substrate is cylindrical.

11. The invention according to claim 10, wherein the sinusoidal linear projection has a spiral structure within the surface of the substrate.

12. The invention according to claim 11, wherein the spiral structure is a multiple spiral structure.

13. The invention according to claim 9, wherein the sinusoidal linear projection is divided in its edge line direction.

14. The invention according to claim 11, wherein the edge line direction of the sinusoidal linear projection is along the center axis of the cylindrical substrate.

15. The invention according to claim 8, wherein the smooth unevenness has slanted planes.

16. The invention according to claim 15 wherein the slanted planes are mirror finished.

17. The invention according to claim 8, wherein on the free surface of the light-receiving layer is formed a smooth unevenness arranged with the same pitch as the smooth unevenness provided on the substrate surface.

18. The invention according to claim 1 or 4, wherein the distribution state of germanium atoms in the first layer is nonuniform in the layer thickness direction.

19. The invention according to claim 18, the nonunirom distribution state of germanium atoms is more enriched toward the substrate side.

20. The invention according to claim 1 or 4, wherein a substance for controlling conductivity is contained in the first layer.

21. The invention according to claim 1 or 4, wherein the substance for controlling conductivity is an atom belonging to the group III or the group V of the periodic table.

22. The invention according to claim 1 or 4, wherein a substance for controlling conductivity is contained in the second layer.

23. The invention according to claim 22, wherein the substance for controlling conductivity is an atom belonging to the group III or the group V of the periodic table.

24. The invention according to claim 1 or 4, wherein the light-receiving layer has a layer region (PN) containing a substance for controlling conductivity.

25. The invention according to claim 24, wherein the distribution state of the substance for controlling conductivity in the layer region (PN) is nonuniform in the layer thickness direction.

26. The invention according to claim 24, wherein the distribution state of the substance for controlling conductivity in the layer region (PN) is uniform in the layer thickness direction.

27. The invention according to claim 24, wherein the substance for controlling conductivity is an atom belonging to the group III or the group V of the periodic table.

28. The invention according to claim 24, wherein the layer region (PN) is provided in the first layer.

29. The invention according to claim 24, wherein the layer region (PN) is provided in the second layer.

30. The invention according to claim 24, wherein the layer region (PN) is provided at the end portion on the substrate side of the light-receiving layer.

31. The invention according to claim 24, wherein the layer region (PN) is provided over both the first layer and the second layer.

32. The invention according to claim 24, wherein the layer region (PN) occupies a part of the layer region in the light-receiving layer.

33. The invention according to claim 32, wherein the content of the substance for controlling conductivity in the layer region (PN) is 0.01 to $5\times10^4$ atomic ppm.

34. The invention according to claim 1 or 4, wherein at least one of hydrogen atoms and halogen atoms is contained in the first layer.

35. The invention according to claim 1 or 4, wherein 0.01 to 40 atomic % of hydrogen atoms are contained in the first layer.

36. The invention according to claim 4, wherein 0.01 to 40 atomic % of halogen atoms are contained in the first layer.

37. The invention according to claim 1 or 4, wherein 0.01 to 40 atomic % as a total of hydrogen atoms and halogen atoms are contained in the first layer.

38. The invention according to claim 1 or 4, wherein 1 to 40 atomic % of hydrogen atoms are contained in the second layer.

39. The invention according to claim 1 or 4, wherein 1 to 40 atomic % of halogen atoms are contained in the second layer.

40. The invention according to claim 1 or 4, wherein 1 to 40 atomic % as a total of hydrogen atoms and halogen atoms are contained in the second layer.

41. The invention according to claim 1 or 4, wherein at least one of hydrogen atoms and halogen atoms is contained in the second layer.

42. The invention according to claim 1 or 4, wherein the light-receiving layer contains at least one kind of atoms selected from oxygen atoms, carbon atoms and nitrogen atoms.

43. The invention according to claim 1 or 4, wherein the light-receiving layer has a layer region (OCN) containing at least one kind of atoms selected from oxygen atoms, carbon atoms and nitrogen atoms.

44. The invention according to claim 43, wherein the layer region (OCN) is provided at the end portion on the substrate side of the light-receiving layer.

45. The invention according to claim 44, wherein the layer region (OCN) contains 0.001 to 50 atomic % of oxygen atoms.

46. The invention according to claim 44, wherein the layer region (OCN) contains 0.001 to 50 atomic % of carbon atoms.

47. The invention according to claim 44, wherein the layer region (OCN) contains 0.001 to 50 atomic % of nitrogen atoms.

48. The invention according to claim 44, wherein oxygen atoms are contained in the layer region (OCN) in nonuniform distribution state in the layer thickness direction.

49. The invention according to claim 44, wherein oxygen atoms are contained in the layer region (OCN) in uniform distribution state in the layer thickness direction.

50. The invention according to claim 44, wherein carbon atoms are contained in the layer region (OCN) in nonuniform distribution state in the layer thickness direction.

51. The invention according to claim 44, wherein carbon atoms are contained in the layer region (OCN)

in uniform distribution state in the layer thickness direction.

52. The invention according to claim 44, wherein nitrogen atoms are contained in the layer region (OCN) in nonuniform distribution state in the layer thickness direction.

53. The invention according to claim 44, wherein nitrogen atoms are contained in the layer region (OCN) in uniform distrubution state in the layer thickness direction.

54. The invention according to claim 1 or 4, wherein the first layer has a layer thickness of 30Å to 50 μm.

55. The invention according to claim 1 or 4, wherein the second layer has a layer thickness of 0.5 to 90 μm.

56. An electrophotographic image forming process comprising:

(a) applying a charging treatment to the light receiving member of claim 1;

(b) irradiating the light receiving member with a laser beam carrying information to form an electrostatic latent image; and (c) developing said electrostatic latent image.

* * * * *

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

AT [57] IN THE ABSTRACT

Line 10, "aranged" should read --arranged--.

IN THE DRAWINGS

Sheet 24, Figure 61, "TIME (MINUTE") should be inserted.

Sheet 30, Figure 73, "THICKNES" should read --THICKNESS--.

COLUMN 1

Line 11, "726,768," should read --726,768;--.
Line 11, "739,867, 740,714,714;" should read --739,867; 740,714;--.
Line 12, "752,920 and 753,011." should read --and 752,920.--.
Line 41, "patent application" should read --Patent Application--.

COLUMN 2

Line 3, "patent application" should read --Patent Application--.
Line 8, "easiness" should read --ease--.
Line 16, "an" should read --a--.
Line 27, "iamge." should read --image.--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 3

Line 13, "sized" should read --sizes--.
Line 23, "sufficinent" should read --sufficient--.
Line 60, "may be" should read --is--.

COLUMN 4

Line 5, "so much" should read --greatly--.
Line 38, "interferance" should read --interference--.
Line 51, "light- receiving" should read --light-receiving--.
Line 53, "speckless" should read --speckles--.

COLUMN 6

Line 5, "thichness" should read --thickness--.
Line 17, "lgiht" should read --light--.
Line 31, "($d_7 \div d_8$)," should read --($d_7 \neq d_8$),--.
Line 38, "exsit" should read --exist--.

COLUMN 7

Line 22, "bite" should read --bit--.
Line 40, "spital" should read --spiral--.
Line 64, "earlily" should read --easily--.

COLUMN 8

Line 6, "0 6 to 2" should read --0.6 to 2--.
Line 17, "thichness" should read --thickness--.
Line 42, "the all" should read --all the--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 9

Line 29, "as hereinafter," should read --hereinafter,--.
Line 31, "great", should read --greatly,--.

COLUMN 10

Line 12, "(substahtially" should read --(substantially--.
Line 28, "tB to" should read --$t_B$ to--.
Line 68, "side" should read --side.--.

COLUMN 12

Line 12, "bormine" should read --bromine--.
Line 48, "easiness" should read --ease--.
Line 56, "easiness" should read --ease--.

COLUMN 13

Line 9, "so called" should read --so-called--.
Line 39, "ion plating" should read --ion-plating--.

COLUMN 14

Line 6, "$siH_2I_2$" should read --$SiH_2I_2$--.

COLUMN 15

Line 47, "depending on" should be deleted.

UNITED STATES PATENT AND TRADEMARK OFFICE

CERTIFICATE OF CORRECTION

DATED : September 29, 1987

INVENTOR(S) : KEISHI SAITOH, ET AL

It is certified that error appears in the above-identified patent and that said Letters Patent is hereby corrected as shown below:

COLUMN 16

Line 9, "so called" should read --so-called--.
Line 27, "suibably be" should read --suitably--.

COLUMN 17

Line 19, "so called" should read --so-called--.
Lines 24-25, "so called" should read --so-called--.

COLUMN 18

Line 21, "$t_T$. In" should read --$t_T$. ¶ In--.
Line 33, "substance C" should read --substance (C)--.

COLUMN 19

Line 28, "Typical" should read --As typical--.

COLUMN 25

Line 8, "contaiing" should read --containing--.
Line 57, "$B_2H_6$" should read --$B_2H_6/H_2$--.
Line 60, "period" should read --period of--.

COLUMN 26

Line 22, "outerdiameter" should read --outer diameter--.
Line 51, "developement" should read --development--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 27

Line 65, "electrophography" should read --electrophotography--.

COLUMN 28

Line 14, "outerdiameter" should read --outer diameter--.

COLUMN 30

Line 27, "outerdiameter" should read --outer diameter--.

COLUMN 33

Line 5, "mages" should read --images--.
Line 25, "elcctrophotography" should read --electrophotography--.

COLUMN 34

Line 31, "light receiving" should read --light-receiving--.
Line 39, "outerdiameter" should read --outer diameter--.
Line 64, "laycr" should read --layer--.

COLUMN 35

Line 51, "mages" should read --images--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 37

Line 36, "PH3" should read --$PH_3$--.
Line 58, "light receiving" should read --light-receiving--.
Line 59, "electrography" should read --electrophotography--.

COLUMN 38

Line 8, "outerdiameter" should read --outer diameter--.
Line 36, "lascr" should read --laser--.

COLUMN 39

Lines 13-4, "practicaly" should read --practically--.
Line 26, "ootained" should read --obtained--.
Lines 27-8, "practicaly" should read --practically--.
Lines 41-2, "practicaly" should read --practically--.
Lines 59-60, "practicaly" should read --practically--.

COLUMN 40

Lines 9-10, "practicaly" should read --practically--.
Line 24, "mages" should read --images--.
Lines 27-8, "practicaly" should read --practically--.
Line 36, "controllor" should read --controller--.
Lines 45-6 "practicaly" should read --practically--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 41

Line 21, "outerdiameter" should read --outer diameter--.
Line 30, "$GeH_4$ and $SiH_4$" should read --$GeH_4$, $SiH_4$ and $B_2H_6/H_2$--.
Line 34, "substarte" should read --substrate--.

COLUMN 43

Line 10, "preparat:on" should read --preparation--.
Line 10, "A." should read --A,--.
Line 40, "EXAMPLIE 54" should read --EXAMPLE 54--.

COLUMN 44

Line 18, "to" should read --is to--.
Line 20, "0.85" should read --0.8 μm.--.
Line 24, "a si" should read --a-Si--.
Line 25, "tollowing" should read --following--.

COLUMN 45

Line 1, "light receiving" should read --light-receiving--.
Line 3, "11G-118G)." should read --111G-118G).--
Line 5, "thc light receiving" should read --the light-receiving--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 46

Line 7, "thc" should read --the--.
Line 37, "light receiving" should read --light-receiving--.
Line 44, "Light receiving" should read --Light-receiving--.
Line 61, "thcse" should read --these--.
Line 68, "sarisfactory" should read --satisfactory--.

COLUMN 47

Line 31, "No. -1G" should read --No. 1-1G--.
Line 67, "changc ratc "should read --change rate--.

COLUMN 48

Line 17, "electrography" should read --electrophotography--.
Line 32, "EXAMPLE 39" should read --EXAMPLE 69--.
Line 34, "outerdiameter should read --outer diameter--.
Line 49, "durng" should read --during--.
Line 52, "light receiving" should read --light-receiving--.
Line 57, "No 1-1H," should and --No. 1-1H,--.
Line 64, "mean" should read --means--.

COLUMN 49

Line 3, "light receiving" should read --light-receiving--.
Line 10, "1athe" should read --lathe--.
Line 12, "Nos" should read --Nos.--.
Line 36, "Table 4H." should read --in Table 4H.--.
Line 55, "Table 6H." should read --Table 5H.--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 50

Line 24 "NH3" should read --$NH_3$--.
Line 38 "$CH_4$ Q gas." should read --$CH_4$ gas.--.

COLUMN 52

Line 33, "outerdiameter" should read --outer diameter--.
Line 38-9 "lightreceiving" should read --light receiving--.

COLUMN 53

Lines 29-30, "No. 1'I" should read --No. 1-1I--.
Line 30, "example" should read --Example--.

COLUMN 56

Line 46, "COMPARITIVE" should read --COMPARATIVE--.
Lines 54-5, "electrography" should read --electrophotography--.

COLUMN 57

Line 6, "0.8 s." should read --0.8 μm--.
Line 32, "thickenss" should read -thickness--.

COLUMN 58

Line 45, "development and transfer fixing" should read --development, transfer and fixing--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 61

Lines 50-51, "electrography" should read --electrophotography--.
Line 68, "outerdiameter" should read --outer diameter--.

COLUMN 64

Line 20, "NH gas" should read --$NH_3$ gas--.

COLUMN 66

Line 59, "di1uted" should read --diluted--.

COLUMN 67

Line 14, "electrography" should read --electrophotography--.
Line 31, "outerdiameter" should read --outer diameter--.
Line 33, "shape]was" should read --shape] was--.

COLUMN 71

Line 11, "$CH_2$" should read --$CH_4$--.
Line 28, "009" should read --2009--.

COLUMN 74

Line 20, "case" should read --cases--.
Line 21, "plate" should read --place--.
Line 26, "sample" should read --Sample--.
Line 46, "electrography" should read --electrophotography--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 85

Table 7D, "= 3000 ppm" should read --(=3000 vol ppm)--.

COLUMN 93

Table 3G, "X X ○○ " should read --X X ○◎ --.

COLUMN 95

Table 17G, "$GeH_4He$ = 0.05" should read GeH4/He = 0.05--.

COLUMN 97

Table 1H, "NO $GeH_4$ + $SiH_4$ = 100"
10 should read

--NO $GeH_4$ + $SiH_4$ = 100--
10

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 98

Table 3H, "X X ○○ " should read --X X ○◎ --.

Table 4H, "$CH_4$ $GeH_4$ + Si $H_4$ = 100"
10 should read

-- $GeH_4$ + Si $H_4$ = 100--
$CH_4$ 10

Table 5H, "$NH_3$ $GeH_4$ + $SiH_4$ = 100" should read
10

-- $GeH_4$ + $SiH_4$ = 100--
$NH_3$ 10

COLUMN 99

Table 6H, "$NH_3$ $GeH_4$ + $SiH_4$ = 100"
6 should read

-- $GeH_4$ + $SiH_4$ = 100--
$NH_3$ 6

Table 7H, "N0 $GeH_4$ + $SiH_4$ = 100"
20 0 should read

-- $GeH_4$ + $SiH_4$ = 100--
NO 20 0

Table 8H,"$NH_3$ $GeH_4$ + $SiH_4$ = 100"
20 0 should read

-- $GeH_4$ + $SiH_4$ = 100--
$NH_3$ 20 0

CERTIFICATE OF CORRECTION

PATENT NO. : 4,696,882
DATED : September 29, 1987
INVENTOR(S) : KEISHI SAITOH, ET AL It is certified that error appears in the above-identified patent and that said Letters Patent is hereby corrected as shown below:

COLUMN 99 (continued)

Table 9H, "N0 $GeH_4$ + $SiH_4$ $H_4$ = 100"
10 * should read

-- $GeH_4$ + $SiH_4$ $H_4$ = 100--
N0 10 *

Table 10H, "$CH_4$ $GeH_4$ + $SiH_4$ = 100"
10 * should read

-- $GeH_4$ + $SiH_4$ = 100
$CH_4$ 10 0

COLUMN 101

Table 1 I-cont., "(= 3000 vol ppm) 10"
N0 should read

--(= 3000 vol ppm)
NO 10--

Table 4I, "(= 3000 vol ppm) 11"
$NH_3$ should read

--(= 3000 vol ppm)
$NH_3$ 11--

Table 5I, "(= 3000 vol ppm) 10"
$CH_4$ should read

--(= 3000 vol ppm)
$CH_4$ 10--

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 103

Table 10I, "(= 3000 vol ppm) 10 ~ 0"
$NH_3$ should read

--(= 3000 vol ppm)
$NH_3$ 10 ~ 0--

COLUMN 105

Table 12I, At the end of Table 12I the following should be inserted:

-- Note: The symbols * and ** represent continuity of change in the gas flow rate respectively. The same note applies to the subsequent other tables.--

COLUMN 108

Table 2J, "○ . . . Practically excellent" should read
--◎ . . . Practically excellent--.

COLUMN 112

Table 3K, " X X Δ" should read
--X X ○ ◎ ◎ ◎ Δ X--.

Table 3K, ". . . Practically very good
. . . Practically excellent"

should read

--○ . . . Practically very good
◎ . . . Practically excellent--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 115

Table 4L, "Starting gas °" should read --Starting gas--

Table 4L, "$B_2H_6/H_2$ (= 3000 vol ppm) $GeH_4$ + $SiH_4$ = 100" 50 0 should read --$B_2H_6/H_2$ (= 3000 vol ppm) $GeH_4$ + $SiH_4$ = 100"-- 50 0

COLUMN 119

Line 68, "TB/T $\leq$ 1." should read --$T_B/T \leq 1$.--.

COLUMN 120

Line 47, "4. The invention" should read --4. An electrophotographic system--.

Line 61, "4 wherein" should read --4, wherein--.

COLUMN 121

Line 7, "claim 10," should read --claim 9,--.

Line 15, "claim 11," should read --claim 10,--.

Line 20, "15 wherein" should read --15, wherein--.

Line 29, "18, the nonuni- should read --18, wherein--.

Line 30, "rom" should read --the nonuniform--.

UNITED STATES PATENT AND TRADEMARK OFFICE

CERTIFICATE OF CORRECTION

PATENT NO. : 4,696,882

DATED : September 29, 1987

INVENTOR(S) : KEISHI SAITOH, ET AL

It is certified that error appears in the above-identified patent and that said Letters Patent is hereby corrected as shown below:

COLUMN 122

Line 16, "claim 4," should read --claim 1 or 4,--.

COLUMN 123

Line 11, "distrubution" should read --distribution--.

Signed and Sealed this

Seventh Day of February, 1989

*Attest:*

DONALD J. QUIGG

*Attesting Officer*

*Commissioner of Patents and Trademarks*